US009380386B2

(12) United States Patent
Fujita

(10) Patent No.: US 9,380,386 B2
(45) Date of Patent: Jun. 28, 2016

(54) DISTORTION SOUND CORRECTION COMPLEMENT DEVICE AND DISTORTION SOUND CORRECTION COMPLEMENT METHOD

(71) Applicant: CLARION CO., LTD., Saitama-shi (JP)

(72) Inventor: Yasuhiro Fujita, Kashiwa (JP)

(73) Assignee: CLARION CO., LTD., Saitama-Shi (JP)

( * ) Notice: Subject to any disclaimer, the term of this patent is extended or adjusted under 35 U.S.C. 154(b) by 0 days.

(21) Appl. No.: 14/647,125

(22) PCT Filed: Nov. 18, 2013

(86) PCT No.: PCT/JP2013/081076

§ 371 (c)(1),
(2) Date: May 26, 2015

(87) PCT Pub. No.: WO2014/087833

PCT Pub. Date: Jun. 12, 2014

(65) Prior Publication Data

US 2015/0304775 A1 Oct. 22, 2015

(30) Foreign Application Priority Data

Dec. 3, 2012 (JP) ..... 2012-264764

(51) Int. Cl.
*H04R 3/04* (2006.01)

(52) U.S. Cl.
CPC ..... *H04R 3/04* (2013.01); *H04R 2430/03* (2013.01); *H04R 2499/13* (2013.01)

(58) Field of Classification Search
CPC ..... H04R 3/04; H04R 3/00; H04R 3/06; H04R 3/08; H04R 3/10; H04R 2430/00; H04R 2430/03
USPC ..... 381/94.1, 94.8, 71.14, 94.3, 94.2; 327/311, 310, 306, 100, 307, 133
See application file for complete search history.

(56) References Cited

U.S. PATENT DOCUMENTS

2004/0234083 A1 11/2004 Katou et al.
2009/0041265 A1 2/2009 Kubo

FOREIGN PATENT DOCUMENTS

JP 2001-224100 8/2001
JP 2004-320516 11/2004
JP 2009-44268 2/2009
JP 2010-124016 6/2010

OTHER PUBLICATIONS

International Search Report for corresponding International Application No. PCT/JP2013/081076, Feb. 25, 2014.

*Primary Examiner* — Paul S Kim
*Assistant Examiner* — Sabrina Diaz
(74) *Attorney, Agent, or Firm* — Mori & Ward, LLP

(57) ABSTRACT

A device and method relates to reducing distortion of signal. The device includes a first filter unit for generating a correction band signal, a signal level detection unit for detecting a signal level of the correction band signal, a first lookup table unit for determining a control signal, a second lookup table unit for determining a correction amount, a correction band extraction signal generation unit for generating a correction band extraction signal, a correction signal generation unit for generating a correction signal, a first edge detection unit for generating an overtone signal from the correction band extraction signal, a filter unit for suppressing high-frequency range and low-frequency range signal levels of the overtone signal, a first amplification unit for amplifying the overtone signal, a second filter unit for generating a complement signal from the overtone signal, and an output signal generation unit for generating an output signal.

12 Claims, 35 Drawing Sheets

FIG. 7(a)

| ITEM | | CONDITIONS | REMARKS |
|---|---|---|---|
| FIRST FILTER UNIT | | 36 Hz (CENTER FREQUENCY) | QUALITY FACTOR Q: 4, GAIN: -8 [dB] |
| SIGNAL LEVEL DETECTION UNIT | MAXIMUM VALUE DETECTION UNIT | 64 SAMPLES | SAMPLING FREQUENCY: 44.1 kHz |
| | MAXIMUM VALUE HOLD UNIT | 64 SAMPLES | SAMPLING FREQUENCY: 44.1 kHz/64 |
| CORRECTION GAIN CALCULATION UNIT | ATTACK RELEASE FILTER UNIT | ATTACK TIME: 0.02 [s]<br>RELEASE TIME: 0.5 [s] | |
| | FIRST LOOKUP TABLE UNIT | WHEN INPUT LEVEL IS GREATER THAN OR EQUAL TO -8 [dB] , CONVERSION IS PERFORMED. | INPUT LEVEL IS CONVERTED BY FIRST LOOKUP TABLE UNIT. |
| | SECOND LOOKUP TABLE UNIT | WHEN INPUT LEVEL IS GREATER THAN OR EQUAL TO -8 [dB] , CONVERSION IS PERFORMED. | INPUT LEVEL IS CONVERTED BY SECOND LOOKUP TABLE UNIT. |

FIG. 7(b)

| ITEM | DETAILS | CONDITIONS |
|---|---|---|
| FIRST HPF UNIT | THIRD-ORDER BUTTERWORTH HIGH-PASS FILTER; FOR HIGH-FREQUENCY RANGE EXTRACTION | 36 Hz |
| SECOND LPF UNIT | THIRD-ORDER BUTTERWORTH LOW-PASS FILTER; FOR LOW-FREQUENCY RANGE EXTRACTION | 36 Hz |
| LEVEL DETECTION SIGNAL GENERATION UNIT | FIRST-ORDER BUTTERWORTH HIGH-PASS FILTER; FOR ADDING WEIGHT | 20 Hz |
| SECOND HPF UNIT | THIRD-ORDER BUTTERWORTH HIGH-PASS FILTER; FOR LOWER-LIMIT FREQUENCY OF OVERTONE | 45 Hz |
| THIRD LPF UNIT | FIFTH ORDER BUTTERWORTH LOW-PASS FILTER; FOR UPPPER-LIMIT FREQUENCY OF OVERTONE | 70 Hz |
| PHASE INVERSION UNIT | PHASE OF OVERTONE (-1: WITH PHASE INVERSION; +1: WITHOUT PHASE INVERSION) | -1 |
| AMPLIFICATION UNIT | OVERTONE GAIN (AMPLIFICATION INITIAL VALUE)<br>* CORRECTION AMOUNT IS ADDED TO THIS VALUE. | 61dB # |

Overtone gain setting value changes according to band (frequency) which is to be complemented.
Formula: 20*log10(36/44100) = −61.7627

FIG. 29(a)

| ITEM | | CONDITIONS | REMARKS |
|---|---|---|---|
| FIRST FILTER UNIT | | 100 Hz (CENTER FREQUENCY) | QUALITY FACTOR Q: 4, GAIN: -8 [dB] |
| SIGNAL LEVEL DETECTION UNIT | MAXIMUM VALUE DETECTION UNIT | 64 SAMPLES | SAMPLING FREQUENCY: 44.1 kHz |
| | MAXIMUM VALUE HOLD UNIT | 64 SAMPLES | SAMPLING FREQUENCY: 44.1 kHz/64 |
| CORRECTION GAIN CALCULATION UNIT | ATTACK RELEASE FILTER UNIT | ATTACK TIME: 0.02 [s]<br>RELEASE TIME: 0.5 [s] | |
| | FIRST LOOKUP TABLE UNIT | WHEN INPUT LEVEL IS GREATER THAN OR EQUAL TO -8 [dB] , CONVERSION IS PERFORMED. | INPUT LEVEL IS CONVERTED BY FIRST LOOKUP TABLE UNIT. |
| | SECOND LOOKUP TABLE UNIT | WHEN INPUT LEVEL IS GREATER THAN OR EQUAL TO -8 [dB] , CONVERSION IS PERFORMED. | INPUT LEVEL IS CONVERTED BY SECOND LOOKUP TABLE UNIT. |

FIG. 29(b)

| ITEM | DETAILS | CONDITIONS |
|---|---|---|
| FIRST HPF UNIT | THIRD-ORDER BUTTERWORTH HIGH-PASS FILTER; FOR HIGH-FREQUENCY RANGE EXTRACTION | 100 Hz |
| SECOND LPF UNIT | THIRD-ORDER BUTTERWORTH LOW-PASS FILTER; FOR LOW-FREQUENCY RANGE EXTRACTION | 100 Hz |
| LEVEL DETECTION SIGNAL GENERATION UNIT | FIRST-ORDER BUTTERWORTH HIGH-PASS FILTER; FOR ADDING WEIGHT | 20 Hz |
| SECOND HPF UNIT | THIRD-ORDER BUTTERWORTH HIGH-PASS FILTER; FOR LOWER-LIMIT FREQUENCY OF OVERTONE | 100 Hz |
| THIRD LPF UNIT | FIFTH ORDER BUTTERWORTH LOW-PASS FILTER; FOR UPPPER-LIMIT FREQUENCY OF OVERTONE | 130 Hz |
| PHASE INVERSION UNIT | PHASE OF OVERTONE (-1: WITH PHASE INVERSION; +1: WITHOUT PHASE INVERSION) | -1 |
| FIRST AMPLIFICATION UNIT | OVERTONE GAIN (AMPLIFICATION INITIAL VALUE)<br>* CORRECTION AMOUNT IS ADDED TO THIS VALUE. | Approx. 53 dB #1 |
| SECOND AMPLIFICATION UNIT | OVERTONE GAIN (AMPLIFICATION INITIAL VALUE)<br>* CORRECTION AMOUNT IS ADDED TO THIS VALUE. | Approx. 59 dB #2 |
| PEAKING FILTER UNIT | SECOND-ORDER PEAKING FILTER (BANDWIDTH LIMITING) | 50 Hz #3 |

#1 and 2: Overtone gain setting value changes according to band (frequency) which is to be complemented.
Formula #1: 20*log10(100/44100) = −52.8888, Formula #2: 20*log10(50/44100) = −58.9094 #2
#3: Because correction band frequency is set to 100 Hz, complement signal is generated at a half thereof.

DISTORTION SOUND CORRECTION COMPLEMENT DEVICE AND DISTORTION SOUND CORRECTION COMPLEMENT METHOD

TECHNICAL FIELD

The present invention relates to a distortion sound correction complement device and a distortion sound correction complement method and more particularly to a distortion sound correction complement device and a distortion sound correction complement method that are able to suppress distorted sound that emerges in an output signal output from a speaker as well as to improve the quality of the sound.

BACKGROUND ART

Conventionally, various devices and methods have been proposed to correct acoustic characteristics in a vehicle interior. For example, first, in a listening environment such as inside the vehicle interior, a microphone is placed at a specific position such as a driver's seat, and frequency characteristics between the speaker and the microphone are measured. Then, the frequency setting, amplitude setting, and band setting of a filter are optimized in such a way as to be within an allowable range of a target response curve, thereby correcting the frequency characteristics. Such a method has been known (Refer to Patent Literature 1, for example).

CITATION LIST

Patent Literature

Patent Literature 1: Japanese Patent Application Laid-Open Publication No. 2001-224100

SUMMARY OF INVENTION

Technical Problem

However, even if the frequency characteristics are corrected as described above, distorted sound is generated beyond the reproduction capability of the speaker when a large amount is corrected in a specific frequency band and when music or the like is output at a relatively high volume. As a result, the quality of the sound may deteriorate significantly.

In recent years, the market for compact vehicles has been growing, and relatively low-priced vehicles have become popular. Power amplifiers and speakers that are mounted in compact vehicles do not necessarily have high reproduction capabilities. Therefore, there is a possibility that the reproduction capabilities of acoustic equipment could be limited by the performance of power amplifiers and speakers. In such a case, the problem is that the reproduction capabilities of acoustic equipment may not be consistent with the reproduction capabilities of amplifiers and speakers even after the frequency characteristics are corrected as described above.

For example, when distorted sound is generated, the gain of an appropriate band (or low-frequency range in many cases) is lowered by sound-field correction in order to suppress the distortion. However, simply lowering the gain leads to a decrease in the output of the low-frequency range. Therefore, the problem is that the low-frequency range becomes thin in terms of audibility.

The present invention has been made in view of the above problems, and an object thereof is to provide a distortion sound correction complement device and a distortion sound correction complement method that are able to significantly reduce distortion of sound at an appropriate frequency even when the distortion can be easily generated at a particular frequency due to characteristics of a speaker or the like, as well as to improve the quality of the sound.

Solution to Problem

To solve the above problem, with a distortion sound correction complement device according to the present invention, the device that regards a frequency at which distortion occurs in a speaker that outputs an output signal as a specific frequency, and a maximum signal level at which the output signal output from the speaker is not distorted at the specific frequency as a specific signal level. The device includes: a first filter unit that performs, by using a peaking filter whose center frequency is the specific frequency, a filter process on an input signal in order to generate a correction band signal; a signal level detection unit that calculates an absolute value of amplitude of the correction band signal to perform maximum-value detection in order to detect a signal level of the correction band signal; a first lookup table unit that determines, based on the signal level detected by the signal level detection unit, a ratio of a signal level that has exceeded the specific signal level to the detected signal level as a value of a control signal; a second lookup table unit that determines, based on the signal level detected by the signal level detection unit, a correction amount that is used to amplify an overtone signal that is generated based on the specific frequency; a correction band extraction signal generation unit that multiplies the correction band signal by the control signal in order to generate a correction band extraction signal; a correction signal generation unit that subtracts the correction band extraction signal from the input signal in order to generate a correction signal; a level detection signal generation unit that calculates an absolute value of the correction band extraction signal and cuts DC components in order to generate a level detection signal; a first edge detection unit that detects a timing at which the correction band extraction signal turns positive after being negative in order to generate, as the overtone signal, an impulse train whose amplitude is 1; a first weighting unit that multiplies the overtone signal by the level detection signal in order to add weight to the overtone signal; a first phase inversion unit that inverts phase of the overtone signal to which the first weighting unit adds weight; a low-pass filter unit that performs, by using a low-pass filter, a filter process on the overtone signal whose phase is inverted by the first phase inversion unit, in order to suppress a high-frequency range signal level of the overtone signal; a high-pass filter unit that suppresses a low-frequency range signal level of the overtone signal on which the low-pass filter unit performs the filter process; a first amplification unit that multiplies the overtone signal on which the high-pass filter unit performs a filter process by gain that is calculated by adding the correction amount to an amplification initial value that is determined based on the input signal, in order to amplify the overtone signal; a second filter unit that performs, by using a filter having inverse characteristics of the peaking filter used by the first filter unit, a filter process on the overtone signal amplified by the first amplification unit in order to suppress a signal level of the specific frequency in the amplified overtone signal and thereby generate a complement signal; and an output signal generation unit that adds the complement signal to the correction signal in order to generate an output signal.

With a distortion sound correction complement method for a distortion sound correction complement device according to the present invention, the method that regards a frequency at which distortion occurs in a speaker that outputs an output signal as a specific frequency, and a maximum signal level at which the output signal output from the speaker is not distorted at the specific frequency as a specific signal level. The method includes: a correction band signal generation step by a first filter unit of performing, by using a peaking filter whose center frequency is the specific frequency, a filter process on an input signal in order to generate a correction band signal; a signal level detection step by a signal level detection unit of calculating an absolute value of amplitude of the correction band signal to perform maximum-value detection in order to detect a signal level of the correction band signal; a control signal determination step by a first lookup table unit of determining, based on the signal level detected at the signal level detection step, a ratio of a signal level that has exceeded the specific signal level to the detected signal level as a value of a control signal; a correction amount determination step by a second lookup table unit of determining, based on the signal level detected at the signal level detection step, a correction amount that is used to amplify an overtone signal that is generated based on the specific frequency; a correction band extraction signal generation step by a correction band extraction signal generation unit of multiplying the correction band signal by the control signal in order to generate a correction band extraction signal; a correction signal generation step by a correction signal generation unit of subtracting the correction band extraction signal from the input signal in order to generate a correction signal; a level detection signal generation step by a level detection signal generation unit of calculating an absolute value of the correction band extraction signal and cutting DC components in order to generate a level detection signal; an overtone signal generation step by a first edge detection unit of detecting a timing at which the correction band extraction signal turns positive after being negative in order to generate, as the overtone signal, an impulse train whose amplitude is 1; a first weighting step by a first weighting unit of multiplying the overtone signal by the level detection signal in order to add weight to the overtone signal; a first phase inversion step by a first phase inversion unit of inverting phase of the overtone signal which is added weight at the first weighting step; a low-pass filter processing step by a low-pass filter unit of performing, by using a low-pass filter, a filter process on the overtone signal whose phase is inverted at the first phase inversion step, in order to suppress a high-frequency range signal level of the overtone signal; a high-pass filter processing step by a high-pass filter unit of suppressing a low-frequency range signal level of the overtone signal on which is performed the filter process at the low-pass filter processing step; a first amplification step by a first amplification unit of multiplying the overtone signal on which is performed a filter process at the high-pass filter processing step by gain that is calculated by adding the correction amount to an amplification initial value that is determined based on the input signal, in order to amplify the overtone signal; a complement signal generation step by a second filter unit of performing, by using a filter having inverse characteristics of the peaking filter used at the correction band signal generation step, a filter process on the overtone signal amplified at the first amplification step in order to suppress a signal level of the specific frequency in the amplified overtone signal and thereby generate a complement signal; and an output signal generation step by an output signal generation unit of adding the complement signal to the correction signal in order to generate an output signal.

With the distortion sound correction complement device and distortion sound correction complement method according to the present invention, components of the frequency (specific frequency) at which distortion occurs in the speaker are extracted from the input signal, and the correction band signal is therefore generated. The ratio of the signal level that has exceeded the specific signal level to the correction band signal is determined as a value of the control signal, and the correction amount that is used to amplify the overtone signal is determined. Accordingly, the correction band extraction signal that is obtained by multiplying the correction band signal by the control signal represents the signal level that is of the specific frequency in the input signal and which exceeds the specific signal level. Therefore, the correction signal that is generated by subtracting the correction band extraction signal from the input signal is a signal whose signal level has been reduced from the signal level of the specific frequency to a level where no distortion occurs.

Meanwhile, the overtone signal is generated based on the correction band extraction signal. The generated overtone signal is a signal made up of impulse trains whose frequency is twice or three or more times as high as the specific frequency. Furthermore, the generated overtone signal is amplified as the overtone signal is multiplied by gain that is calculated by adding the correction amount to the amplification initial value. In this case, the correction amount is determined based on the signal level of the correction band signal, which is a signal produced by extracting specific-frequency components from the input signal. Therefore, it is possible to complement the suppressed signal level at the specific frequency with the overtone signal in accordance with the correction amount.

The overtone signal (complement signal) whose signal level is suppressed at the specific frequency by the second filter unit, and the correction signal whose signal level is reduced at the specific frequency in such a way as to prevent distortion are added in the output signal generation unit. As a result, an output signal can be generated in such a way as to suppress distorted sound and to complement the quality of sound in terms of audibility at the specific frequency with the overtone signal.

Furthermore, as for the amplified overtone signal, since the filter process is performed by the low-pass filter, the signal level of the high-frequency range overtone signal is suppressed. Therefore, the signal outputting of the high-frequency range overtone signal does not lead to the occurrence of distorted sound or abnormal noise.

In the distortion sound correction complement device described above, a cut-off frequency of the low-pass filter used by the low-pass filter unit may be set to a higher frequency than the center frequency of the peaking filter used by the first filter unit.

In the distortion sound correction complement method for the distortion sound correction complement device described above, a cut-off frequency of the low-pass filter used at the low-pass filter processing step may be set to a higher frequency than the center frequency of the peaking filter used at the correction band signal generation step.

In this manner, with the distortion sound correction complement device and distortion sound correction complement method according to the present invention, the cut-off frequency of the low-pass filter used by the low-pass filter unit is set to a higher frequency than the center frequency of the peaking filter used by the first filter unit. As a result, while suppressing the suppression of the outputting of the overtone signal whose frequency is twice as high as the specific frequency and of the outputting of the overtone signal whose frequency is three times as high as the specific frequency, it is possible to suppress, in stages, the outputting of the overtone signal whose frequency is a larger multiple thereof. Accordingly, it is possible to enable a listener to sufficiently recognize the quality of sound in terms of audibility at the specific frequency which is complemented with the overtone signal. Moreover, it is possible to effectively prevent distorted sound or abnormal noise that could occur due to the signal outputting of high-frequency range overtone signal.

In the distortion sound correction complement device described above, the amplification initial value may be determined by: amplification initial value [dB]=20 $\log_{10}$ (Specific frequency [Hz]/Sampling frequency [Hz]) in accordance with a sampling frequency of the input signal and the specific frequency.

In the distortion sound correction complement method for the distortion sound correction complement device described above, the amplification initial value may be determined by: amplification initial value [dB]=20 $\log_{10}$ (Specific frequency [Hz]/Sampling frequency [Hz]) in accordance with a sampling frequency of the input signal and the specific frequency.

With the distortion sound correction complement device and distortion sound correction complement method according to the present invention, with the use of the above-described relational formula, the amplification initial value is determined in accordance with the sampling frequency of the input signal and the specific frequency. In this manner, the amplification initial value is determined. Therefore, it is possible to calculate the optimal amplification initial value of the overtone signal for the specific frequency. Furthermore, the overtone signal is amplified by the amplification unit after the correction amount is added to the amplification initial value. Therefore, appropriate amplification is applied to the overtone signal in accordance with fluctuations in the signal level of the specific frequency in the input signal. As a result, it is possible to improve the quality of sound in the output signal.

In the distortion sound correction complement device described above, the value of the control signal that is determined by the first lookup table unit is a gain coefficient indicating the ratio of a signal level that has exceeded the specific signal level to the detected signal level. If the value is less than or equal to the specific signal level, the gain coefficient may be set to 0; and if the value is greater than the specific signal level, the gain coefficient may be set to a value that is greater than 0 but less than 1 depending on how much the detected signal level increases In the distortion sound correction complement method for the distortion sound correction complement device described above, the value of the control signal that is determined at the control signal determination step is a gain coefficient indicating the ratio of a signal level that has exceeded the specific signal level to the detected signal level. If the value is less than or equal to the specific signal level, the gain coefficient may be set to 0; and if the value is greater than the specific signal level, the gain coefficient may be set to a value that is greater than 0 but less than 1 depending on how much the detected signal level increases.

With the distortion sound correction complement device and distortion sound correction complement method according to the present invention, if the signal level of the correction band signal is less than or equal to the specific signal level, the value of the gain coefficient is set to 0. If the signal level is greater than the specific signal level, the value of the gain coefficient is set to a value that is greater than 0 but less than 1. Accordingly, if the signal level of the correction band signal is less than or equal to the specific signal level and distortion therefore does not occur, the value of the gain coefficient is 0, and the signal level of the correction band extraction signal is 0. Therefore, even if the input signal is used as the correction signal without being changed (correction signal=input signal), distortion does not occur in the output signal.

Even if the signal level of the correction band signal is greater than the specific signal level, and if distortion could occur from the output signal, the correction band extraction signal represents a signal level that has exceeded the specific signal level because the gain coefficient is greater than 0. Accordingly, the correction signal that is produced by subtracting the correction band extraction signal from the input signal is a signal whose signal level has been suppressed in such a way as not to exceed the specific signal level. Furthermore, the overtone signal is amplified based on the signal level that has exceeded the specific signal level (or based on the signal level of the correction band extraction signal).

Therefore, the overtone signal can be amplified by using the correction amount corresponding to the suppressed signal level. As a result, it is possible to sufficiently compensate (complement) the suppressed signal level with the overtone signal in terms of audibility.

In the distortion sound correction complement device described above, if the signal level of the correction band signal is less than or equal to the specific signal level, the correction amount that may be determined by the second lookup table unit is 0; and if the signal level of the correction band signal is greater than the specific signal level, the correction amount may be determined based on a value of a difference between the signal level of the correction band signal and the specific signal level.

In the distortion sound correction complement method for the distortion sound correction complement device described above, if the signal level of the correction band signal is less than or equal to the specific signal level, the correction amount that may be determined at the correction amount determination step is 0; and if the signal level of the correction band signal is greater than the specific signal level, the correction amount may be determined based on a value of a difference between the signal level of the correction band signal and the specific signal level.

With the distortion sound correction complement device and distortion sound correction complement method according to the present invention, if the signal level of the correction band signal is less than or equal to the specific signal level, the value of the correction amount is 0. When the signal level of the correction band signal is less than or equal to the specific signal level, distortion does not occur in the output signal. Therefore, there is no need to amplify the overtone signal. Accordingly, it is possible to suppress the unnecessary amplification process by setting the correction amount to 0.

If the signal level of the correction band signal is greater than the specific signal level, the value of the correction amount is determined based on the value of the difference between the signal level of the correction band signal and the specific signal level. When the signal level of the correction band signal is greater than the specific signal level, distortion could occur in the output signal. The value of the difference between the signal level of the correction band signal and the specific signal level is used as the correction amount in order to amplify the overtone signal. As a result, it is possible to sufficiently compensate (complement) the quality of sound of the correction signal whose signal level has been suppressed at the specific frequency by amplifying the overtone signal.

The above-described distortion sound correction complement device may include: a second edge detection unit that generates, as a ½ overtone signal, a signal with an amplitude of 1 that is generated by removing every other pulse from an impulse train that is generated by detecting a timing at which the correction band extraction signal turns positive after being negative; a second weighting unit that multiplies the ½ overtone signal by the level detection signal in order to add weight to the ½ overtone signal; a second phase inversion unit that inverts phase of the ½ overtone signal to which the second weighting unit adds weight; a peaking filter unit that performs, by using a peaking filter whose center frequency is half the specific frequency, a filter process on the ½ overtone signal whose phase is inverted by the second phase inversion unit; a second amplification unit that multiplies the ½ overtone signal on which the peaking filter unit performs the filter process by gain that is calculated by adding the correction amount to a ½-overtone amplification initial value that is calculated by 20 $\log_{10}$ (Specific frequency [Hz]/2×Sampling frequency of input signal [Hz]), in order to amplify the ½ overtone signal; and an addition unit that adds the overtone signal amplified by the first amplification unit and the ½ overtone signal amplified by the second amplification unit in order to generate a new overtone signal, wherein the second filter unit performs, by using a filter having inverse characteristics of the peaking filter used by the first filter unit, a filter process on the new overtone signal generated by the addition unit in order to suppress a signal level of the specific frequency in the new overtone signal and thereby generate a complement signal, and the output signal generation unit adds the complement signal to the correction signal in order to generate an output signal.

The above-described distortion sound correction complement method for the distortion sound correction complement device may include: a ½ overtone signal generation step by a second edge detection unit of generating, as a ½ overtone signal, a signal with an amplitude of 1 that is generated by removing every other pulse from an impulse train that is generated by detecting a timing at which the correction band extraction signal turns positive after being negative; a second weighting step by a second weighting unit of multiplying the ½ overtone signal by the level detection signal in order to add weight to the ½ overtone signal; a second phase inversion step by a second phase inversion unit of inverting phase of the ½ overtone signal which is added weight at the second weighting step; a peaking filter processing step by a peaking filter unit of performing, by using a peaking filter whose center frequency is half the specific frequency, a filter process on the ½ overtone signal whose phase is inverted at the second phase inversion step; a second amplification step by a second amplification unit of multiplying the ½ overtone signal on which is performed the filter process at the peaking filter processing step by gain that is calculated by adding the correction amount to a ½-overtone amplification initial value that is calculated by 20 $\log_{10}$ (Specific frequency [Hz]/2×Sampling frequency of input signal [Hz]), in order to amplify the ½ overtone signal; and an addition step by an addition unit of adding the overtone signal amplified at the first amplification step and the ½ overtone signal amplified at the second amplification step in order to generate a new overtone signal, wherein at the complement signal generation step, the second filter unit performs, by using a filter having inverse characteristics of the peaking filter used at the correction band signal generation step, a filter process on the new overtone signal generated by the addition unit in order to suppress a signal level of the specific frequency in the new overtone signal and thereby generate a complement signal, and at the output signal generation step, the output signal generation unit adds the complement signal to the correction signal in order to generate an output signal.

As described above, with the distortion sound correction complement device and distortion sound correction complement method according to the present invention, the overtone signal and the ½ overtone signal are added to generate the complement signal, and the complement signal is added to the correction signal to generate the output signal. Therefore, the synergistic effects of the overtone signal and ½ overtone signal help to improve the quality of sound of the output signal output from the speaker.

Advantageous Effects of Invention

With the distortion sound correction complement device and distortion sound correction complement method according to the present invention, components of the frequency (specific frequency) at which distortion occurs in the speaker are extracted from the input signal, and the correction band signal is therefore generated. The ratio of the signal level that has exceeded the specific signal level to the correction band signal is determined as a value of the control signal, and the correction amount that is used to amplify the overtone signal is determined. Accordingly, the correction band extraction signal that is obtained by multiplying the correction band signal by the control signal represents the signal level that is of the specific frequency in the input signal and which exceeds the specific signal level. Therefore, the correction signal that is generated by subtracting the correction band extraction signal from the input signal is a signal whose signal level has been reduced from the signal level of the specific frequency to a level where no distortion occurs.

Meanwhile, the overtone signal is generated, based on the correction band extraction signal. The generated overtone signal is a signal made up of impulse trains whose frequency is twice or three or more times as high as the specific frequency. Furthermore, the generated overtone signal is amplified as the overtone signal is multiplied by gain that is calculated by adding the correction amount to the amplification initial value. In this case, the correction amount is determined based on the signal level of the correction band signal, which is a signal produced by extracting specific-frequency components from the input signal. Therefore, it is possible to complement the suppressed signal level at the specific frequency with the overtone signal in accordance with the correction amount.

The overtone signal (complement signal) whose signal level is suppressed at the specific frequency by the second filter unit, and the correction signal whose signal level is reduced at the specific frequency in such a way as to prevent distortion are added in the output signal generation unit. As a result, an output signal can be generated in such a way as to suppress distorted sound and to complement the quality of sound in terms of audibility at the specific frequency with the overtone signal.

Furthermore, as for the amplified overtone signal, since the filter process is performed by the low-pass filter, the signal level of the high-frequency range overtone signal is suppressed. Therefore, the signal outputting of the high-frequency range overtone signal does not lead to the occurrence of distorted sound or abnormal noise.

BRIEF DESCRIPTION OF DRAWINGS

FIG. 7(*a*) is Table 1 showing parameters of each function unit of the distortion correction unit according to the first embodiment; FIG. 7(*b*) is Table 2 showing parameters of each function unit of the low-frequency range complement unit according to the first embodiment.

FIG. 8(*b*) is a graph illustrating filter characteristics of a peaking filter of a first filter unit of the distortion correction unit according to the first embodiment.

FIG. 9(*b*) is a graph illustrating how the amplitude of an output signal output from the first filter unit changes in the input signal shown in FIG. 9(*a*); FIG. 9(*c*) is a graph illustrating how the amplitude of an input signal changes when a music signal is used as the input signal after a parameter of Table 1 is set; and FIG. 9(*d*) is a graph illustrating how the amplitude of an output signal output from the first filter unit changes in the input signal shown in FIG. 9(*c*).

FIGS. 10(*c*) and 10(*d*) are graphs illustrating, in a linear manner and a decibel manner, a maximum value detection signal and a maximum value hold signal that are output from the maximum value detection unit and the maximum value hold unit when a music signal is used as an input signal.

FIG. 11(*b*) is a graph illustrating a conversion table of a second lookup table unit.

FIGS. 13(*a*) and 13(*b*) are graphs illustrating a linear display output and a decibel display output when an input signal is a sine wave; FIGS. 13(*c*) and 13(*d*) are graphs illustrating a linear display output and a decibel display output when the input signal is a music signal.

FIGS. 14(*a*) and 14(*b*) are graphs illustrating a linear display output and a decibel display output when the input signal is a sine wave, and FIGS. 14(*c*) and 14(*d*) are graphs illustrating a linear display output and a decibel display output when the input signal is a music signal.

FIGS. 15(*a*) and 15(*b*) are graphs illustrating a case where the input signal is a sine wave, and FIGS. 15(*c*) and 15(*d*) are graphs illustrating a case where the input signal is a music signal.

FIG. 16(*b*) is a graph illustrating how the amplitude of a correction band extraction signal changes when the input signal is a music signal.

FIG. 17(*b*) is a graph illustrating characteristics of a third LPF unit and a second HPF unit.

FIG. 18(*b*) is a graph illustrating expanded time intervals of the low-frequency range correction band extraction signal shown in FIG. 18(*a*).

FIG. 19(*b*) is a graph illustrating expanded time intervals of the low-frequency range correction band extraction signal shown in FIG. 19(*a*).

FIG. 20(*a*) is a graph illustrating a case where the input signal is a sine wave, and FIG. 20(*b*) is a graph illustrating a case where the input signal is a music signal.

FIG. 21(*a*) is a graph illustrating a case where the input signal is a sine wave, and FIG. 21(*b*) is a graph illustrating a case where the input signal is a music signal.

FIG. 22(*a*) is a graph illustrating a case where the input signal is a sine wave, and FIG. 22(*b*) is a graph illustrating a case where the input signal is a music signal.

FIGS. 23(*a*) and 23(*b*) are graphs illustrating a case where the input signal is a sine wave, and FIGS. 23(*c*) and 23(*d*) are graphs illustrating a case where the input signal is a music signal.

FIG. 24(*b*) is a graph illustrating filter characteristics of a peaking filter unit according to a second embodiment.

FIG. 25(*a*) is a graph illustrating a case where the input signal is a sine wave, and FIG. 25(*b*) is a graph illustrating a case where the input signal is a music signal.

FIG. 26(*b*) is a graph illustrating a complement signal after the signal passes through the second filter unit according to the second embodiment.

FIG. 28(*b*) is a graph illustrating the level detection signal that is output from the level detection signal generation unit, and a ½ overtone signal.

FIG. 29(*a*) is Table 3 showing parameters of each function unit of the distortion correction unit according to the second embodiment; FIG. 29(*b*) is Table 4 showing parameters of each function unit of a low-frequency range complement unit according to the second embodiment.

FIG. 30(*b*) is a graph illustrating a correction signal; FIG. 30(*c*) is a graph illustrating a correction band extraction signal in the device.

FIG. 31(*b*) is a graph illustrating filter characteristics of the second filter unit according to the second embodiment.

DESCRIPTION OF EMBODIMENTS

Hereinafter, a distortion sound correction low-frequency range complement device, which is one example of a distortion sound correction complement device of the present invention, will be described in detail with reference to the accompanying drawings.

First Embodiment

Figure 1:
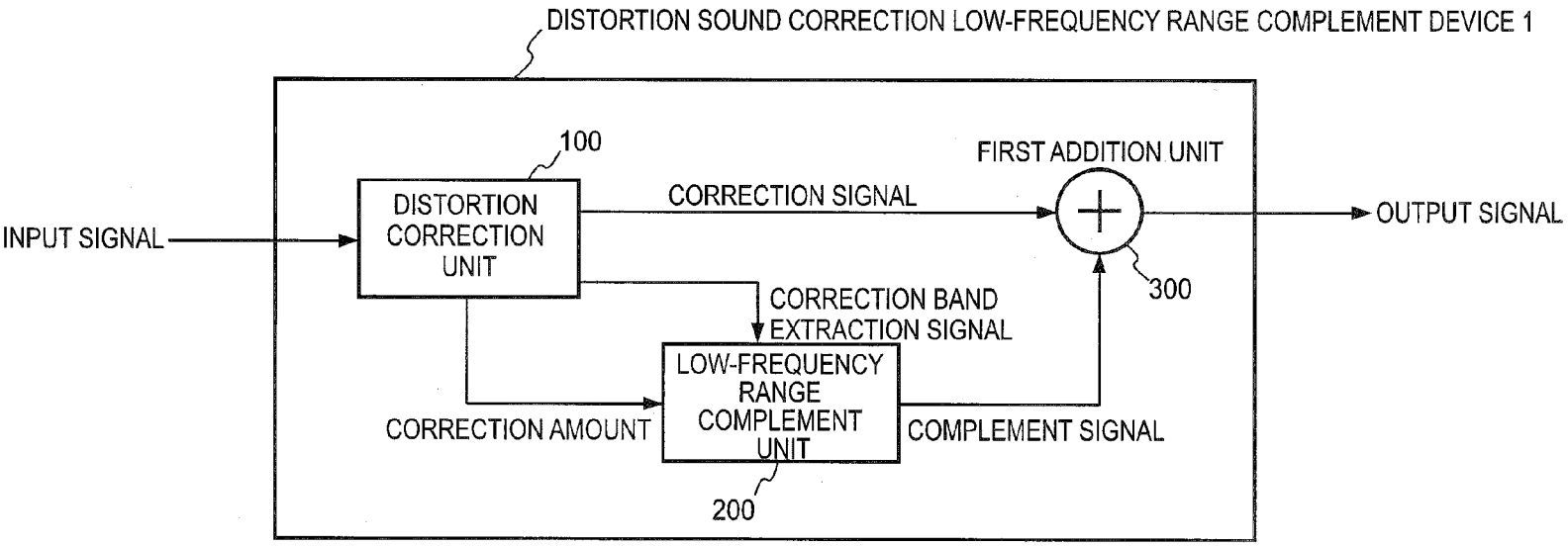
FIG. 1 is a block diagram illustrating the schematic configuration of a distortion sound correction low-frequency range complement device according to a first embodiment.

FIG. 1 is a block diagram illustrating the schematic configuration of the distortion sound correction low-frequency range complement device. As shown in FIG. 1, the distortion sound correction low-frequency range complement device 1 includes a distortion correction unit 100, a low-frequency range complement unit 200, and a first addition unit (output signal generation unit) 300.

In the distortion sound correction low-frequency range complement device 1, the distortion correction unit 100 limits an output level of a signal in a frequency band where distorted sound is generated (Hereinafter, a frequency at which distorted sound is generated will be referred to as a specific frequency). Furthermore, in the distortion sound correction low-frequency range complement device 1, the low-frequency range complement unit 200 generates an overtone signal in order to complement the limited output level. Then, the first addition unit 300 combines the overtone signal with the signal with the limited output level, thereby generating an output signal that allows a listener to sufficiently recognize (or sense), in terms of audibility, the sound in the band where the output level has been limited, while suppressing the distortion.

Figure 2:
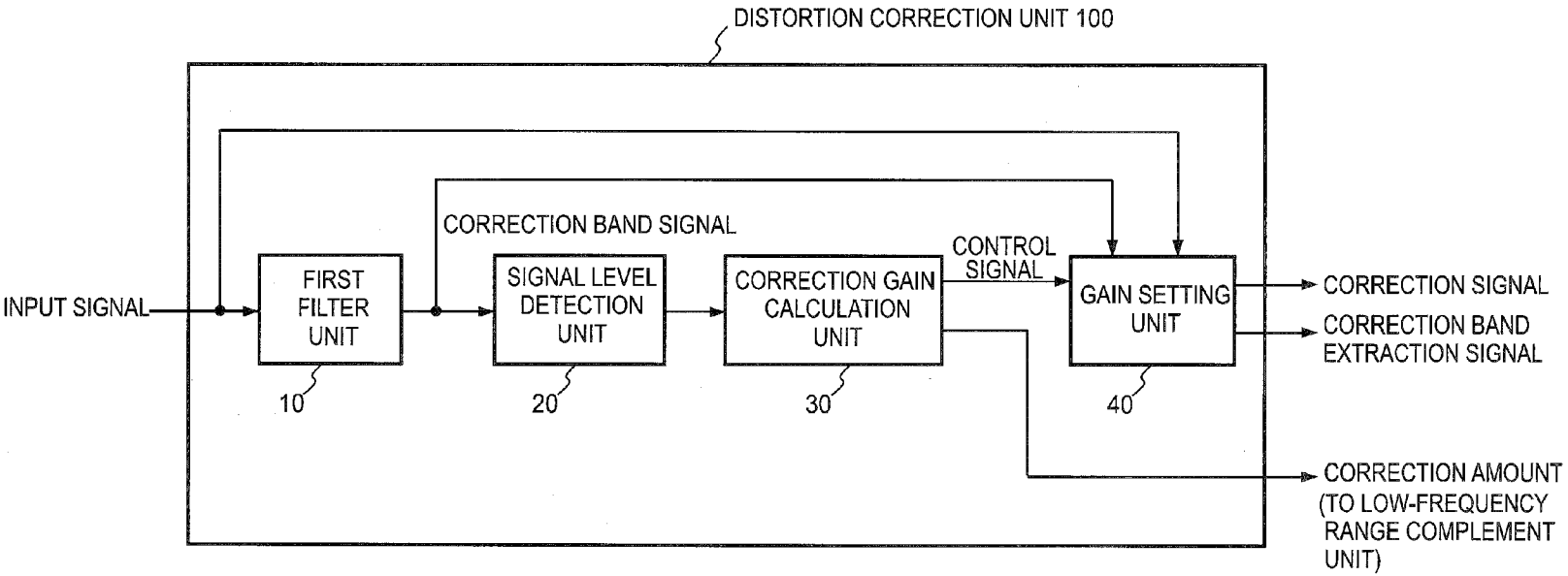
FIG. 2 is a block diagram illustrating the schematic configuration of a distortion correction unit according to the first embodiment.

FIG. 2 is a block diagram illustrating the schematic configuration of the distortion correction unit 100. The distortion correction unit 100 includes a first filter unit 10, a signal level detection unit 20, a correction gain calculation unit 30, and a gain setting unit 40.

The first filter unit 10 is a filter that allows only a specific-frequency signal of an input signal to pass therethrough after the input signal is input from a sound source (not shown). The first filter unit 10 of the first embodiment employs a second-order peaking filter, as described later, in order to extract a specific-frequency signal. The specific frequency is determined based on results of measuring distortion of a speaker in advance inside a vehicle interior. The distortion sound correction low-frequency range complement device 1 regards the specific frequency as a correction band, in the distortion sound correction low-frequency range complement device 1, and carries out a distortion correction process and a complement process of a corresponding band. A signal that has passed through the first filter unit 10 is output, as a correction band signal, to the signal level detection unit 20 and the gain setting unit 40.

Figure 3:
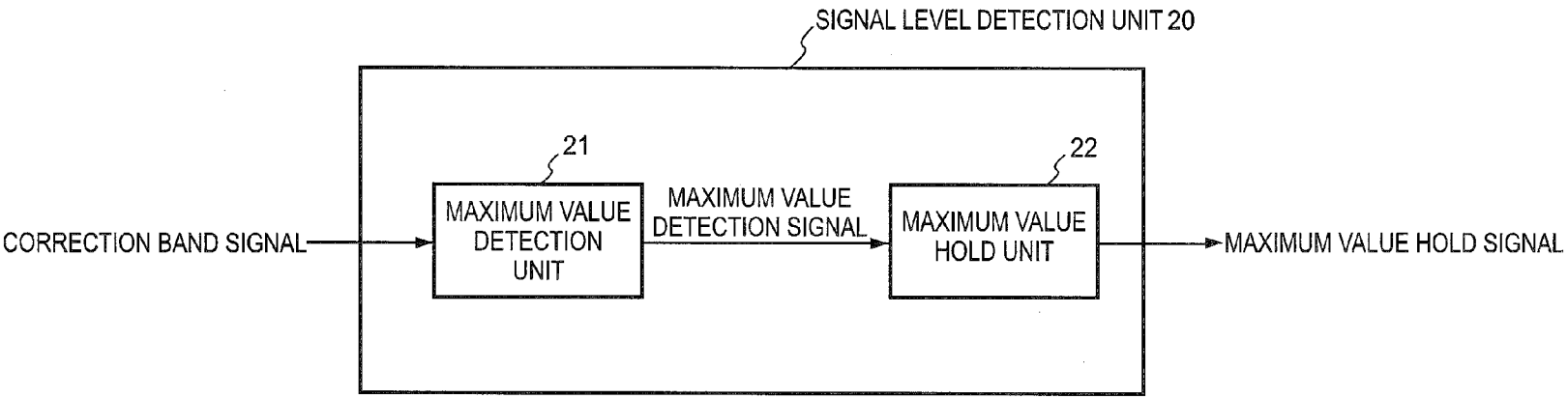
FIG. 3 is a block diagram illustrating the schematic configuration of a signal level detection unit according to the first embodiment.

FIG. 3 is a block diagram illustrating the schematic configuration of the signal level detection unit 20. The signal level detection unit 20 includes a maximum value detection unit 21 and a maximum value hold unit 22. The maximum value detection unit 21 detects an absolute value of the amplitude of a signal (correction band signal) that has passed through the first filter unit 10, and detects a maximum value within a predetermined period of time. A signal that the maximum value detection unit 21 has detected as a maximum value is output to the maximum value hold unit 22 as a maximum value detection signal.

The maximum value hold unit 22 holds (or keeps) the maximum value detected by the maximum value detection unit 21 (or the detection value of the maximum value detection signal) during only a predetermined period of time. The signal held by the maximum value hold unit 22 is output, as a maximum value hold signal, to the correction gain calculation unit 30.

Figure 4:
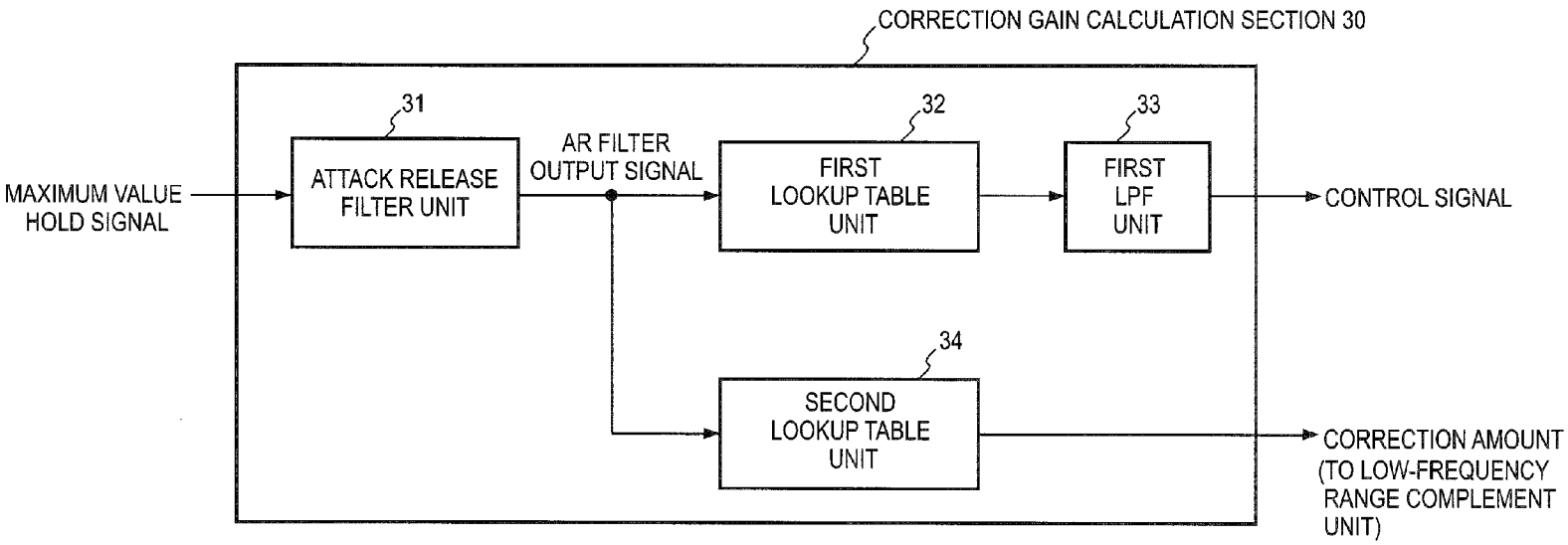
FIG. 4 is a block diagram illustrating the schematic configuration of a correction gain calculation unit according to the first embodiment.

FIG. 4 is a block diagram illustrating the schematic configuration of the correction gain calculation unit 30. The correction gain calculation unit 30 includes an attack release filter unit 31, a first lookup table unit 32, a first LPF (Low-pass filter) unit 33, and a second lookup table unit 34.

The attack release filter unit 31 carries out a filter process on a maximum value hold signal that is input from the maximum value hold unit 22 in such a way as to achieve a response speed corresponding to an attack time and a release time. The attack time and the release time are set in advance. Specific examples of setting values will be described later. After going through the filter process by the attack release filter unit 31 with the attack time and the release time, the signal filtered (AR filter output signal) is output to the first lookup table unit 32 and the second lookup table unit 34.

The first lookup table unit 32 and the second lookup table unit 34 convert the level of the signal input from the attack release filter unit 31. Specific settings of the first lookup table unit 32 and second lookup table unit 34 (i.e., contents of the conversion tables) are determined based on the signal level in the correction band (or more specifically, the signal level of the AR filter output signal).

The first lookup table unit 32 calculates a gain coefficient based on the signal level (value [dB]) of the signal input, and outputs the gain coefficient to the first LPF unit 33. The gain coefficient that is calculated based on the first lookup table unit 32 represents the ratio of a signal level that has exceeded a specific signal level to the signal level of the signal input (AR filter output signal). The specific signal level is a maximum signal level that does not distort, at a specific frequency, an output signal output from a speaker. The specific signal level may be calculated by measuring the distortion of a signal output from the speaker; the details thereof will be described later.

The gain coefficient represents the ratio of a signal level that has exceeded a specific signal level to the signal level of the signal input (AR filter output signal). Accordingly, if the signal level of the signal input is less than or equal to the specific signal level, the value of the gain coefficient is set to 0. If the signal level of the signal input is greater than the specific signal level, the value of the gain coefficient is determined based on how much the signal level has increased and is therefore set to a value that is greater than 0 and less than 1. In this case, the signal level of the signal input (AR filter output signal) is substantially equivalent to the signal level of the correction band signal.

If the signal level of the correction band signal is less than or equal to the specific signal level, distortion does not occur in the output signal even when the gain setting unit 40, described later, does not subtract, from the input signal, the signal level of the specific frequency at which the distortion could occur. Accordingly, if the signal level of the correction band signal is less than or equal to the specific signal level and the distortion therefore does not occur, by setting the value of the gain coefficient to 0, the signal level of a correction band extraction signal (See FIG. 5 described later) that the gain setting unit 40 uses in subtracting from the input signal can be set to 0. As a result, it is possible to avoid reducing (subtracting) the signal level of the specific frequency in the input signal unnecessarily.

If the signal level of the correction band signal is greater than the specific signal level, distortion could occur in the output signal. Accordingly, if the signal level of the correction band signal is greater than the specific signal level, by setting the gain coefficient to a value greater than 0, during the process of the gain setting unit 40 described later, a signal level that exceeds the specific signal level can be calculated from the correction band extraction signal. Therefore, the gain setting unit 40 subtracts the correction band extraction signal from the input signal, thereby reducing the signal level where distortion could occur at the specific frequency of the input signal (or correcting the distorted sound). Thus, it is possible to curb the occurrence of distortion in the output signal.

The second lookup table unit 34 calculates a correction amount that is used to amplify an overtone signal as described later, based on the signal level (value [dB]) of the signal input (AR filter output signal). In this case, while a correction signal is calculated by subtracting, from the input signal, the signal level of the specific frequency at which distortion could occur in the gain setting unit 40 described later, the overtone signal is a signal that is generated to complement the specific frequency that has undergone the subtraction. Accordingly, the amplification of the overtone signal is set based on the signal level that has undergone the subtraction; the correction amount adjusts the amount of amplification based on the signal level thereof. The correction amount is determined based on the settings of the first lookup table unit 32 (or contents of the conversion table). As the gain coefficient is increased gradually from 0 to 1, the value of the correction amount tends to increase.

More specifically, the correction amount that is determined in the second lookup table unit 34 comes to 0 if the signal level of the signal input (AR filter output signal) is less than or equal to the specific signal level. If the signal level of the signal input (AR filter output signal) is greater than the specific signal level, the correction amount is determined based on the value of a difference between the signal level of the signal input and the specific signal level. In this case, the signal level of the signal input (AR filter output signal) is substantially equivalent to the signal level of the correction band signal.

If the signal level of the signal input is less than or equal to the specific signal level, the value of the correction amount is 0. In this case, if the signal level of the signal input is less than or equal to the specific signal level, or if the signal level of the correction band signal is less than or equal to the specific signal level, distortion does not occur in the output signal. Therefore, there is no need to subtract, from the input signal, the signal level of the specific frequency at which distortion could occur. In this case, there is no need to amplify the overtone signal. Therefore, by setting the correction amount to 0, it is possible to suppress an unnecessary amplification process.

If the signal level of the signal input is greater than the specific signal level, or if the signal level of the correction band signal is greater than the specific signal level, then the value of the correction amount is determined based on the amount of a signal level that has exceeded the specific signal level, or the value of a difference between the signal level of the correction band signal (=signal input) and the specific signal level. If the signal level of the correction band signal is greater than the specific signal level, distortion could occur in the output signal. The value of the difference between the signal level of the correction band signal and the specific signal level is used as a correction amount to amplify the overtone signal. Therefore, it is possible to sufficiently compensate (or complement) the sound quality of the correction signal whose signal level is suppressed at the specific frequency, by amplifying the overtone signal.

The gain coefficient that is calculated by the first lookup table unit 32 is smoothed by a low-pass filter of the first LPF unit 33, before being output to the gain setting unit 40 as a control signal. The correction amount that is calculated by the second lookup table unit 34 is output to the low-frequency range complement unit 200.

Figure 5:
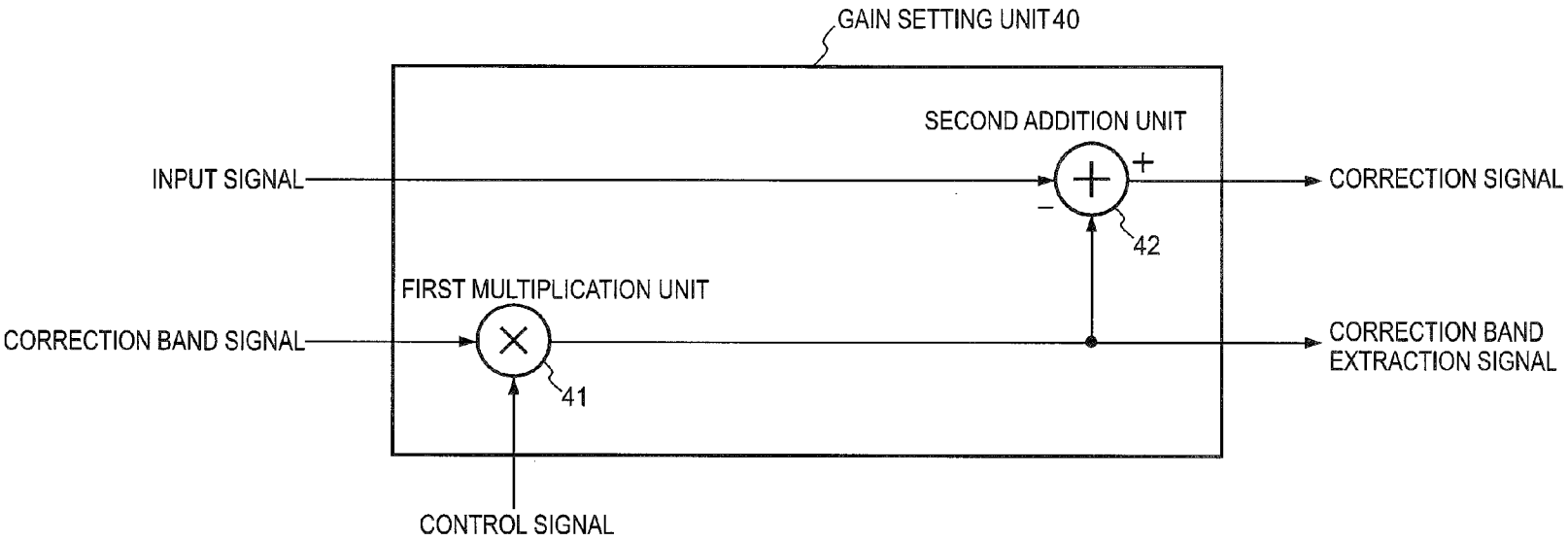
FIG. 5 is a block diagram illustrating the schematic configuration of a gain setting unit according to the first embodiment.

FIG. 5 is a block diagram illustrating the schematic configuration of the gain setting unit 40. The gain setting unit 40 includes a first multiplication unit (correction band extraction signal generation unit) 41 and a second addition unit (correction signal generation unit) 42. To the first multiplication unit 41, the correction band signal that is generated as the frequency at which distortion occurs is extracted from the input signal in the first filter unit 10, and the gain coefficient that is smoothed by the first LPF unit 33 are input as control signal. As described above, the gain coefficient is a value that is less than or equal to 1. Therefore, the control signal, too, is a value that is less than or equal to 1. Accordingly, the first multiplication unit 41 multiplies the correction band signal by the control signal, thereby generating a signal representing a signal level that is greater than the specific signal level in the correction band signal. This signal is referred to as a correction band extraction signal.

To the second addition unit 42, the correction band extraction signal that is generated by the first multiplication unit 41, and the input signal that is output from a sound source (not shown) are input. The second addition unit 42 generates a correction signal by subtracting the correction band extraction signal from the input signal. In this case, the correction band extraction signal is a signal that has a frequency (specific frequency) at which distortion has occurred and indicates a signal level that is greater than the specific signal level. Therefore, when the correction band extraction signal is subtracted from the input signal that is output from the sound source, what is generated is a signal whose signal level has been lowered from the signal level of the specific frequency in the input signal to a level where distortion does not occur. That is, the correction signal that is output from the second addition unit 42 is equivalent to the input signal by which distortion is not generated at the specific frequency. The correction signal that is output from the second addition unit 42 is output to the first addition unit 300.

Figure 6:
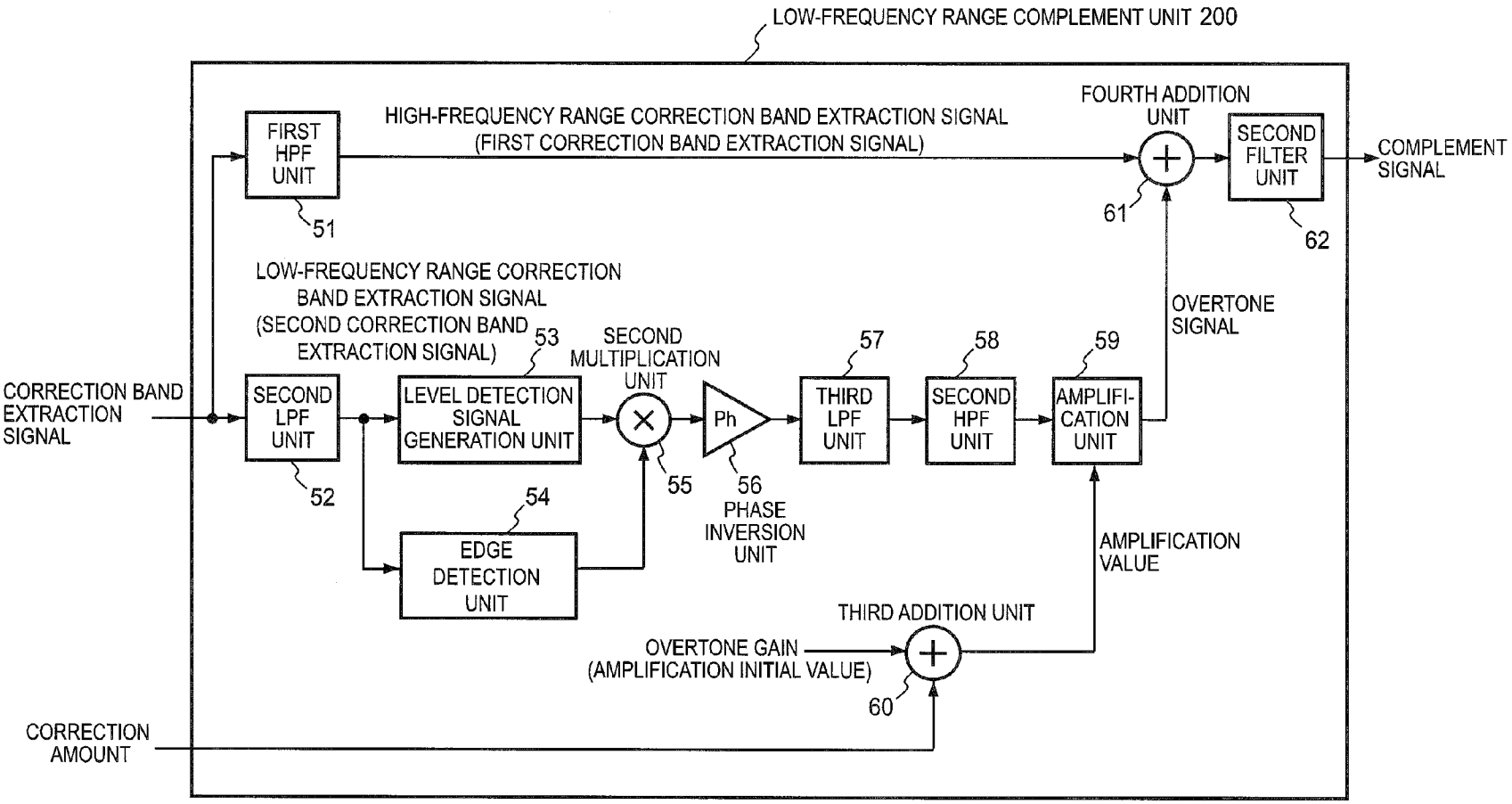
FIG. 6 is a block diagram illustrating the schematic configuration of a low-frequency range complement unit according to the first embodiment.

FIG. 6 is a block diagram illustrating the schematic configuration of the low-frequency range complement unit 200. As shown in FIG. 6, the low-frequency range complement unit 200 includes a first HPF (High-pass filter) unit 51, a second LPF unit 52, a level detection signal generation unit 53, an edge detection unit (first edge detection unit) 54, a second multiplication unit (first weighting unit) 55, a phase inversion unit (first phase inversion unit) 56, a third LPF unit (low-pass filter unit) 57, a second HPF unit (high-pass filter unit) 58, an amplification unit (first amplification unit) 59, a third addition unit 60, a fourth addition unit 61, and a second filter unit 62.

The correction band extraction signal that is output from the gain setting unit 40 is input to the first HPF unit 51 and the second LPF unit 52. In one example, the first HPF unit 51 and the second LPF unit 52 may be third-order Butterworth filters.

The first HPF unit 51 is a filter that allows high-frequency components of the signal input to pass therethrough. The high-frequency components of the correction band extraction signal are extracted by the first HPF unit 51, and are output to the fourth addition unit 61 as high-frequency range correction band extraction signal (first correction band extraction signal). The second LPF unit 52 is a filter that allows low-frequency components of the signal input to pass therethrough. The low-frequency components of the correction band extraction signal are extracted by the second LPF unit 52, and are output to the level detection signal generation unit 53 and the edge detection unit 54 as low-frequency range correction band extraction signal (second correction band extraction signal).

The level detection signal generation unit 53 calculates an absolute value of the low-frequency range correction band extraction signal input, cuts DC components, and then outputs the signal to the second multiplication unit 55 as a level detection signal. The edge detection unit 54 detects, in the low-frequency range correction band extraction signal input, a position (or timing) where the value of the signal turns positive from being negative, and sets an impulse output at the detected position (timing) in order to generate an impulse train. In this case, the amplitude of the impulse train is set to 1, and the generated impulse train is referred to as an overtone signal. The edge detection unit 54 of the first embodiment corresponds to a first edge detection unit in claims.

The second multiplication unit 55 multiplies the level detection signal that is input from the level detection signal generation unit 53 by the overtone signal that is input from the edge detection unit 54. The multiplication process by the second multiplication unit 55 can add weight to the overtone signal in accordance with the signal level of the low-frequency range correction band extraction signal.

The phase inversion unit 56 inverts the phase of the weighted overtone signal. The third LPF unit 57 is a filter that allows low-frequency components of the signal input to pass therethrough. The third LPF unit 57 carries out a filter process on the overtone signal whose phase has been inverted, thereby suppressing a signal level of a high-frequency range (high bandwidth) of the overtone signal. The second HPF unit 58 is a filter that allows high-frequency components of the signal input to pass therethrough. The second HPF unit 58 carries out a filter process on the overtone signal, thereby suppressing a signal level of a lower-frequency range (low bandwidth). The overtone signal whose band is limited in the high-frequency and low-frequency ranges by the third LPF unit 57 and the second HPF unit 58 is output to the amplification unit 59. The phase inversion unit 56 of the first embodiment corresponds to a first phase inversion unit in claims; the amplification unit 59 corresponds to a first amplification unit in claims.

In the case of the first embodiment, as one example of the third LPF unit 57, a fifth-order Butterworth low-pass filter is used; as one example of the second HPF unit 58, a third-order Butterworth high-pass filter is used.

The amplification unit 59 carries out an amplification process on the overtone signal whose band has been limited. The amplification unit 59 carries out the amplification process by multiplying the value of the amplitude of the overtone signal by the gain [dB] of the linear. The gain that is amplified by the amplification unit 59 is calculated by adding, in the third addition unit 60, the correction amount (gain [dB]) calculated by the second lookup table unit 34 to an amplification initial value that is set based on the band (frequency) of the input signal for which distortion is to be corrected.

As described above, the correction amount that is calculated by the second lookup table unit 34 is a value that is determined based on the value of the difference between the signal level of the correction band signal and the specific signal level. Accordingly, even if the signal level of the frequency band is reduced by the signal level of the correction band extraction signal from the input signal in the second addition unit 42, by adding the correction amount that is determined based on the reduced signal level to the amplification initial value in order to carry out the amplification process on the overtone signal, it is possible to prevent a listener from feeling that the sound of the frequency band that is suppressed in the output signal is thin in terms of audibility. As a result, the listener can sense sufficient acoustic effects. The method for calculating the amplification initial value, and the like will be described later in detail.

The overtone signal that has undergone the amplification process in the amplification unit 59 is output to the fourth addition unit 61. To the fourth addition unit 61, the high-frequency range correction band extraction signal (first correction band extraction signal) is input from the first HPF unit 51. The high-frequency range correction band extraction signal is a signal of high-frequency component of a signal (correction band extraction signal) whose signal level of frequency (specific frequency) at which distortion could occur in a speaker is reduced. The fourth addition unit 61 adds the high-frequency range correction band extraction signal and the overtone signal, thereby generating a signal which has, as high-frequency component, signal component that does not cause distortion of the speaker and which have an overtone that enables a listener to recognize the sound in terms of audibility with respect to a frequency that is different from the specific frequency.

The signal that is generated by adding the high-frequency range correction band extraction signal and the overtone signal is input to the second filter unit 62. The second filter unit 62 is a filter that has inverse characteristics of the first filter unit 10. The first filter unit 10 is a peaking filter that extracts a signal of the specific frequency. By using this filter, it is possible to extract a frequency (specific frequency) at which distortion occurs in a speaker from the input signal. The second filter unit 62 is a peaking filter that has inverse characteristics of the first filter unit 10. The second filter unit 62 carries out a filter process on the signal that is generated by adding the high-frequency range correction band extraction signal and the overtone signal. Therefore, it is possible to suppress only the signal level of the frequency (specific frequency) at which distortion occurs in a speaker, as well as to allow a signal of other frequency bands (bands other than the specific frequency) to pass therethrough.

The signal that has passed through the second filter unit 62 is output to the first addition unit 300 as a complement signal. The first addition unit 300 adds the correction signal that is input from the gain setting unit 40 of the distortion correction unit 100 and the complement signal that is input from the second filter unit 62 of the low-frequency range complement unit 200, and outputs an output signal.

In this case, the correction signal is a signal whose signal level is suppressed at the specific frequency so that distortion does not occur in a speaker in the input signal. Moreover, as described above, the complement signal is a signal whose signal level is suppressed at a frequency (specific frequency) at which distortion occurs in a speaker and which is generated as the sound quality of the specific frequency is complemented by overtones of other frequency bands (bands other than the specific frequency). Therefore, by adding the correction signal and the complement signal, the first addition unit 300 can generate an output signal whose signal level is reduced from a signal level of frequency component (specific frequency component) at which distortion occurs in the input signal to a level where no distortion occurs and which enables a listener to recognize the sound of that frequency component (specific frequency component) in terms of audibility with the help of the overtone signal.

[Detailed Description of Operation of Distortion Sound Correction Low-Frequency Range Complement Device]

The actual distortion correction process and low-frequency range complement process by the above distortion sound correction low-frequency range complement device 1 will be described.

FIG. 7(*a*) is Table 1 showing one example of parameters (setting values) that are set in each function unit of the distortion correction unit 100. Each of the setting values of the parameters shown in Table 1 is determined on the distorted sound that occurs in a speaker that is placed inside a vehicle interior.

Figure 8A:
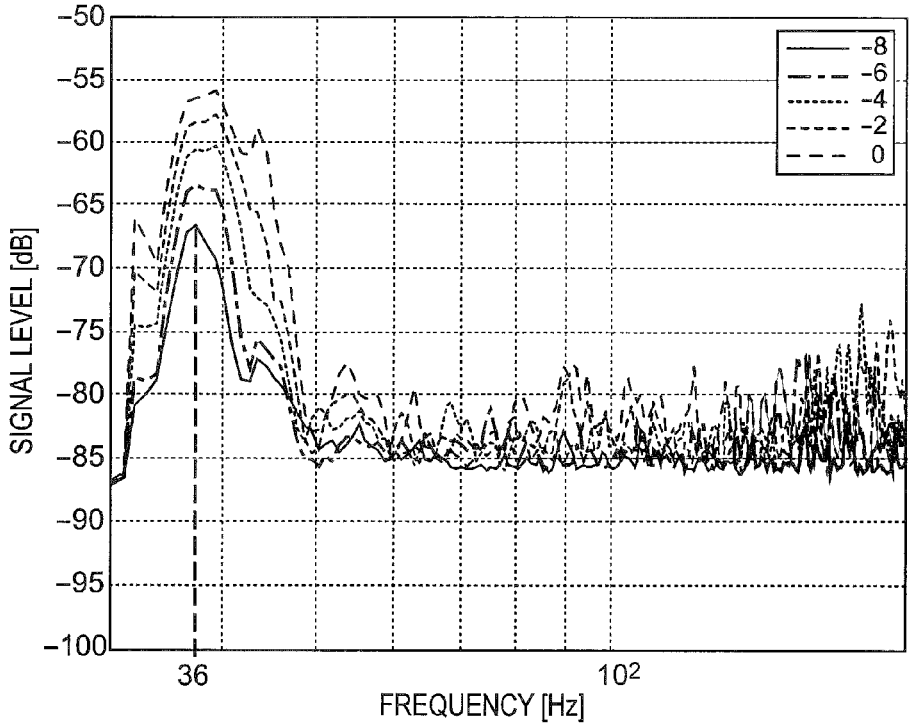
FIG. 8(*a*) is a graph illustrating a signal level of a distortion component that is generated when an input level of an output signal from a speaker is changed, according to the first embodiment.
Figure 8B:
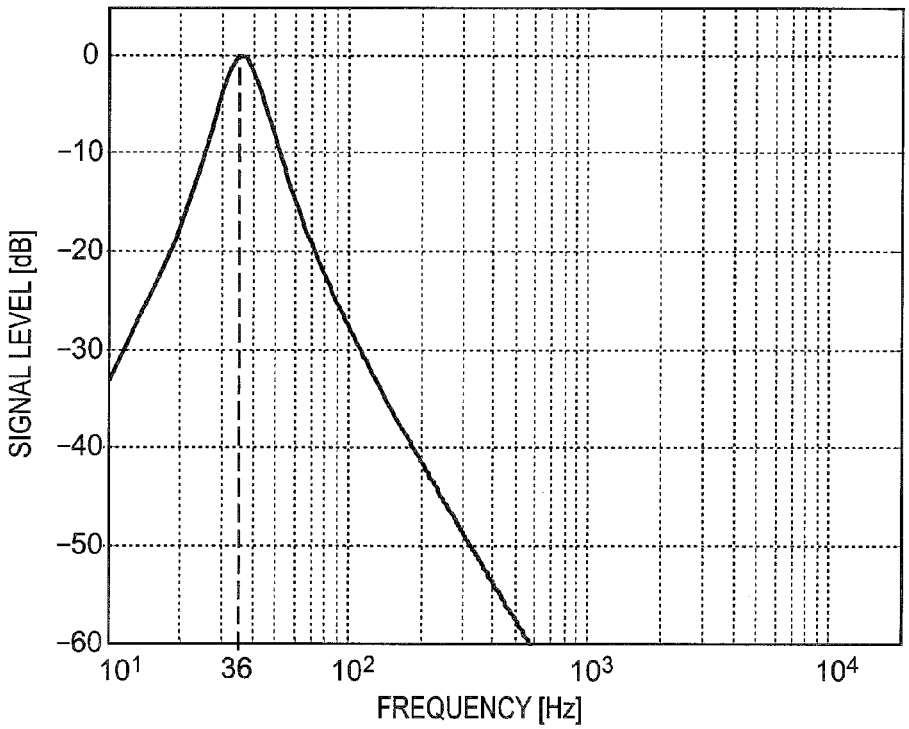
Figure 9A:
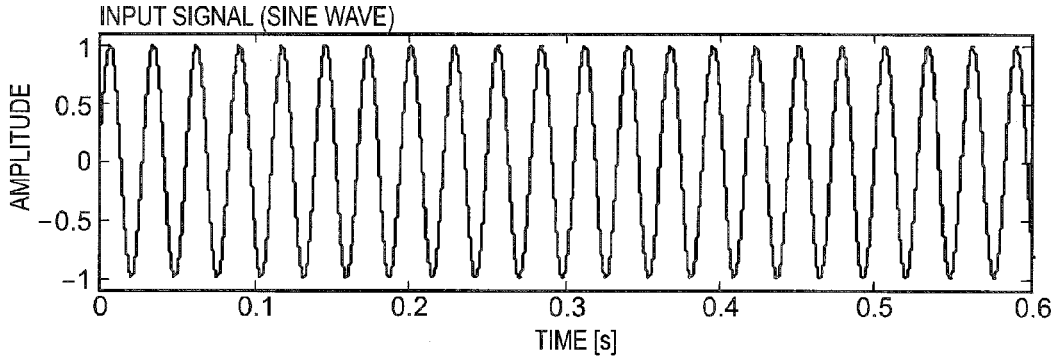
FIG. 9(*a*) is a graph illustrating how the amplitude of an input signal changes when a sine wave is used as the input signal after a parameter of Table 1 of FIG. 7 is set in the first filter unit.
Figure 9B:
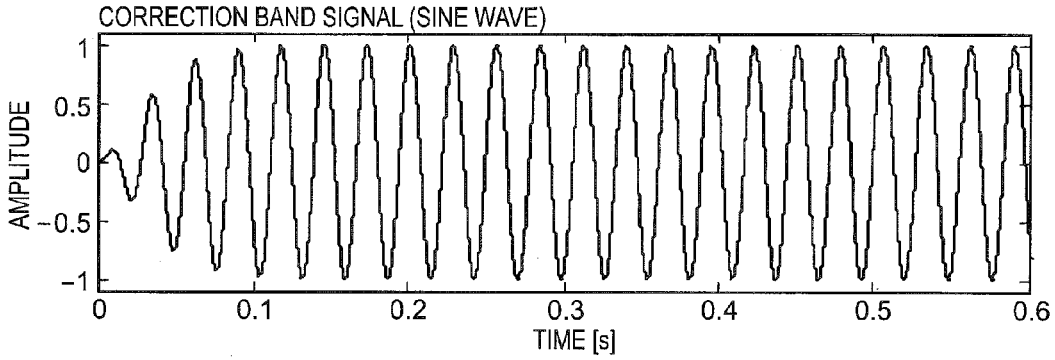
Figure 9C:
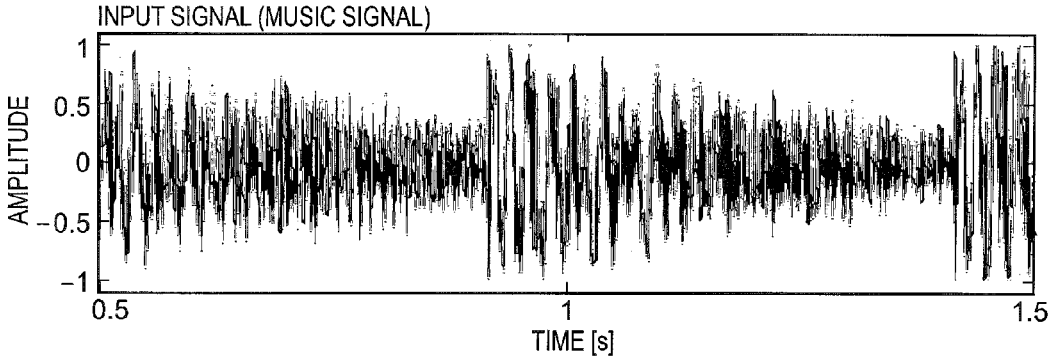
Figure 9D:
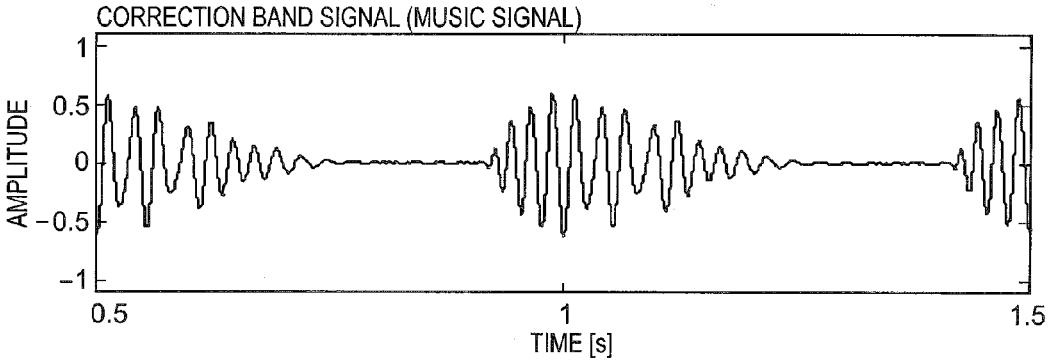
Figure 10A:
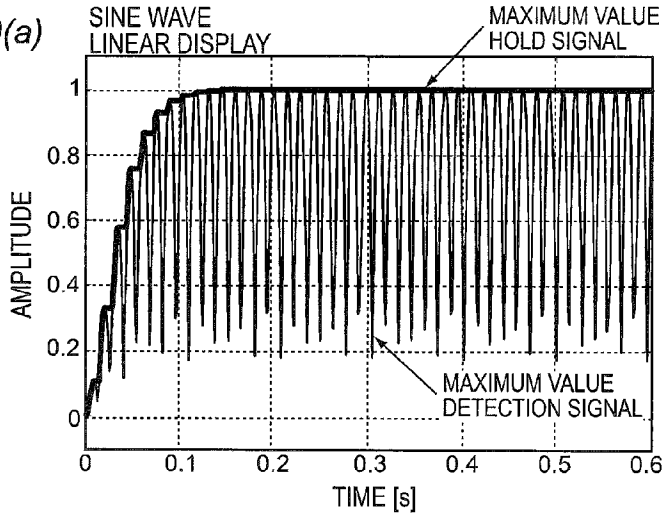
FIGS. 10(*a*) and 10(*b*) are graphs illustrating, in a linear manner and a decibel manner, a maximum value detection signal and a maximum value hold signal that are output from a maximum value detection unit and a maximum value hold unit when a sine wave is used as an input signal.
Figure 10B:
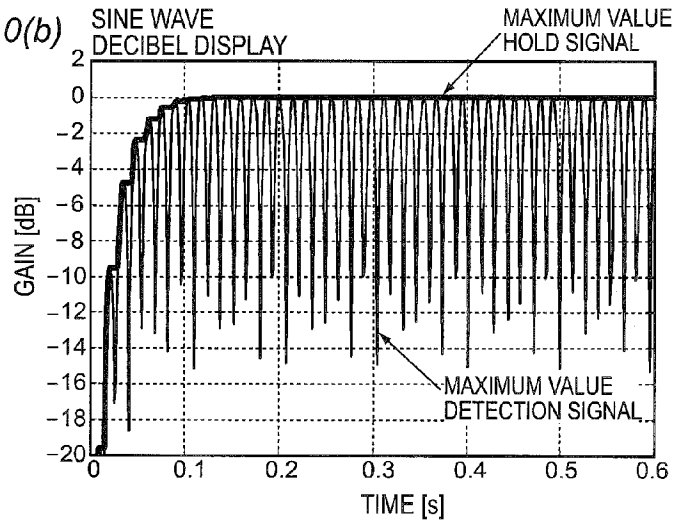
Figure 10C:
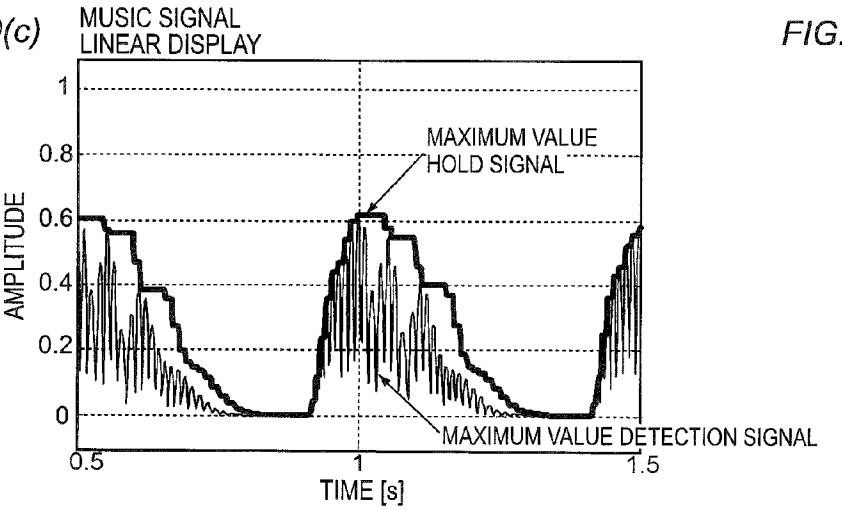
Figure 10D:
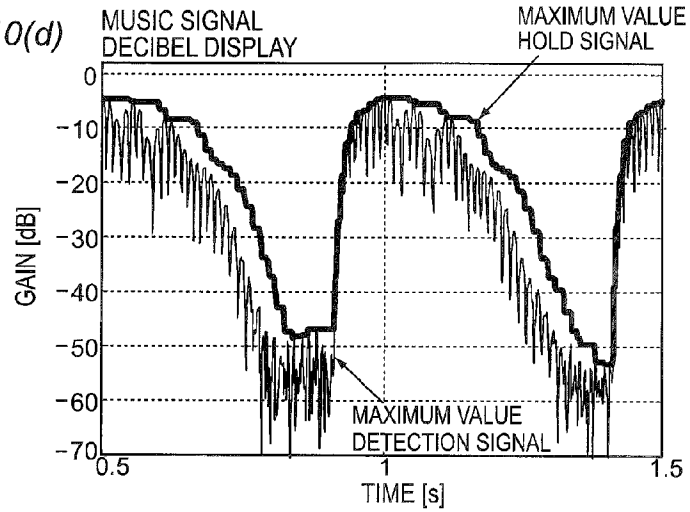

FIG. 8(*a*) is a graph illustrating the signal level [dB] of distortion components occurring in the speaker as the input level of a signal output from the speaker in a target vehicle interior is changed from −8 [dB] to 0 [dB]. As shown in FIG. 8(*a*), it is clear that, as the input level of a signal output from the speaker is raised, the distortion components increase. In this case, by collecting the sound through a microphone with a sweeping of the input signal (e.g., sine wave) and subtracting the collected sound signal from the input signal, it is possible to calculate an unwanted signal other than the input signal (sine wave). The unwanted signal thus calculated includes harmonic distortion and noise. By finding a band in which there are many distortion components, it is possible to make clear a band (i.e., band of the specific frequency) on which the correction process is to be performed. In the example of FIG. 8(*a*), the specific frequency is around 35 [Hz] to 40 [Hz], or more specifically 36 [Hz]. As can be seen from FIG. 8(*a*), in the range between 35 [Hz] and 40 [Hz], by reducing the signal level of the input signal by 8 [dB] from −8 [dB] to 0 [dB], it is possible to suppress the occurrence of distortion in the speaker. Accordingly, in the example of FIG. 8(*a*), the specific signal level is −8 [dB].

FIG. 8(*b*) is a graph illustrating filter characteristics of a peaking filter of the first filter unit 10 of the distortion correction unit 100. In the case of the peaking filter shown in FIG. 8(*b*), the center frequency (cut-off frequency) is set in a frequency band corresponding to a specific frequency of 36 [Hz], which is identified in FIG. 8(*a*) as described above.

FIG. 9(*a*) illustrates how the amplitude of an input signal changes when a sine wave is used as the input signal after a value of a parameter shown in Table 1 of FIG. 7(*a*) is set in the first filter unit 10. FIG. 9(*b*) illustrates how the amplitude of an output signal output from the first filter unit 10 changes in the input signal shown in FIG. 9(*a*). FIG. 9(*c*) illustrates how the amplitude of an input signal changes when a music signal is used as the input signal after a value of a parameter shown in Table 1 is set. FIG. 9(*d*) illustrates how the amplitude of an output signal output from the first filter unit 10 changes in the input signal shown in FIG. 9(*c*).

From the output signal of the sine wave shown in FIG. 9(*b*), it is unclear whether only the specific frequency is extracted by the peaking filter of the first filter unit 10. However, in the output signal of the music signal shown in FIG. 9(*d*), the amplitude overall is reduced compared with the input signal shown in FIG. 9(*c*). Therefore, it is determined that only the specific frequency is extracted by the peaking filter.

FIGS. 10(*a*) and 10(*b*) are graphs illustrating, in a linear manner (or in terms of amplitude) and a decibel manner (or in terms of gain), signals (the maximum value detection signal and the maximum value hold signal) that are output from the maximum value detection unit 21 and the maximum value hold unit 22 when a sine wave is used as the input signal. FIGS. 10(*c*) and 10(*d*) are graphs illustrating, in a linear manner (or in terms of amplitude) and a decibel manner (or in terms of gain), signals (the maximum value detection signal and the maximum value hold signal) that are output from the maximum value detection unit 21 and the maximum value hold unit 22 when a music signal is used as the input signal. The maximum value hold signal is a signal held by the maximum value hold unit 22 that is a maximum value of a signal detected by the maximum value detection unit 21.

Figure 11A:
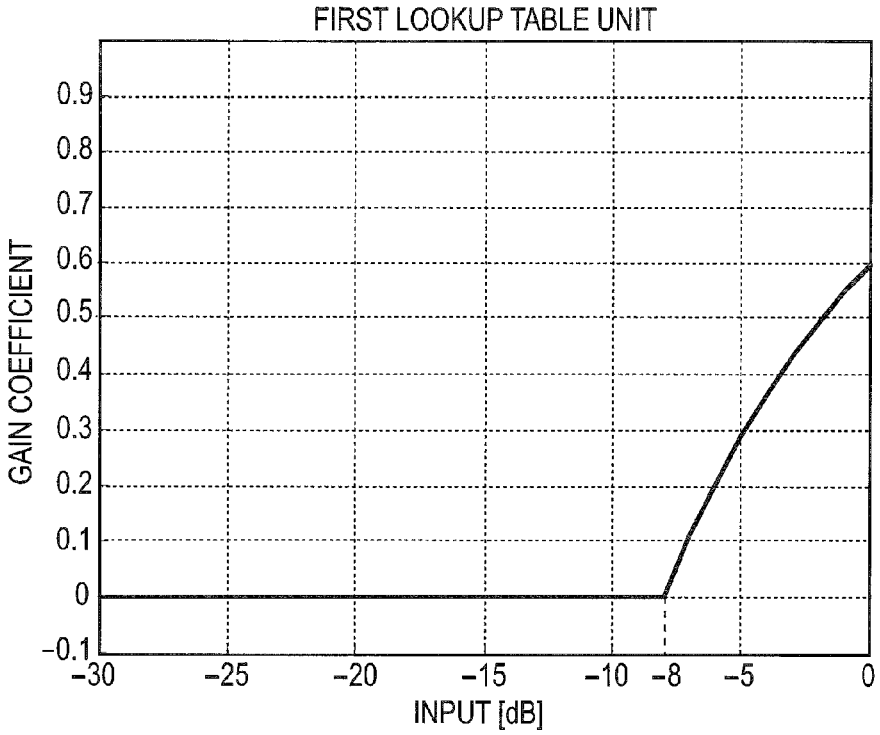
FIG. 11(*a*) is a graph illustrating a conversion table of a first lookup table unit.
Figure 11B:
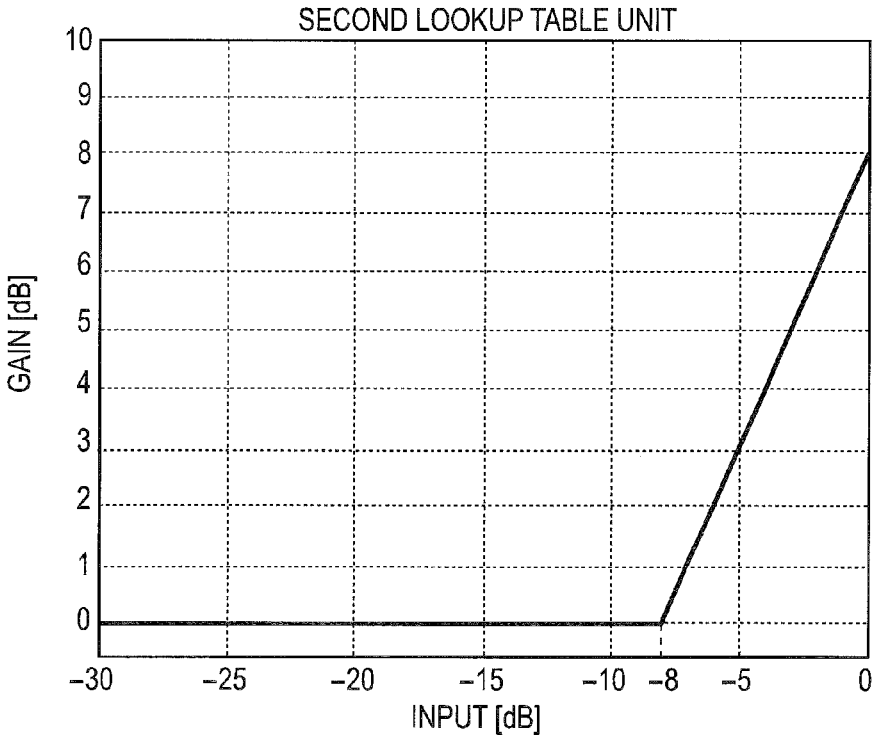

FIG. 11(*a*) illustrates a conversion table of the first lookup table unit 32. FIG. 11(*b*) illustrates a conversion table of the second lookup table unit 34. A signal (AR filter output signal) that has undergone attack-release control of the attack release filter unit 31 based on setting values shown in Table 1 of FIG. 7(*a*) is input to the first lookup table unit 32 and the second lookup table unit 34. A level conversion process is performed on the signal based on each of the conversion tables.

On the conversion table of the first lookup table unit 32 shown in FIG. 11(*a*), when the signal level of the signal input (AR filter output signal) is between −30 [dB] and −8 [dB], a post-conversion gain coefficient is set to 0. As described above with reference to a graph of FIG. 8(*a*) concerning distortion components of the input signal, in the case of the first embodiment, the specific signal level is −8 [dB]. Accordingly, if the signal level of the signal input is less than or equal to the specific signal level or between −30 [dB] and −8 [dB], distortion is unlikely to occur in a speaker, and there is no problem with the post-conversion gain coefficient being set to 0.

If the signal level of the signal input (AR filter output signal) is greater than the specific signal level or greater than −8 [dB], distortion occurs in the speaker. Therefore, on the conversion table shown in FIG. 11(*a*), after the signal level of the signal input (AR filter output signal) exceeds −8 [dB], the gain coefficient is set in such a way as to increase as the signal level rises.

That is, if the signal level of the specific frequency (or frequency extracted by the first filter unit 10) is less than or equal to a preset threshold value (specific signal level: in the case of the first embodiment, a signal level of −8 [dB]), the gain coefficient is set to 0, and substantially no corrections are made to the signal level. If the signal level is greater than the preset threshold value (specific signal level), the gain coefficient is set in such a way as to reduce the signal level in accordance with the value of the signal level that has exceeded the threshold value. According to the first embodiment, as shown in FIG. 11(*a*), if the signal level input is greater than −8 [dB], the gain coefficient is increased from 0 to 0.6 as the signal level input rises from −8 [dB] to 0 [dB]. The gain coefficient is output as a control signal via the first LPF unit 33. Then, in the first multiplication unit 41, a signal (correction band extraction signal) that is generated by multiplying the control signal (gain coefficient) by the correction band signal is subtracted from the input signal. As a result, a correction signal in which a signal that causes distortion at the specific frequency is suppressed is generated.

On the conversion table of the second lookup table unit 34 shown in FIG. 11(*b*), as in the case of the first lookup table unit 32, when the signal level of the signal input is between −30 [dB] and −8 [dB], a post-conversion correction amount (gain) is set to 0. As described above with reference to the graph of FIG. 8(*a*) concerning distortion components of the signal input, in the range between −30 [dB] and −8 [dB], distortion is unlikely to occur in a speaker. If the signal level of the signal input is greater than −8 [dB], the conversion table is set in such a way as to increase the correction amount (gain) in proportion to a rise in the signal level. As shown in FIG. 11(*b*), if the signal level input is greater than −8 [dB], the correction amount rises from 0 [dB] to 8 [dB] in proportion to a rise ih the signal level input from −8 [dB] to 0 [dB].

When the conversion table of the first lookup table unit 32 is compared with the conversion table of the second lookup table unit 34, both conversion tables are the same in that, when the signal level of the signal input (AR filter output signal) is between −30 [dB] and −8 [dB], the value after the level conversion by the conversion tables is set to 0, and that no aggressive corrections are made. That is, in the range between −30 [dB] and −8 [dB], as the outputs of the level conversion, the gain coefficient is 0, and the correction amount (or gain for correction) is 0 [dB]. If the signal level of the signal input is greater than −8 [dB], the gain coefficient of the conversion table of the first lookup table unit 32 and the correction amount (gain) of the conversion table of the second lookup table unit 34 increase in accordance with the signal level, although the rate of increase is different. For example, if the signal level of the signal input (AR filter output signal) is 0 [dB], the gain coefficient of the first lookup table unit 32 is 0.6, while the correction amount of the second lookup table unit 34 is 8 [dB]. Even though the gain coefficient, 0.6, and the correction amount, 8 [dB], are different values, the values will be able to correct the signal level by the same amount.

In general, the general formula for calculating sound pressure can be represented as follows:

$$SPL=20\log_{10}(p_1/p_0) \qquad \text{Formula 1}$$

where SPL represents the sound pressure level [dB (Decibel)]; $p_1$ represents the sound pressure [Pa (Pascal)]; and $p_0$ represents the reference sound pressure ($=20\times10^{-6}$ [Pa]).

In this manner, the sound pressure level (SPL) is represented as the common logarithm of the ratio to a value with respect to the magnitude of the sound pressure (Pascal).

Suppose that the reference sound pressure $p_0$ takes a reference value of 1, and that the input signal of full scale 0 [dB] (with a maximum amplitude value of 1) is multiplied by 0.4. The description below is what value the sound pressure would take with a sound pressure level [dB].

On the basis of Formula 1, the SPL with a sound pressure ratio of 0.4 is as follows:

$$\begin{aligned} SPL &= 20\log_{10}(0.4/1) \\ &= -7.95880017 \text{ [dB]} \end{aligned}$$

As described above, if the signal level of the signal input is 0 [dB], the gain coefficient is 0.6 in FIG. 11(*a*). This gain coefficient is multiplied by the correction band signal in the first multiplication unit 41 to generate a correction band extraction signal. The correction band extraction signal is subtracted from the input signal coming from the sound source. Accordingly, if the maximum amplitude value of the input signal is 1 (reference value=1), the correction band extraction signal has a maximum amplitude value of 0.6 with respect to the input signal, and the maximum amplitude value of the correction signal that is generated by subtracting the correction band extraction signal from the input signal comes to 0.4. Accordingly, the maximum amplitude value, 0.4, of the correction signal corresponds to a signal whose signal level is reduced (corrected) by −8 [dB] with respect to the input signal, according to the above formula. The −8 [dB] corresponds to the 8 [dB] of the correction amount (gain) of the conversion table of the second lookup table unit 34 when the signal input is 0 [dB].

That is, the gain coefficient that is calculated by the conversion table of the first lookup table unit 32, and the correction amount that is calculated by the conversion table of the second lookup table unit 34 are values that are set to correct the signal level by the same gain (level).

Moreover, in Formula 1, reference sound pressure $p_0$ is set to a reference value of 1. As a result, as described above, reference sound pressure $p_0$ is negligible. Therefore, Formula 1 can be represented by:

$$p_1=10^{SPL/20} \qquad \text{Formula 2}$$

On the basis of Formula 2, since the gain coefficient that is calculated by the conversion table of the first lookup table unit 32 is a control signal that is used to subtract from the input signal, the gain coefficient can be represented by:

$$p_1'=1-10^{SPL/20} \qquad \text{Formula 3}$$

In Formula 3, the maximum amplitude value on full scale 0 [dB] is 1.

Figure 12A:
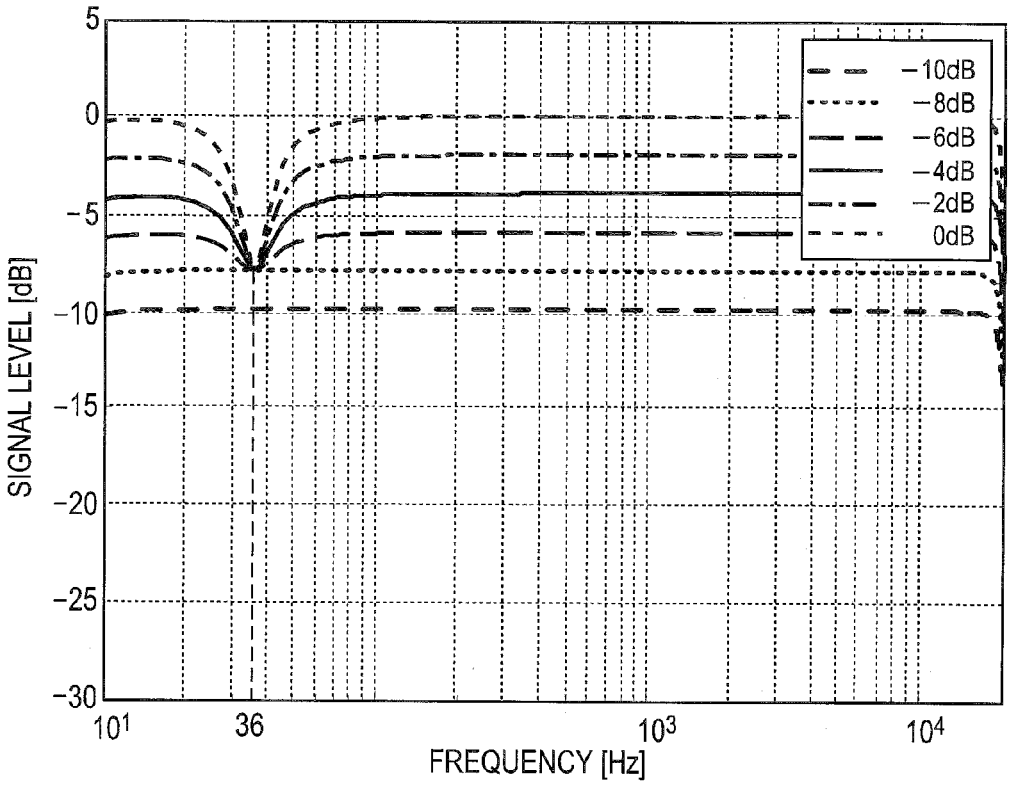
FIGS. 12(*a*) and 12(*b*) are graphs illustrating correction characteristics of a frequency band where distortion is corrected by the distortion correction unit in accordance with a signal level of a signal input.
Figure 12B:
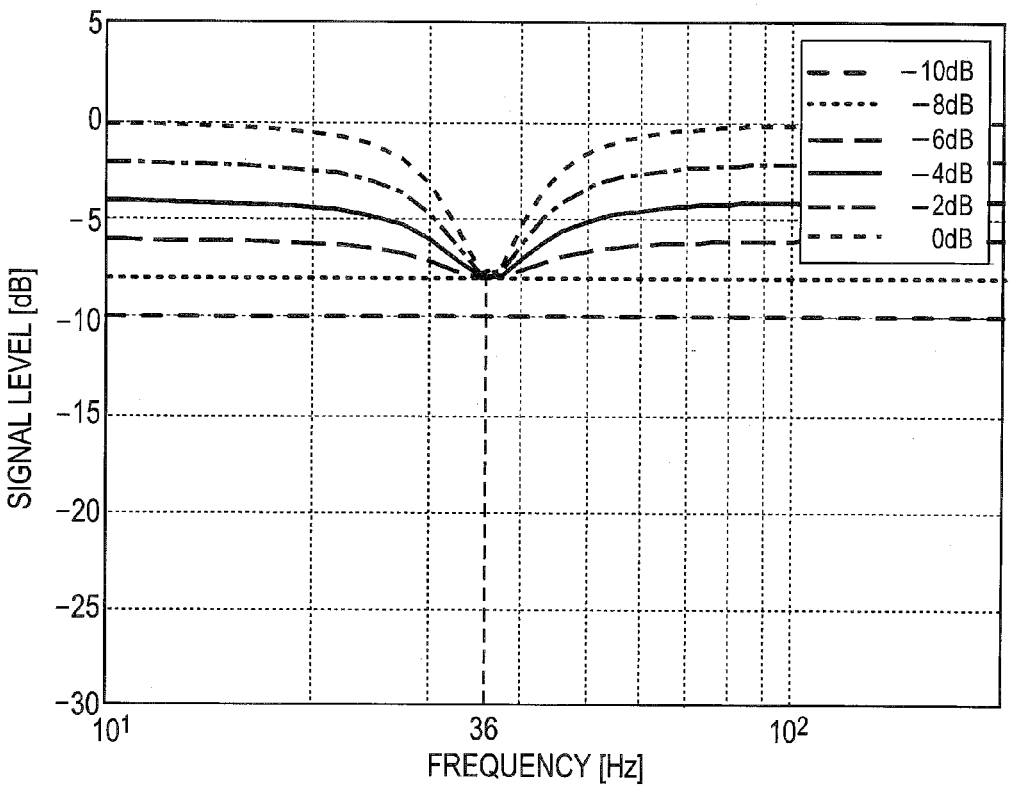
Figure 13A:
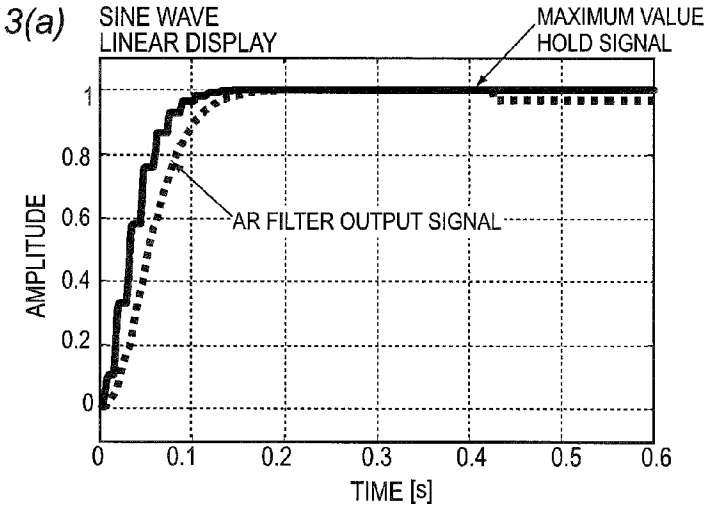
FIGS. 13(*a*) to 13(*d*) are graphs illustrating a maximum value hold signal that is input to an attack release filter unit, and an AR filter output signal that is output from the attack release filter unit.
Figure 13B:
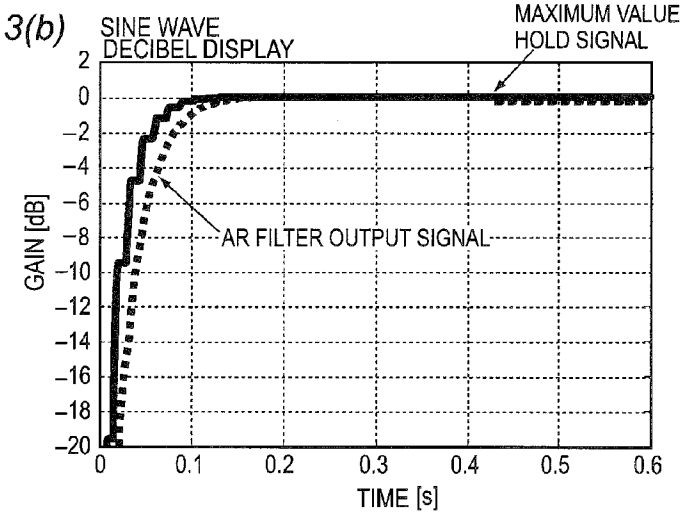
Figure 13C:
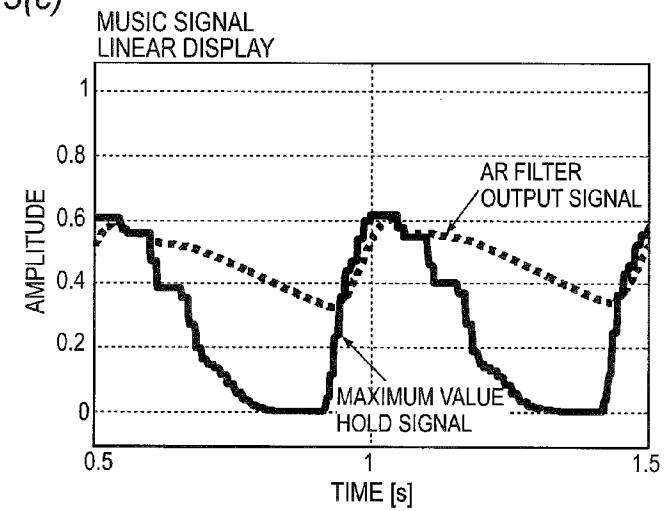
Figure 13D:
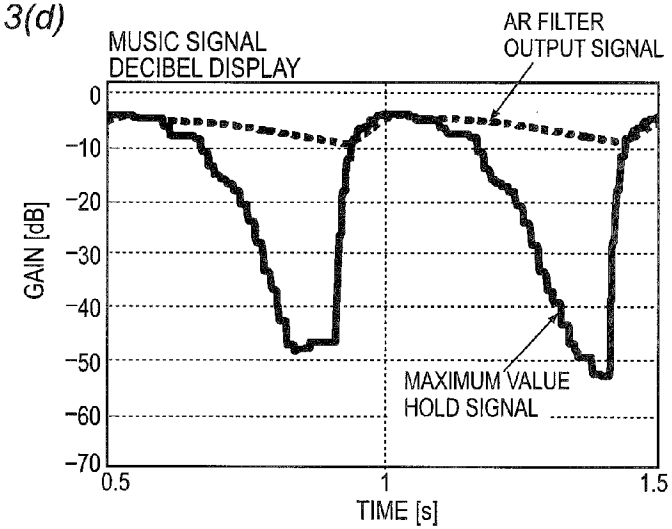
Figure 14A:
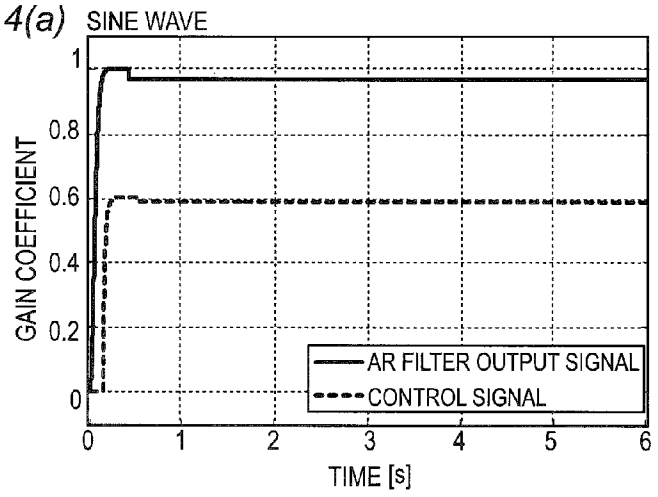
FIGS. 14(*a*) and 14(*c*) are graphs illustrating an AR filter output signal that is input to the first lookup table unit, and a control signal that is output from a first LPF unit, and FIGS. 14(*b*) and 14(*d*) are graphs illustrating the AR filter output signal that is input to a second lookup table unit, and a correction amount that is output from the second lookup table unit.
Figure 14B:
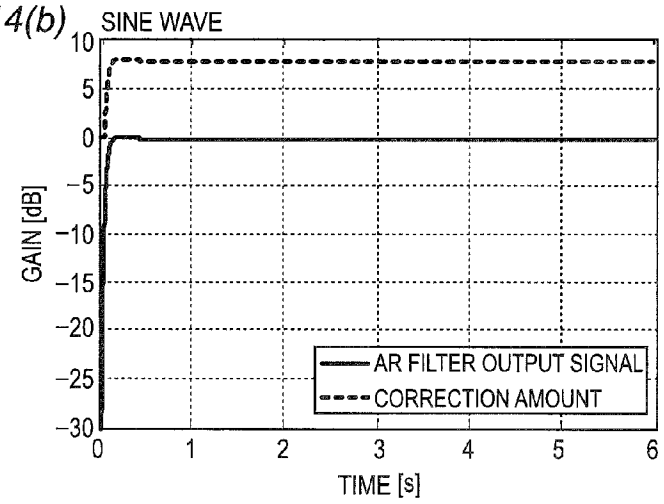
Figure 14C:
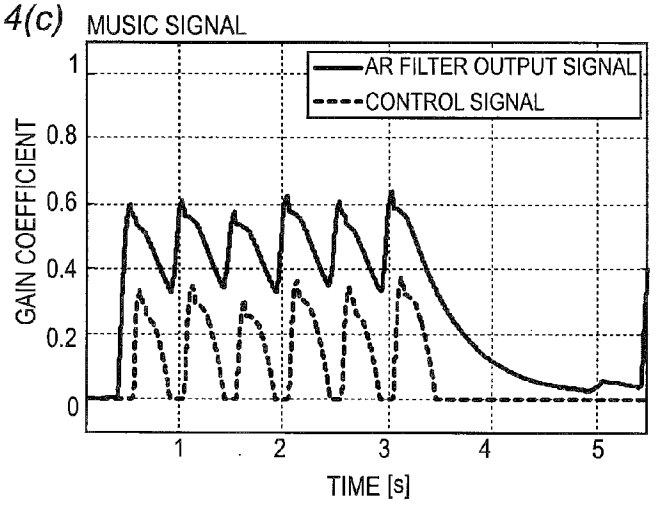
Figure 14D:
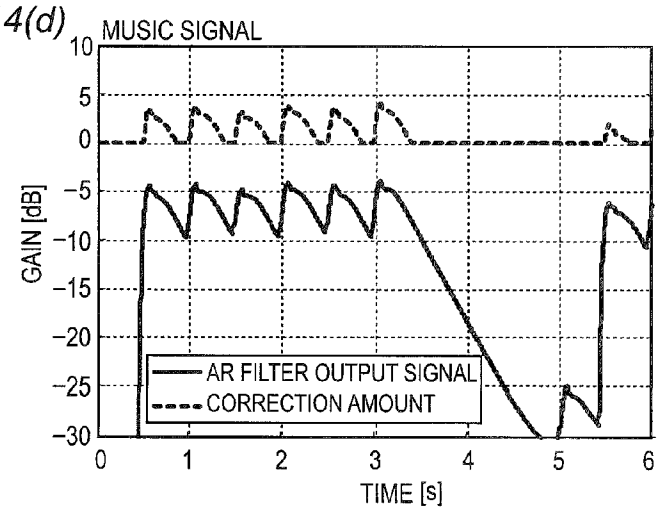
Figure 15A:
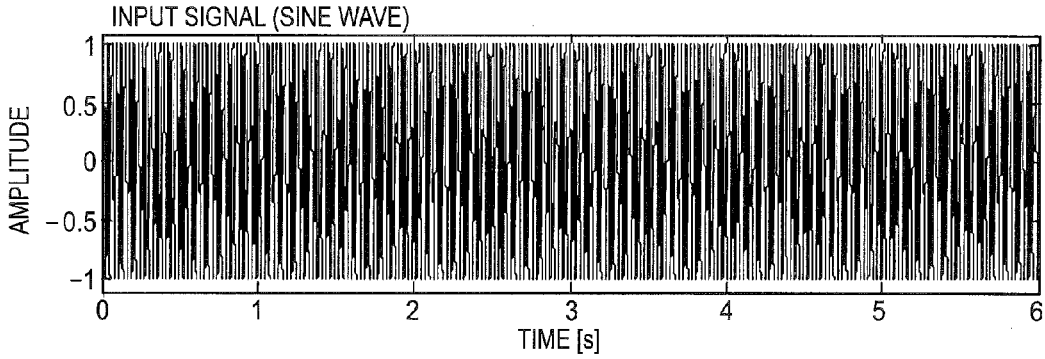
FIGS. 15(*a*) and 15(*c*) are graphs illustrating the input signal that is input to a second addition unit, and FIGS. 15(*b*) and 15(*d*) are graphs illustrating a correction signal calculated in the second addition unit.
Figure 15B:
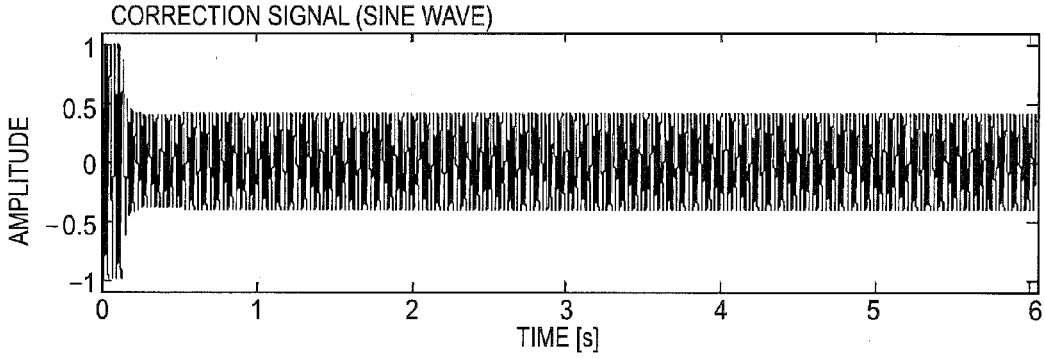
Figure 15C:
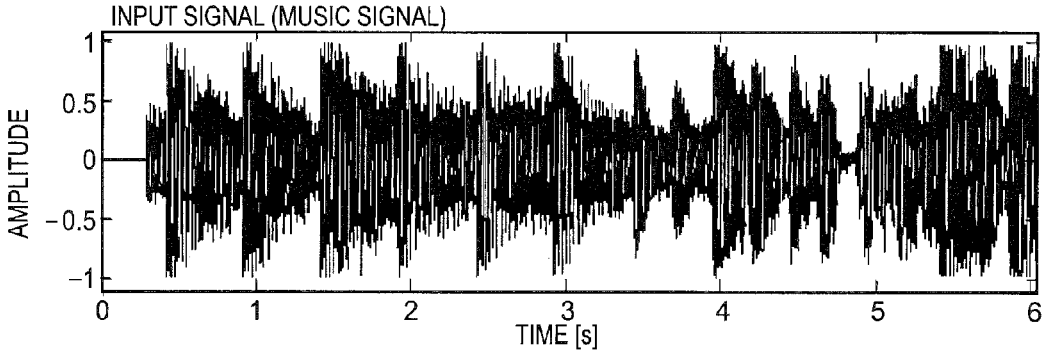
Figure 15D:
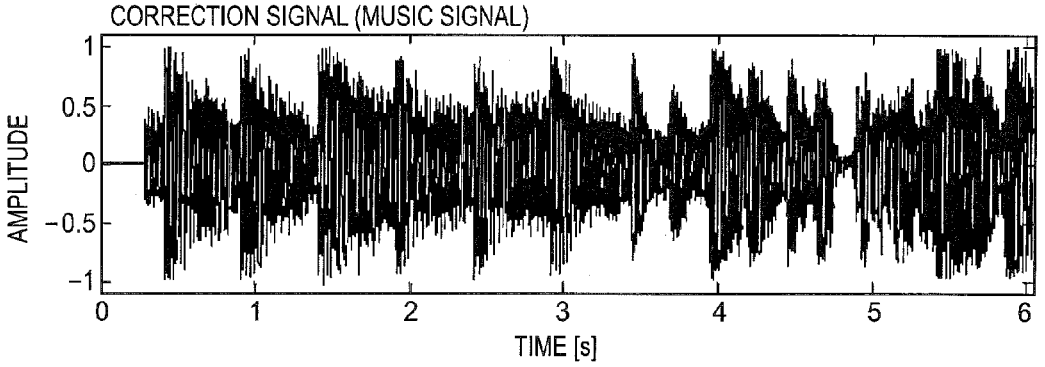

For example, when the signal level of the signal input is −3 [dB], the gain coefficient is 0.4377 based on the conversion table of the first lookup table unit 32 shown in FIG. 11(*a*). When the gain coefficient is 0.4377, sound pressure level SPL [dB (Decibel)] is −5.0006 [dB] based on Formula 3. When the signal level of the signal input is −3 [dB], the correction amount is 5 [dB] based on the conversion table of the second lookup table unit 34 shown in FIG. 11(*b*); this correction amount corresponds to the −5 [dB] that is calculated from Formula 3. FIGS. 12(*a*) and 12(*b*) are graphs illustrating correction characteristics of a frequency band where distortion is corrected by the distortion correction unit 100 in accordance with the signal level of the signal input. As shown in FIGS. 12(*a*) and 12(*b*), corrections are made at the specific frequency (36 Hz), which is a frequency at which distortion occurs in a speaker. Furthermore, for the signal levels greater than or equal to −8 [dB], the gain is suppressed in such a way that the signal level of the specific frequency becomes less than or equal to −8 [dB].

FIGS. 13(*a*) to 13(*d*) are graphs illustrating a maximum value hold signal that is input to the attack release filter unit 31 from the maximum value hold unit 22, and an AR filter output signal that is output from the attack release filter unit 31. FIGS. 13(*a*) and 13(*b*) illustrate a linear display output (FIG. 13(*a*)) and decibel display output (FIG. 13(*b*)) of each signal (the maximum value hold signal and the AR filter output signal) when the input signal is a sine wave; FIGS. 13(*c*) and 13(*d*) illustrate a linear display output (FIG. 13(*c*)) and decibel display output (FIG. 13(*d*)) of each signal (the maximum value hold signal and the AR filter output signal) when the input signal is a music signal.

It is clear that, because the maximum value hold signal has undergone the attack-release filter process in the attack release filter unit 31, the output signal (AR filter output signal) has been smoothed. By increasing the values of the attack time and release time that are set in the attack-release filter unit 31, it is possible to increase the extent to which the output signal is smoothed. In this manner, by adjusting the parameters of the attack release filter in the attack release filter unit 31, it is possible to adjust the extent to which the output signal (AR filter output signal) is smoothed.

FIGS. 14(*a*) and 14(*c*) illustrate an AR filter output signal that is input to the first lookup table unit 32 from the attack release filter unit 31, and a control signal that is output from the first LPF unit 33 via the first lookup table unit 32, and FIGS. 14(*b*) and 14(*d*) are graphs illustrating an AR filter output signal that is input to the second lookup table unit 34 from the attack release filter unit 31, and a correction amount that is output from the second lookup table unit 34. FIGS. 14(*a*) and 14(*b*) illustrate a linear display output (FIG. 14(*a*)) and decibel display output (FIG. 14(*b*)) of each signal (the AR filter output signal, the control signal, and the correction amount) when the input signal is a sine wave. FIGS. 14(*c*) and 14(*d*) illustrate a linear display output (FIG. 14(*c*)) and decibel display output (FIG. 14(*d*)) of each signal when the input signal is a music signal.

FIGS. 15(*a*) and 15(*c*) illustrate an input signal that is input to the second addition unit 42, and FIGS. 15(*b*) and 15(*d*) illustrate a correction signal calculated by subtracting a correction band extraction signal from an input signal. FIGS. 15(*a*) and 15(*b*) illustrate how the amplitude of each signal (the input signal and the correction signal) changes when the input signal is a sine wave, and FIGS. 15(*c*) and 15(*d*) illustrate how the amplitude of each signal (the input signal and the correction signal) changes when the input signal is a music signal.

Figure 16A:
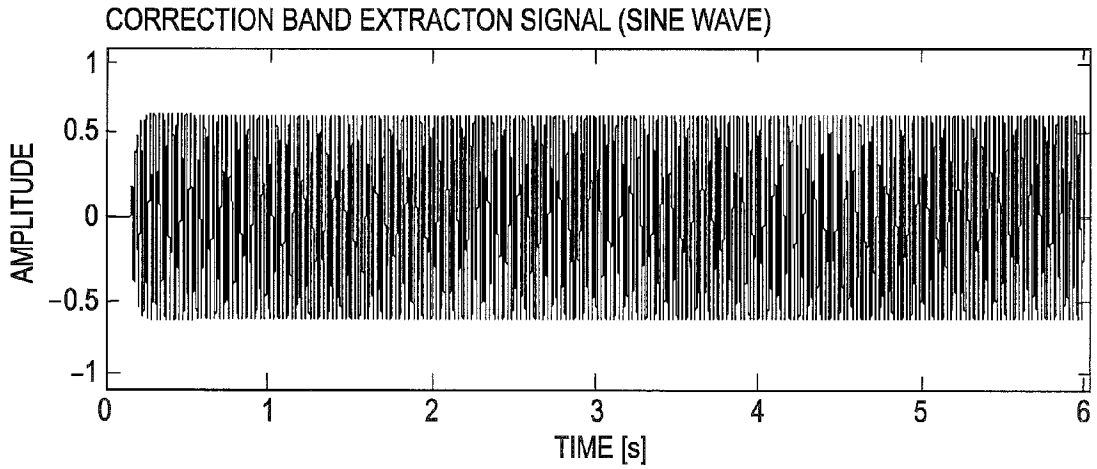
FIG. 16(*a*) is a graph illustrating how the amplitude of a correction band extraction signal changes when the input signal is a sine wave.
Figure 16B:
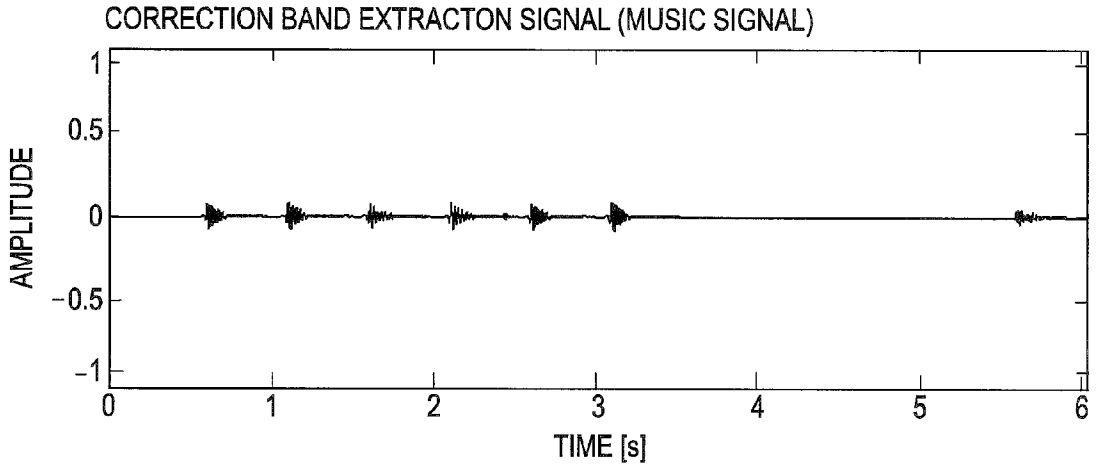

In the diagram of the sine wave shown in FIG. 15(*a*), what is shown is the maximum amplitude value of the input signal that is 1 (full scale). The maximum amplitude value (gain coefficient) of the correction signal calculated from FIG. 15(*b*) is 0.4 (or about −8 [dB]). This means that the signal level of the input signal has been suppressed (or corrected) by 8 [dB] in the distortion correction unit 100. FIG. 16(*a*) illustrates how the amplitude of a correction band extraction signal changes when the input signal is a sine wave. If the maximum amplitude value of the input signal is 1, the amplitude value of the correction band extraction signal is 0.6 as shown in the diagram.

FIGS. 15(*c*) and 15(*d*) illustrate a case where the input signal is a music signal. In the case of the music signal, even if only the signal level of the specific frequency is suppressed, the total amount of suppression tends not to be reflected in the amplitude value. Accordingly, the maximum amplitude value of the correction signal of FIG. 15(*d*) appears not to have decreased as much as that of the correction signal of FIG. 15(*b*). However, the comparison with the input signal shown in FIG. 15(*c*) reveals that the amplitude value has decreased. FIG. 16(*b*) illustrates how the amplitude of a correction band extraction signal changes when the input signal is a music signal. When the input signal is a music signal, a change in the amplitude of the correction band extraction signal shown in the diagram is smaller than that of the sine wave.

The correction band extraction signal shown in, FIGS. 16(*a*) and 16(*b*), and the correction amount shown in FIGS. 14(*b*) and 14(*d*) are output from the distortion correction unit 100 to the low-frequency range complement unit 200, and an overtone signal is generated in the low-frequency range complement unit 200.

FIG. 7(*b*) is Table 2 showing parameters (setting values) that are set in each function unit of the low-frequency range complement unit 200. Each of the setting values of the parameters shown in Table 2 is determined based on the distorted sound that occurs in a speaker.

Figure 17A:
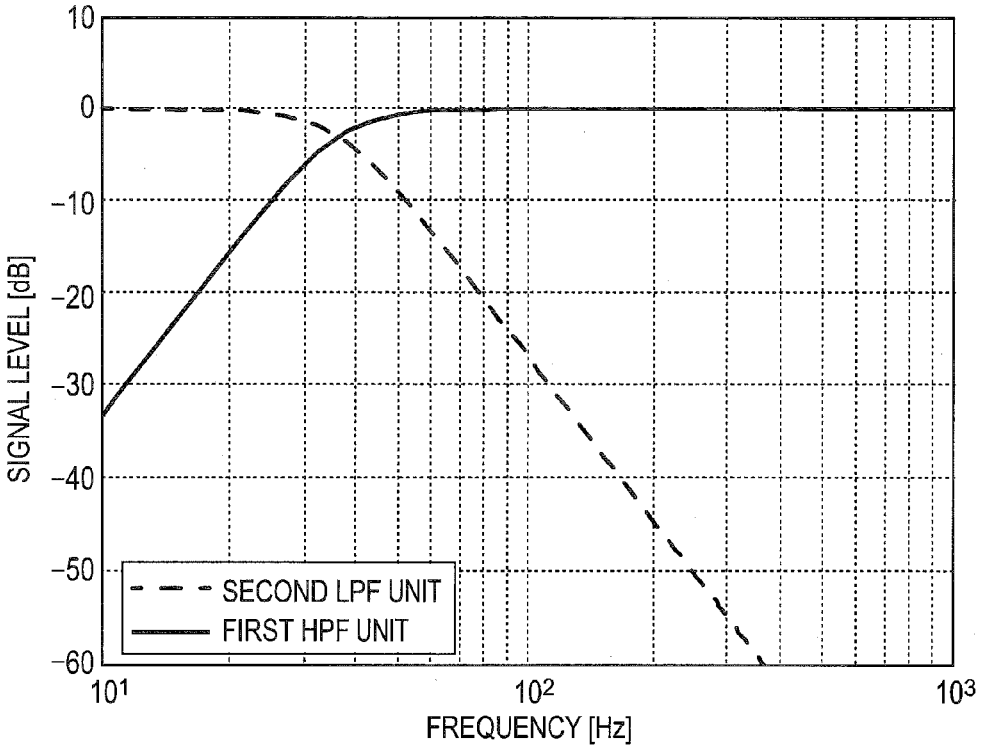
FIG. 17(*a*) is a graph illustrating filter characteristics of a first HPF unit and a second LPF unit.
Figure 17B:
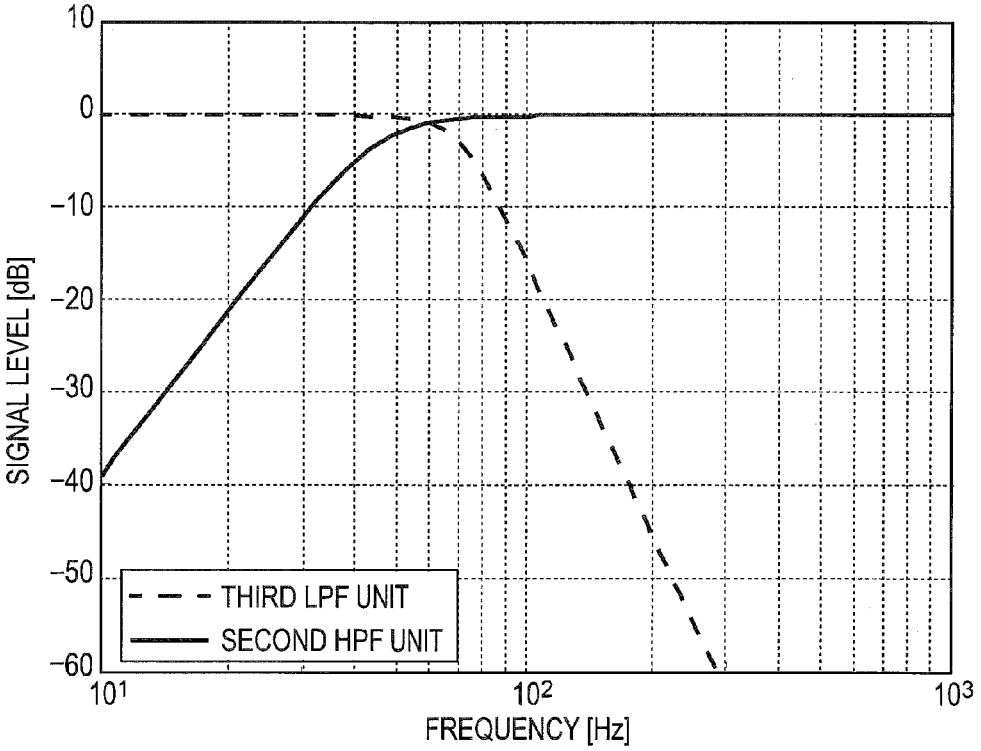
Figure 18A:
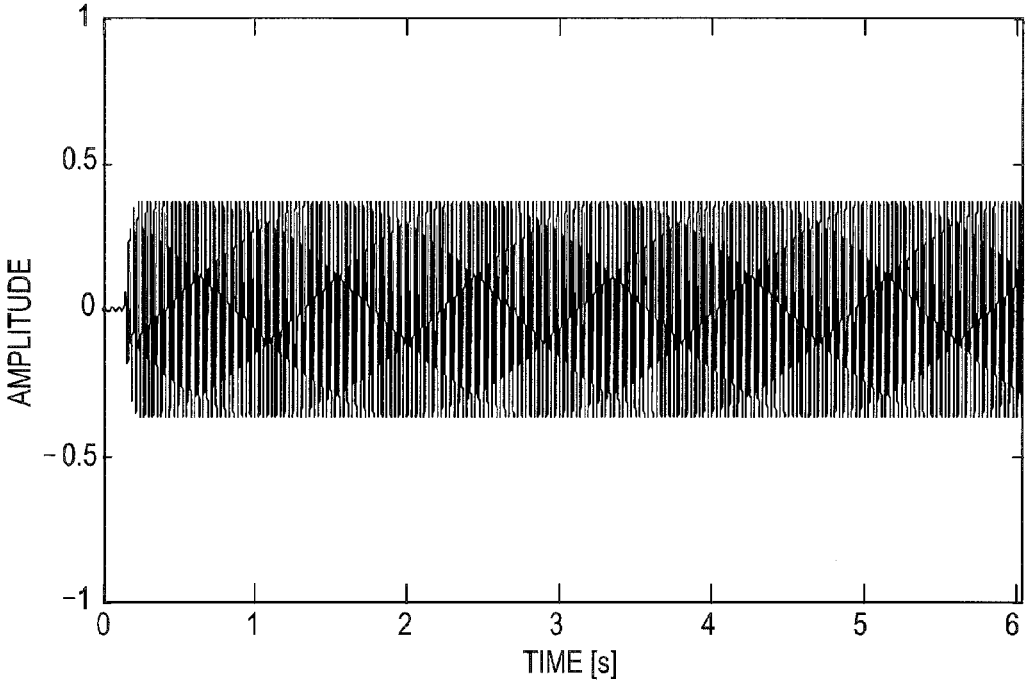
FIG. 18(*a*) is a graph illustrating a low-frequency range correction band extraction signal when the input signal is a sine wave.
Figure 18B:
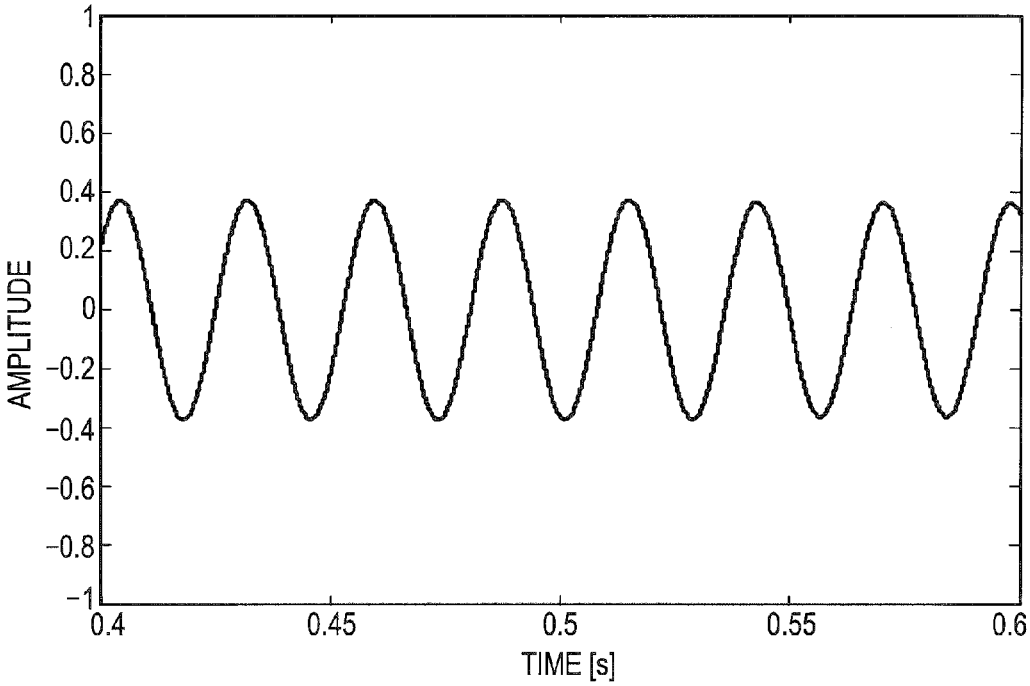
Figure 19A:
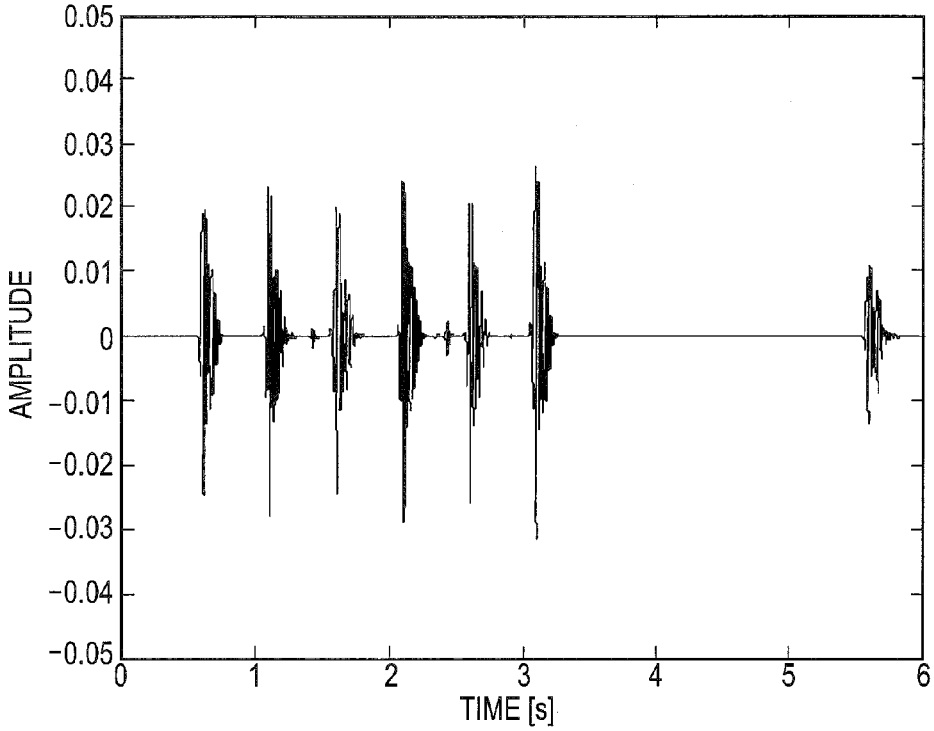
FIG. 19(*a*) is a graph illustrating a low-frequency range correction band extraction signal when the input signal is a music signal.
Figure 19B:
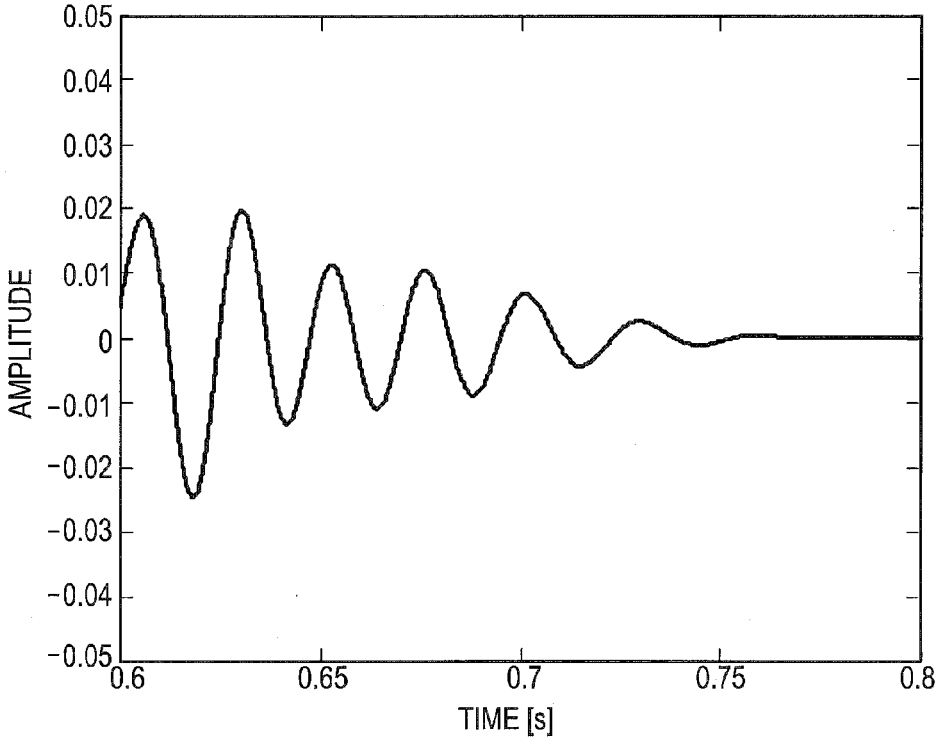

FIG. 17(*a*) is a graph illustrating filter characteristics of the first HPF unit 51 and the second LPF unit 52. From the correction band extraction signal that is input from the distortion correction unit 100, high frequencies are extracted by the first HPF unit 51 that has filter characteristics shown in FIG. 17(*a*), and a high-frequency range correction band extraction signal (first correction band extraction signal) is generated. Low frequencies are extracted by the second LPF unit 52, and a low-frequency range correction band extraction signal (second correction band extraction signal) is generated. FIG. 18(*a*) illustrates a low-frequency range correction band extraction signal when the input signal is a sine wave; FIG. 18(*b*) is a graph illustrating expanded time intervals of the low-frequency range correction band extraction signal shown in FIG. 18(*a*). FIG. 19(*a*) illustrates a low-frequency range correction band extraction signal when the input signal is a music signal; FIG. 19(*b*) is a graph illustrating expanded time intervals of the low-frequency range correction band extraction signal shown in FIG. 19(*a*).

Figure 20A:
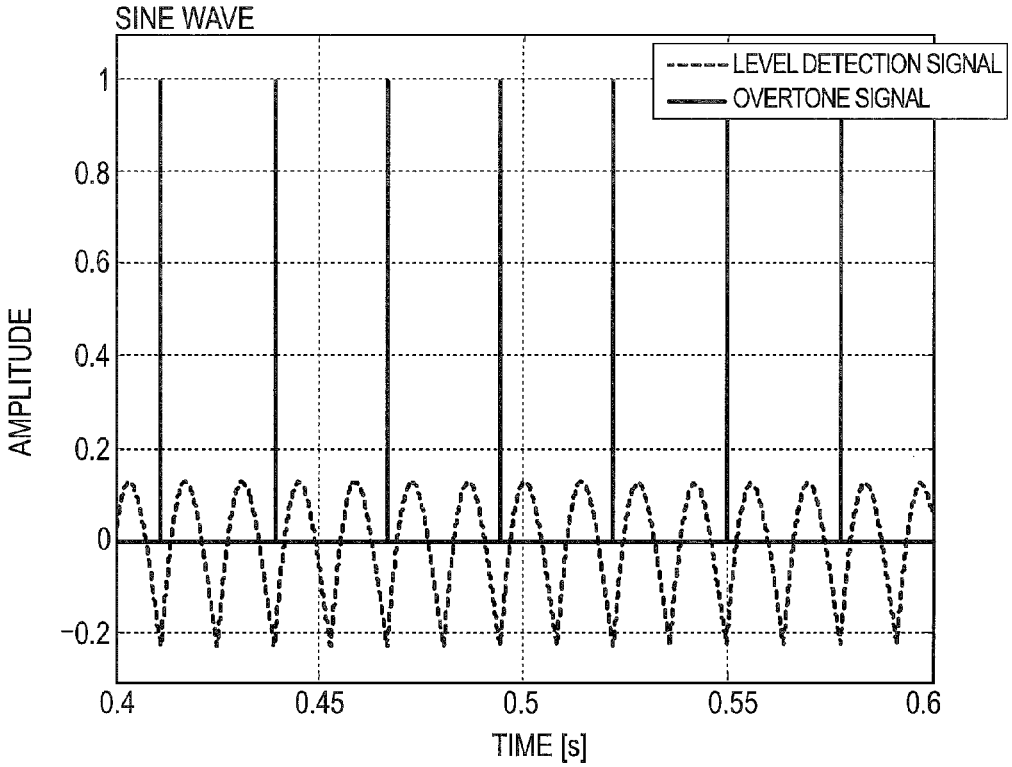
FIGS. 20(*a*) and 20(*b*) are graphs illustrating a level detection signal that is output from a level detection signal generation unit, and an overtone signal that is output from an edge detection unit.
Figure 20B:
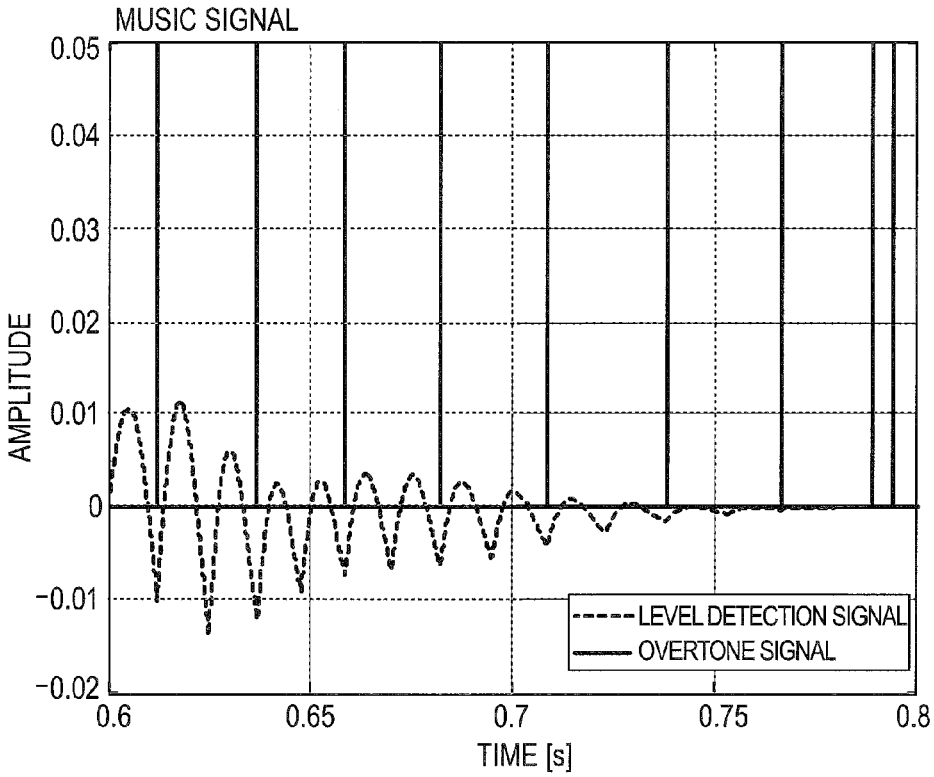

The low-frequency range correction band extraction signal that is output from the second LPF unit 52 is output to the level detection signal generation unit 53 and the edge detection unit 54. FIGS. 20(*a*) and 20(*b*) are graphs illustrating a level detection signal that is output from the level detection signal generation unit 53, and an overtone signal that is output from the edge detection unit 54: FIG. 20(*a*) illustrates a case where the input signal is a sine wave, and FIG. 20(*b*) illustrates a case where the input signal is a music signal.

The level detection signal generation unit 53 of the first embodiment employs a first-order Butterworth filter in order to remove DC components; the cut-off frequency is set to 20 [Hz] (See Table 2 shown in FIG. 7(*b*)). The edge detection unit 54 detects a position where the low-frequency range correction band extraction signal input turns positive after being negative, and generates an impulse train of that position. In FIGS. 20(*a*) and 20(*b*), the signal level of the level detection signal is being offset to the negative side at the position of the impulse train as DC components are removed. The offset amount to the negative side at the position of the impulse train represents the signal level of a low-frequency range signal detected.

Figure 21A:
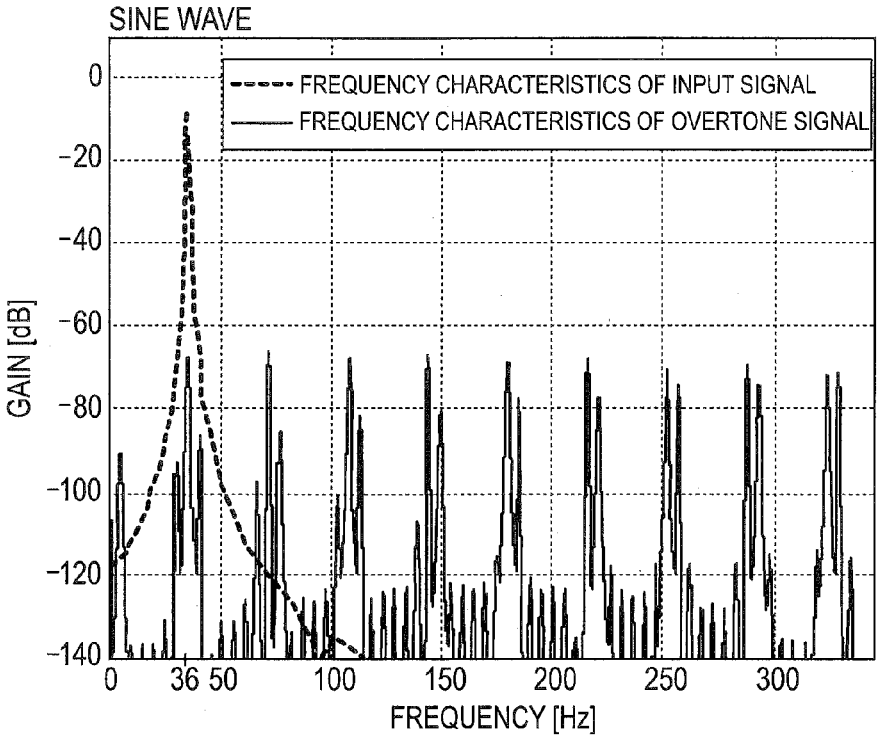
FIGS. 21(*a*) and 21(*b*) are graphs illustrating frequency characteristics of the input signal with a specific frequency extracted, and frequency characteristics of an overtone signal with the phase being inverted by a phase inversion unit.
Figure 21B:
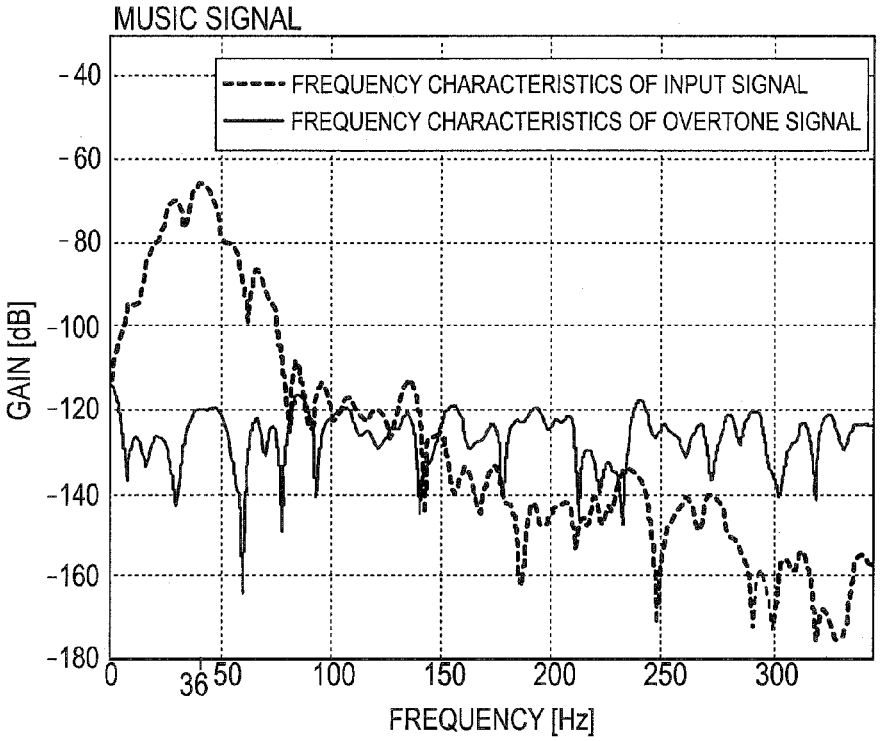

Then, the second multiplication unit 55 adds weight to the impulse train in accordance with the signal level of the low-frequency range signal. Furthermore, the phase inversion unit 56 inverts the phase of the overtone signal. FIGS. 21(*a*) and 21(*b*) are graphs illustrating frequency characteristics of the input signal with the specific frequency extracted by the first filter unit 10, and frequency characteristics of the overtone signal after weight is added by the second multiplication unit 55 and the phase is inverted by the phase inversion unit 56. FIG. 21(*a*) illustrates a case where the input signal is a sine wave, and FIG. 21(*b*) illustrates a case where the input signal is a music signal.

As shown in FIG. 21(*a*), in the case of the input signal, only the value of the gain (signal level) at the specific frequency, 36 [Hz], is high. In the case of the overtone signal, the gain (signal level) whose frequency is a multiple of 36 [Hz], which includes not only 36 [Hz] but also 72 [Hz], 108 [Hz], 144 [Hz], is at the same level (gain). In FIG. 21(*a*), the gain of the overtone signal is smaller than the gain of the input signal. The reason is that pulses for each period of the sine wave are extracted in the overtone signal, and that, in the overtone signal shown in FIG. 21(*a*), only the level (energy) [dB] of one sample is shown with respect to one period of the sine wave. Meanwhile, in the signal level of the input signal shown in FIG. 21(*a*), the level (energy) [dB] in one period of the sine wave is shown. Therefore, there is a difference of about 60 [dB] in the signal level (gain) between the signal level of the input signal and the signal level of the overtone signal. This difference needs to be amplified by the amplification unit 59.

One period of the 36 [Hz] sine wave amounts to 1,225 samples (=44,100 [Hz] (Sampling frequency)÷36 [Hz]). With respect to the 36 [Hz] sine wave, the level (energy) of one sample is:

$$20\times\log_{10}(1/1{,}225)=-61.7627\ [\mathrm{dB}]$$

That is, the figure needs to be amplified by about 61 [dB]. Accordingly, before the amplification by the amplification unit 59, the amplification initial value is set to 61 [dB] (See Table 2 of FIG. 7(*b*)). Furthermore, by using a value that is obtained by adding the correction amount calculated by the distortion correction unit 100 to the amplification initial value, the amplification unit 59 amplifies the overtone signal. As described above with reference to FIG. 11(*b*), the correction amount of the first embodiment is set to between 0 [dB] and 8 [dB] by the second lookup table unit 34.

FIG. 17(*b*) is a graph illustrating characteristics of band-limiting filters of the third LPF unit 57 and second HPF unit 58, which have cut-off frequencies as set in Table 2 shown in FIG. 7(*b*). The overtone signal whose phase has been inverted is output to the amplification unit 59 after the band thereof is limited by the third LPF unit 57 and second HPF unit 58 having filter characteristics shown in FIG. 17(*b*).

In this case, the cut-off frequency set in the third LPF unit 57 is set to a higher frequency than the center frequency of the peaking filter used by the first filter unit 10. More specifically, the cut-off frequency set in the third LPF unit 57 is 70 [Hz], and the center frequency set in the first filter unit 10 is 36 [Hz]. In this manner, the cut-off frequency of the third LPF unit 57 is set to a higher frequency than the center frequency of the first filter unit 10. As a result, while suppressing the suppression of the outputting of the overtone signal whose frequency is twice as high as the specific frequency (36 [Hz]) and of the outputting of the overtone signal whose frequency is three times as high as the specific frequency, it is possible to suppress, in stages, the outputting of the overtone signal whose frequency is a larger multiple thereof. Thus, it is possible to effectively prevent distorted sound or abnormal noise that could occur due to the outputting of high-frequency range of overtone signal.

Figure 22A:
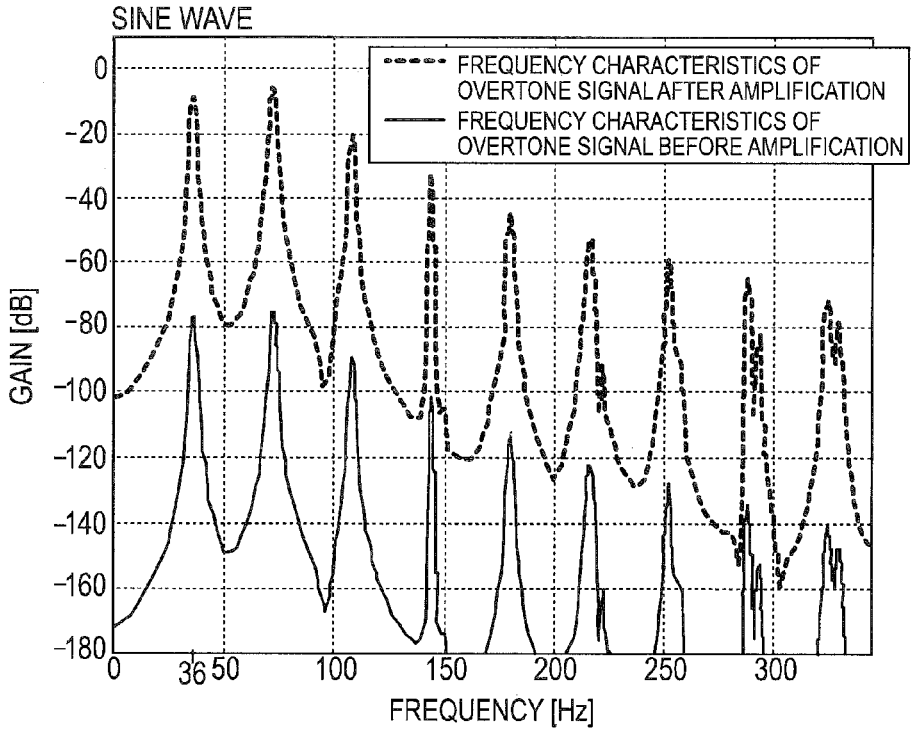
FIGS. 22(*a*) and 22(*b*) are graphs illustrating frequency characteristics of an overtone signal before an amplification process is performed, and frequency characteristics of an overtone signal after an amplification process is performed.
Figure 22B:
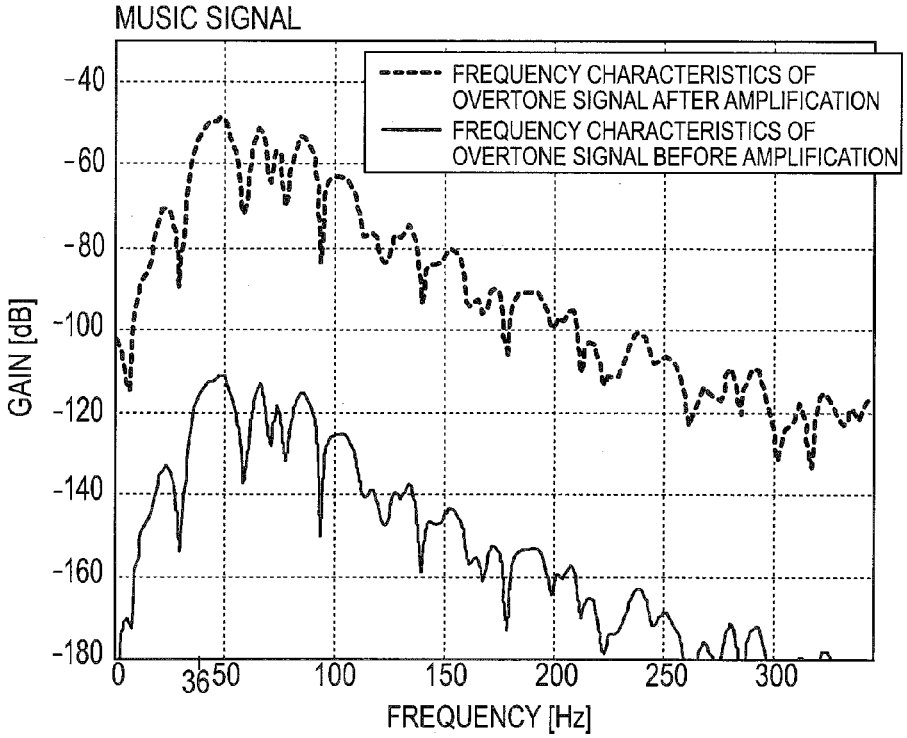
Figure 23A:
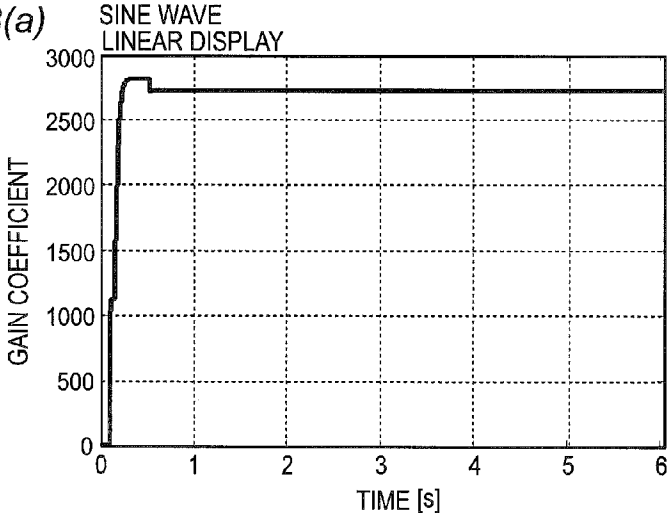
FIGS. 23(*a*) and 23(*c*) are graphs illustrating, in linear manner, an amplification value in an amplification unit (amplification initial value+correction amount), and FIGS. 23(*b*) and 23(*d*) are graphs illustrating, in decibel manner, an amplification value in the amplification unit (amplification initial value+correction amount)
Figure 23B:
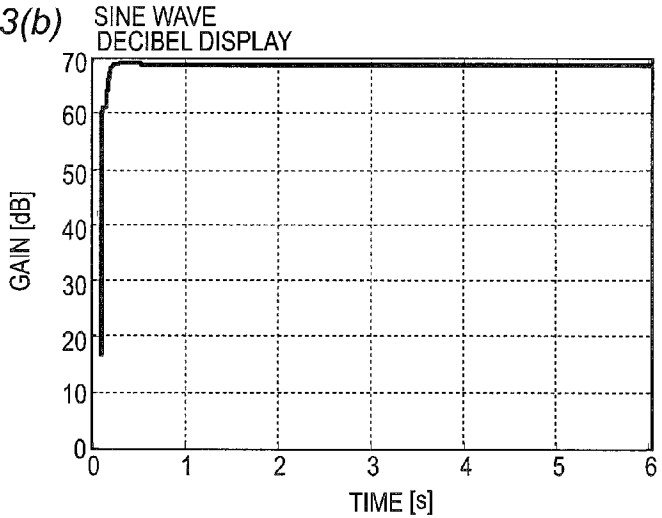
Figure 23C:
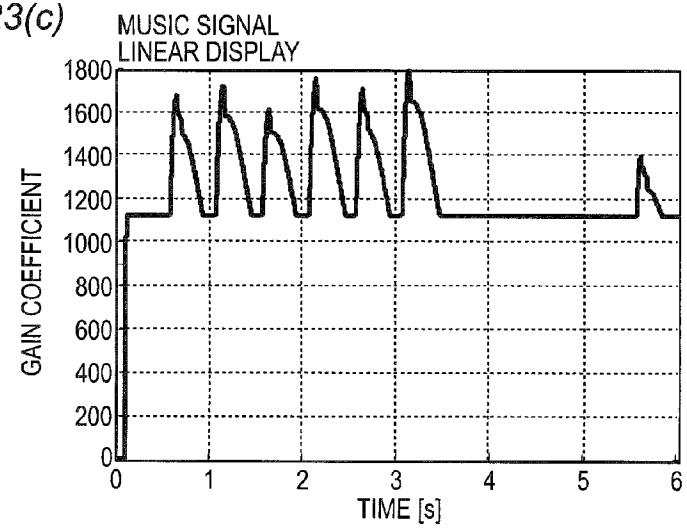
Figure 23D:
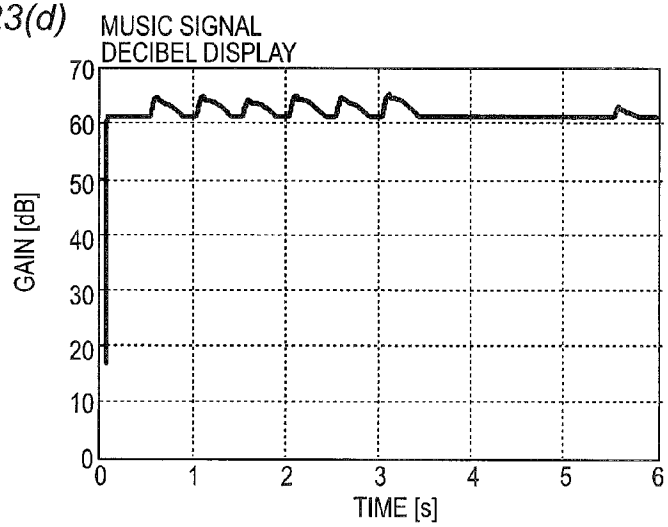

FIGS. 22(*a*) and 22(*b*) are graphs illustrating frequency characteristics of an overtone signal that is input to the amplification unit 59 (or an overtone signal before an amplification process is performed), and frequency characteristics of an overtone signal after an amplification process is performed by the amplification unit 59. FIG. 22(*a*) illustrates a case where the input signal is a sine wave, and FIG. 22(*b*) illustrates a case where the input signal is a music signal. As can be seen from FIGS. 22(*a*) and 22(*b*), the amplification unit 59 amplifies the signal level of the overtone signal.

FIGS. 23(*a*) and 23(*c*) are graphs illustrating, in linear manner, an amplification value in the amplification unit 59 (amplification initial value+correction amount), and FIGS. 23(*b*) and 23(*d*) are graphs illustrating in decibel manner. FIGS. 23(*a*) and 23(*b*) illustrate a case where the input signal is a sine wave, and FIGS. 23(*c*) and 23(*d*) illustrate a case where the input signal is a music signal. As shown in FIGS. 23(*b*) and 23(*d*) in decibel manner, with respect to the amplification initial value, 61 [dB], of the first embodiment, the amplification value varies within a range of a value to which the correction amount (0 [dB] to 8 [dB]) has been added, or within the range between 61 [dB] to 69 [dB].

Figure 24A:
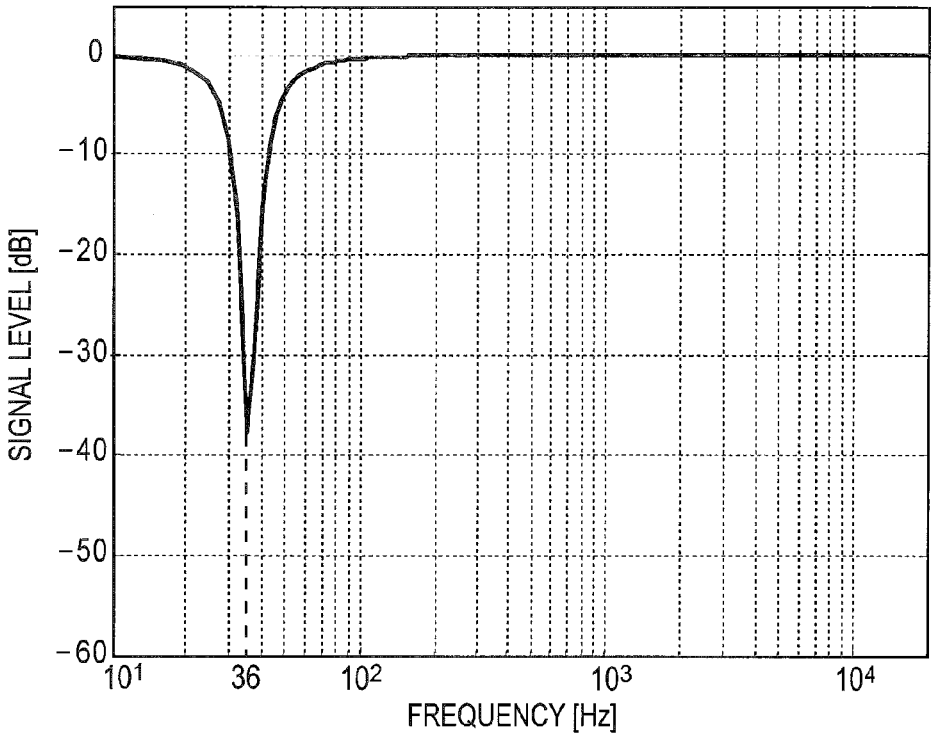
FIG. 24(*a*) is a graph illustrating filter characteristics of a peaking filter used in a second filter unit.
Figure 24B:
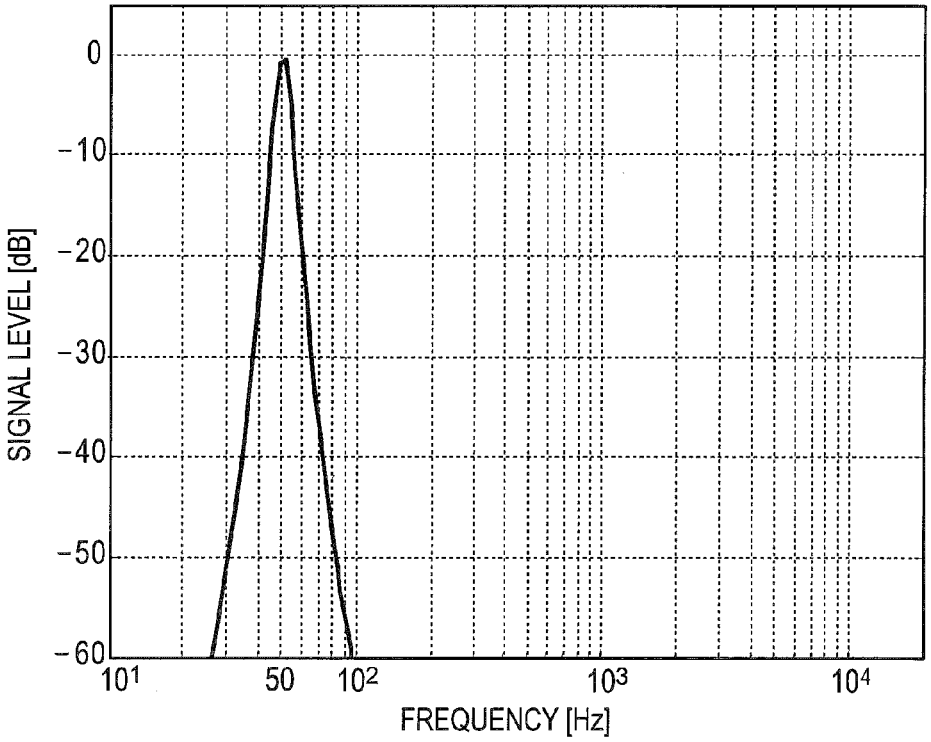
Figure 25A:
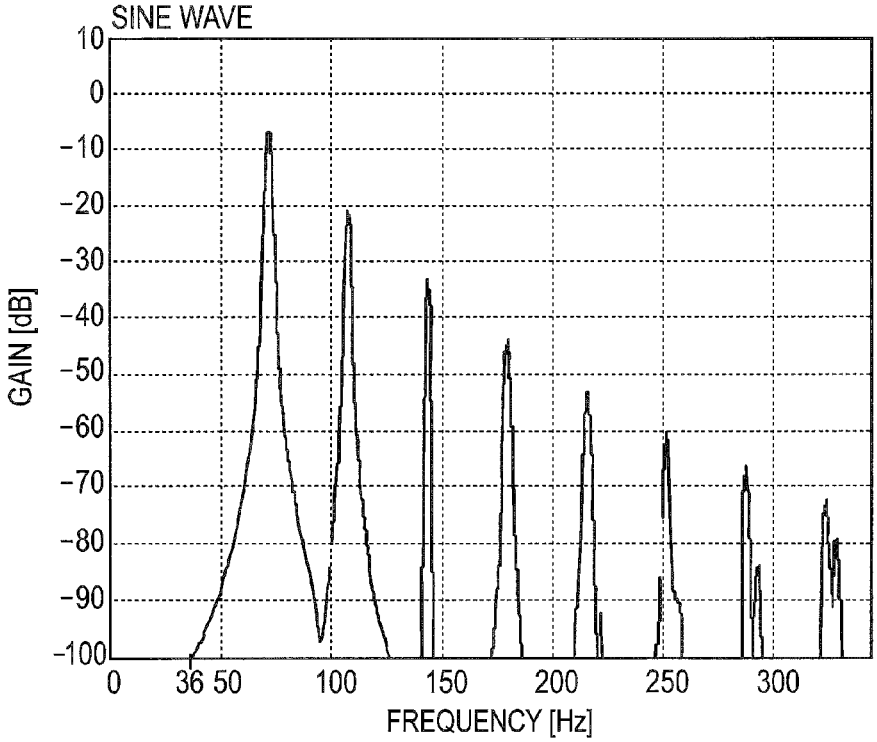
FIGS. 25(*a*) and 25(*b*) are graphs illustrating frequency characteristics of an overtone signal that has undergone a filter process by the second filter unit.
Figure 25B:
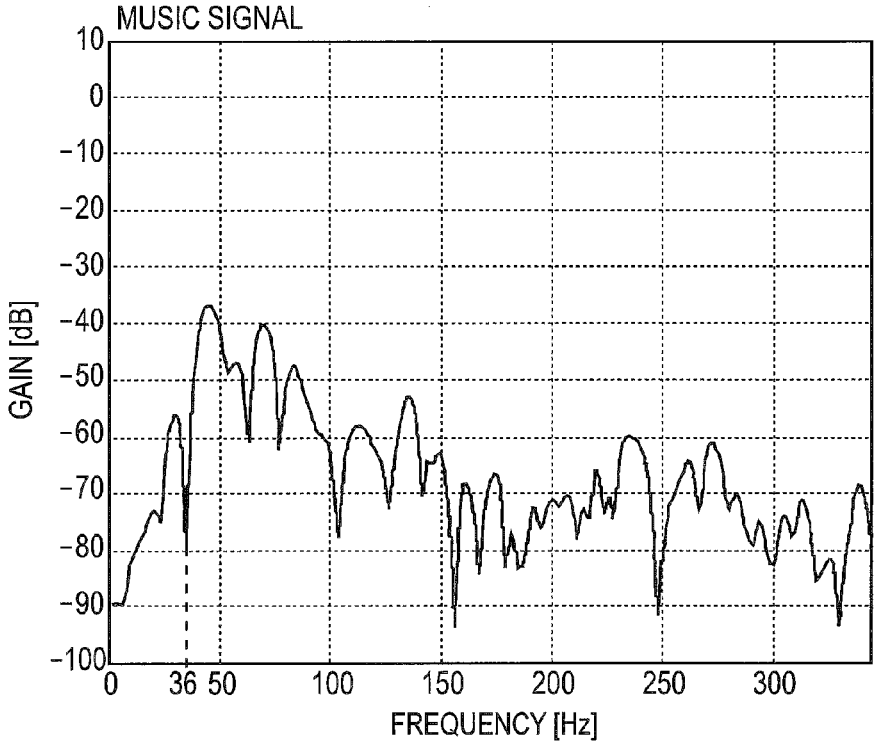

As can be seen from FIGS. 22(*a*) and 22(*b*), the amplified overtone signal contains a signal output at 36 [Hz] or at the specific frequency. Accordingly, if the amplified overtone signal is added to the correction signal without being changed, the signal level of the 36 [Hz] where distortion occurs is enhanced, too. As a result, distortion occurs in the final output signal. Accordingly, in order to block the outputting of the overtone signal of the specific frequency, the second filter unit 62 uses a filter having inverse characteristics of a peaking filter of the specific frequency that is used by the first filter unit 10 to suppress the outputting of the signal of the specific frequency, FIG. 24(*a*) illustrates filter characteristics of inverse characteristics of a peaking filter used by the second filter unit 62. This filter is applied to the amplified overtone signal, thereby making it possible to generate an overtone signal whose outputting is suppressed at the specific frequency, 36 [Hz]. FIGS. 25(*a*) and 25(*b*) show frequency characteristics of an overtone signal that has undergone a filter process by the second filter unit 62. FIG. 25(*a*) illustrates a case where the input signal is a sine wave, and FIG. 25(*b*) illustrates a case where the input signal is a music signal. As can be seen from the frequency characteristics of the overtone signal shown in FIGS. 25(*a*) and 25(*b*), compared with the amplified overtone signal shown in FIGS. 22(*a*) and 22(*b*), the signal outputting of the overtone signal that has undergone the filter process is suppressed at 36 [Hz].

In this manner, the signal outputting at the specific frequency is suppressed, and the overtone signal is generated with respect to the specific frequency. As a result, a complement signal is generated. In the first addition unit 300, to the correction signal whose signal level is suppressed at the specific frequency, the complement signal that is an overtone whose signal outputting is suppressed at the specific frequency is added. As a result, the distortion sound correction low-frequency range complement device 1 outputs, as an output signal, a signal whose signal level has been reduced from the signal level of the specific frequency to a level at which distortion does not occur in a speaker (or a signal whose distortion has been corrected) and whose low-frequency range has been complemented by the overtone signal to allow a listener to recognize the sound quality of the specific frequency in terms of audibility.

In this manner, in the output signal, during playback through a speaker, the generation of distorted sound or abnormal noise can be suppressed by the correction. As for a band (low-frequency range) that has been suppressed by the correction in such a way that a listener might feel thin in terms of audibility, the band can be sufficiently complemented by generating an overtone of another band that does not affect the specific frequency. Moreover, the distortion sound correction low-frequency range complement device 1 can perform the distortion correction process and the low-frequency range complement process in accordance with the input signal from the sound source. Therefore, it is possible to generate a complement signal corresponding to a distortion level and to enable a listener to recognize sound without a sense of discomfort.

Second Embodiment

What has been described in the first embodiment is a method of reducing the signal level of the input signal from the sound source at a frequency (specific frequency) where distortion occurs and generating an overtone signal with respect to the specific frequency, thereby suppressing distortion from a speaker and enabling a listener to recognize the suppressed sound of the specific frequency through the overtone signal in terms of audibility. However, the method for complementing the suppressed sound of the specific frequency is not necessarily limited to the overtone signal. A method of generating a new overtone signal by adding a ½ overtone signal to the overtone signal may also be available. According to the second embodiment, which is described below, the overtone signal and the ½ overtone signal are used to complement in terms of audibility. The same structural and functional portions of a distortion sound correction low-frequency range complement device of the second embodiment as those of the first embodiment will be described with the same reference symbols, and those structural and functional portions will not be described in detail.

Figure 26A:
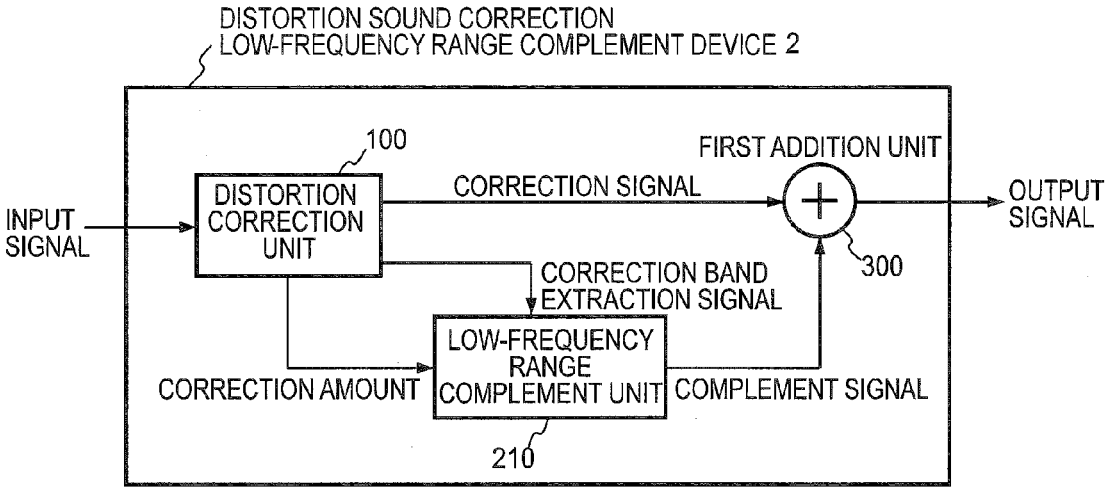
FIG. 26(*a*) is a block diagram illustrating the schematic configuration of a distortion sound correction low-frequency range complement device according to the second embodiment.
Figure 26B:
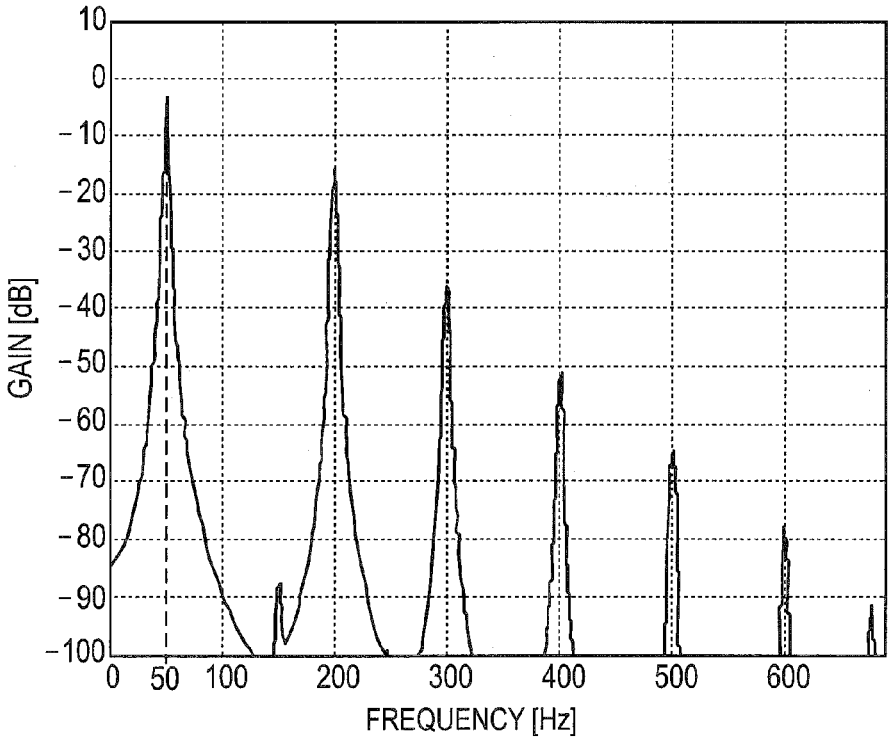

FIG. 26(*a*) is a block diagram illustrating the schematic configuration of a distortion sound correction low-frequency range complement device according to the second embodiment. The distortion sound correction low-frequency range complement device 2 includes a distortion correction unit 100, a low-frequency range complement unit 210, and a first addition unit 300. The distortion correction unit 100 and the first addition unit 300 have the same structures and functions as the distortion correction unit 100 and first addition unit 300 described in the first embodiment.

Figure 27:
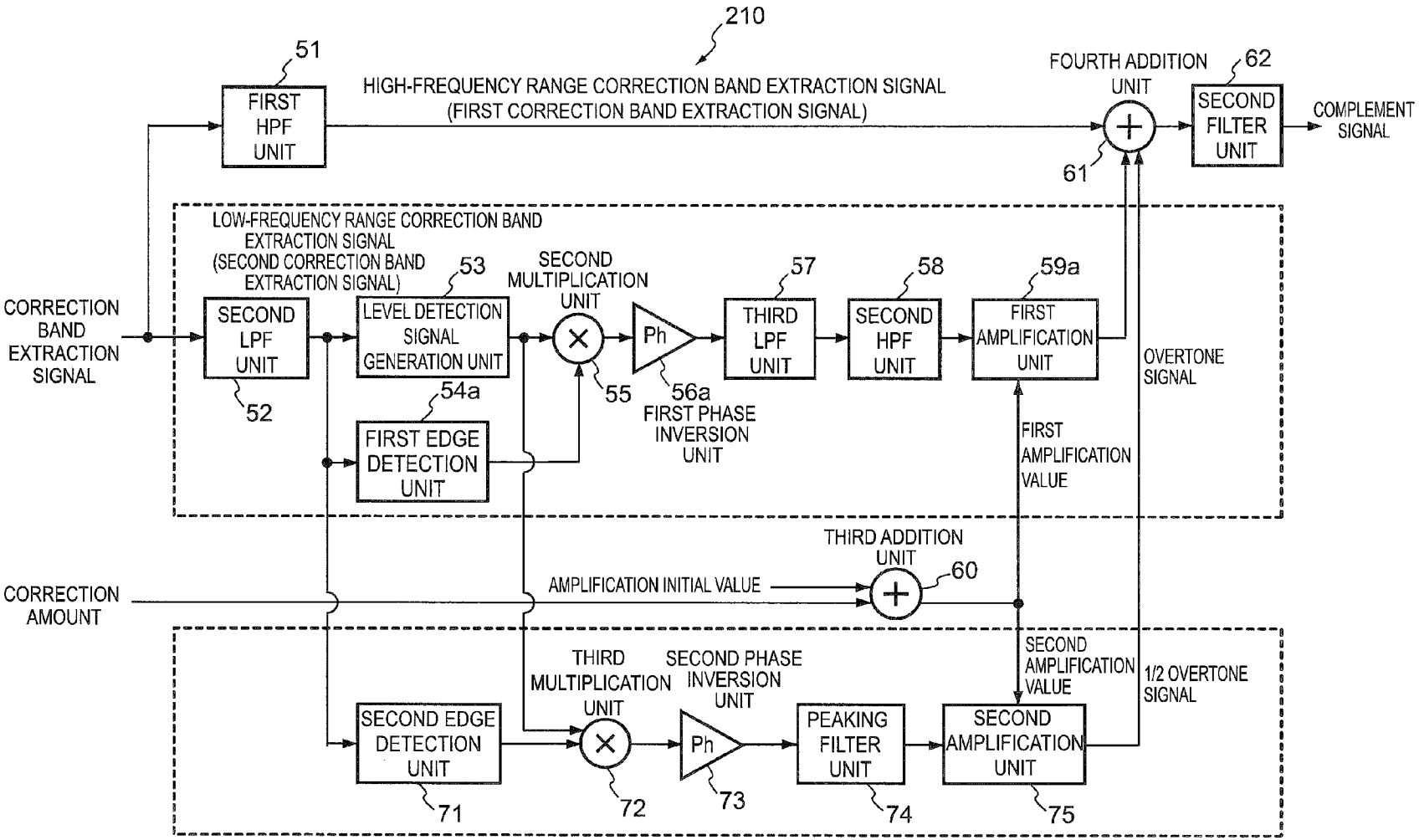
FIG. 27 is a block diagram illustrating the schematic configuration of a low-frequency range complement unit according to the second embodiment.

FIG. 27 is a block diagram illustrating the schematic configuration of the low-frequency range complement unit 210. The low-frequency range complement unit 210 includes a first HPF unit 51, a second LPF unit 52, a level detection signal generation unit 53, a first edge detection unit 54*a*, a second multiplication unit (first weighting unit) 55, a first phase inversion unit 56*a*, a third LPF unit (low-pass filter unit) 57, a second HPF unit (high-pass filter unit) 58, a first amplification unit 59*a*, a third addition unit 60, a fourth addition unit (addition unit) 61, a second filter unit 62, a second edge detection unit 71, a third multiplication unit 72 (second weighting unit), a second phase inversion unit 73, a peaking filter unit 74, and a second amplification unit 75.

The first HPF unit 51, second LPF unit 52, level detection signal generation unit 53, second multiplication unit 55, third LPF unit 57, second HPF unit 58, third addition unit 60, fourth addition unit 61, and second filter unit 62 of the low-frequency range complement unit 210 are identical to the functional units of the low-frequency range complement unit 200 of the distortion sound correction low-frequency range complement device 1 of the first embodiment. The first edge detection unit 54*a* corresponds to the edge detection unit 54 of the first embodiment. The first phase inversion unit 56*a* corresponds to the phase inversion unit 56 of the first embodiment. The first amplification unit 59*a* corresponds to the amplification unit 59 of the first embodiment. These functional units have been described above and therefore will not be described in detail. Furthermore, the third multiplication unit 72 has the same structure and function as the second multiplication unit 55. The second phase inversion unit 73 and the second amplification unit 75 have the same structures and functions as the phase inversion unit 56 and the amplification unit 59. Therefore, these components will not be described. The first edge detection unit 54*a* of the second embodiment corresponds to a first edge detection unit in claims. The first phase inversion unit 56*a* corresponds to a first phase inversion unit in claims. The first amplification unit 59*a* corresponds to a first amplification unit in claims.

The second edge detection unit 71 detects a position (timing) where the value of a signal turns positive after being negative, in the low-frequency range correction band extraction signal input. The second edge detection unit 71 generates, at the detected position (timing), an impulse train that is a signal with every other pulse being removed. In this case, the amplitude of the impulse train is set to 1, and the generated impulse train is referred to as a ½ overtone signal. That is, the ½ overtone signal is a signal that is generated by removing every other pulse from the impulse train (overtone) that is output from the first edge detection unit 54*a*. By removing every other pulse, the period of the ½ overtone signal is twice as long as that of the overtone signal, with half the frequency.

Figure 28A:
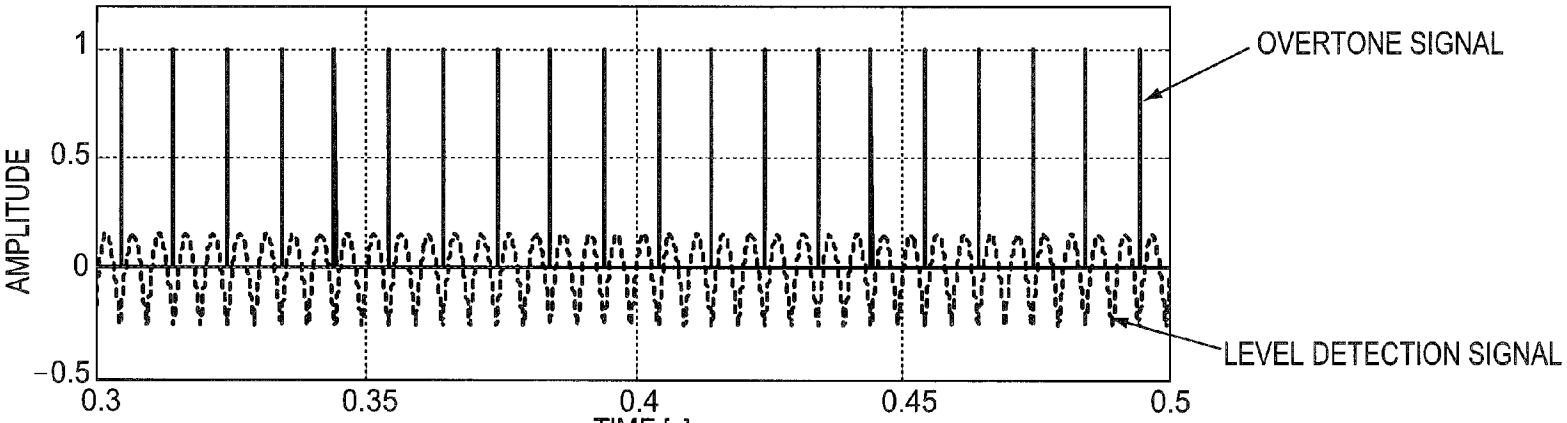
FIG. 28(*a*) is a graph illustrating a level detection signal that is output from the level detection signal generation unit, and an overtone signal.
Figure 28B:
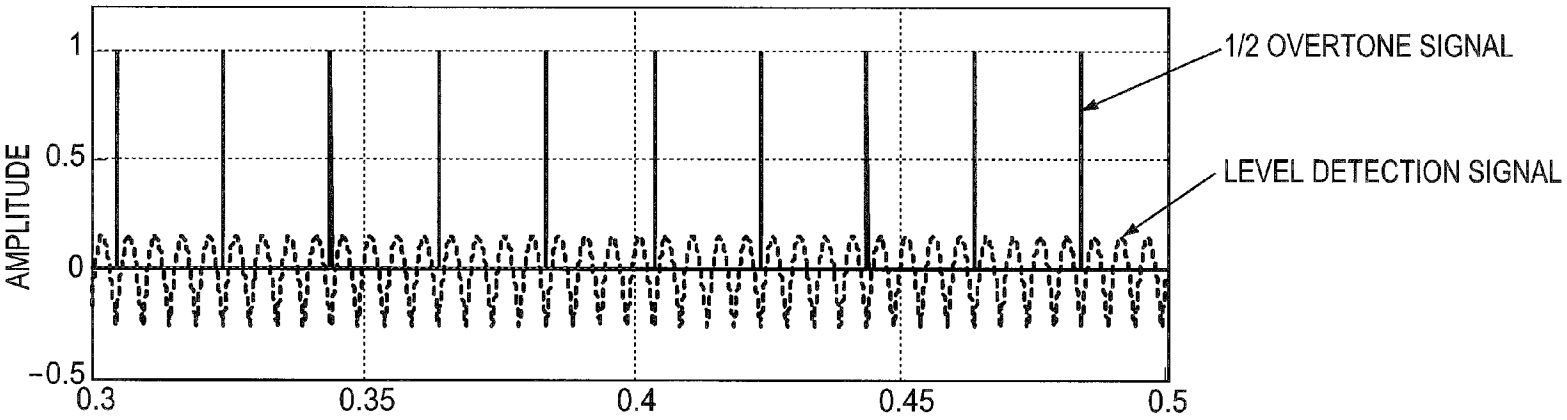

FIG. 28(*a*) is a graph illustrating a level detection signal that is output from the level detection signal generation unit 53, and an overtone signal. FIG. 28(*b*) is a graph illustrating a level detection signal that is output from the level detection signal generation unit 53, and a ½ overtone signal. As can be seen from FIGS. 28(*a*) and 28(*b*), as opposed to the impulse train of the overtone signal, every other pulse is being removed in the impulse train of the ½ overtone signal.

The peaking filter unit 74 is a filter that limits the band of the generated ½ overtone signal. FIG. 24(*b*) illustrates one example of filter characteristics of the peaking filter unit 74. According to the second embodiment, as a sound source signal, a 100 [Hz] sine wave is used as one example. Each functional unit of the distortion correction unit 100 of the distortion sound correction low-frequency range complement device 2 is set based on Table 3 shown in FIG. 29(*a*). Each functional unit of the low-frequency range complement unit 210 is set based on Table 4 shown in FIG. 29(*b*). Furthermore, according to the second embodiment, the specific frequency is set to 100 [Hz]. Accordingly, in the peaking filter unit 74, as shown in FIG. 24(*b*), the center frequency (cut-off frequency) is set to 50 [Hz], or half the specific frequency, which is 100 [Hz].

Figure 30A:
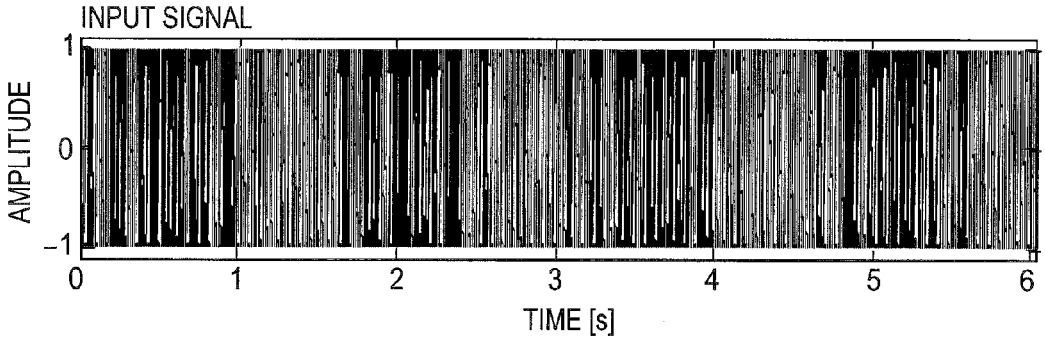
FIG. 30(*a*) is a graph illustrating the input signal of the distortion sound correction low-frequency range complement device according to the second embodiment.
Figure 30B:
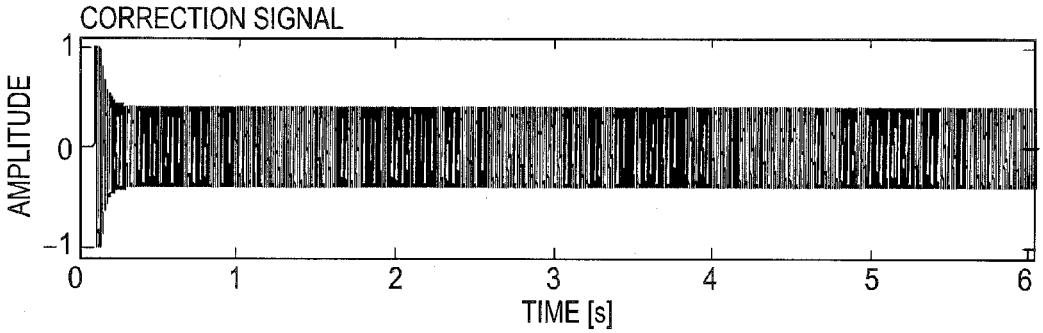
Figure 30C:
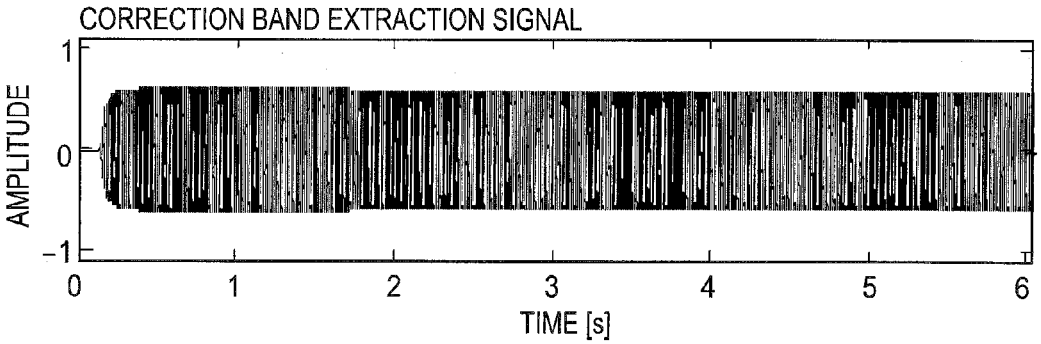

FIGS. 30(*a*) to 30(*c*) illustrate an input signal in the distortion sound correction low-frequency range complement device 2 (FIG. 30(*a*)); a correction signal (FIG. 30(*b*)); and a correction band extraction signal (FIG. 30(*c*)). In the case of the second embodiment, the specific signal level is set to −8 [dB]. FIGS. 30(*a*) to 30(*c*) illustrate a case where the amplitude of the input signal is 1, and a maximum amplitude value of the correction signal is about 0.4. The diagrams illustrate the correction signal being attenuated by an amount equivalent to the outputting of a signal corresponding to a correction amount of −8 [dB].

The second amplification unit 75 carries out an amplification process on the ½ overtone signal whose band has been limited by the peaking filter unit 74. The second amplification unit 75 carries out the same amplification process as the first amplification unit 59*a*; the amplification is carried out based on a value that is obtained by adding, to the amplification initial value, a correction amount that is input from the distortion correction unit 100. As shown in Table 4 of FIG. 29(*b*), the amplification initial value of the first amplification unit 59*a* is different from the amplification initial value of the second amplification unit 75.

Figure 31A:
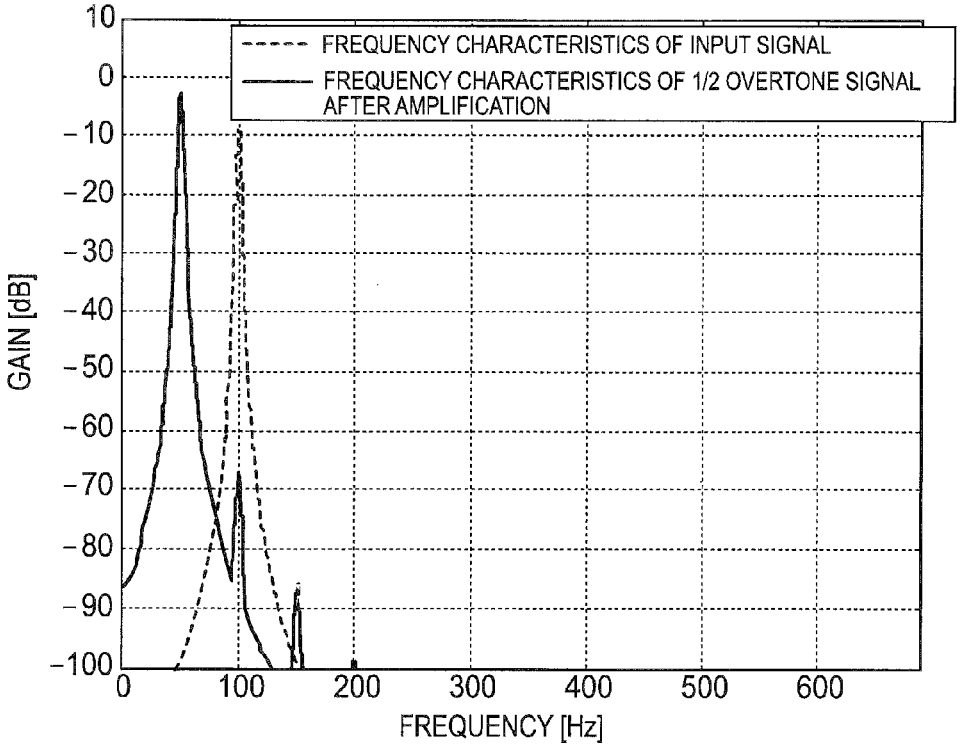
FIG. 31(*a*) is a graph illustrating frequency characteristics of a ½ overtone signal that is amplified by a second amplification unit based on a second amplification value, and frequency characteristics of the input signal.
Figure 31B:
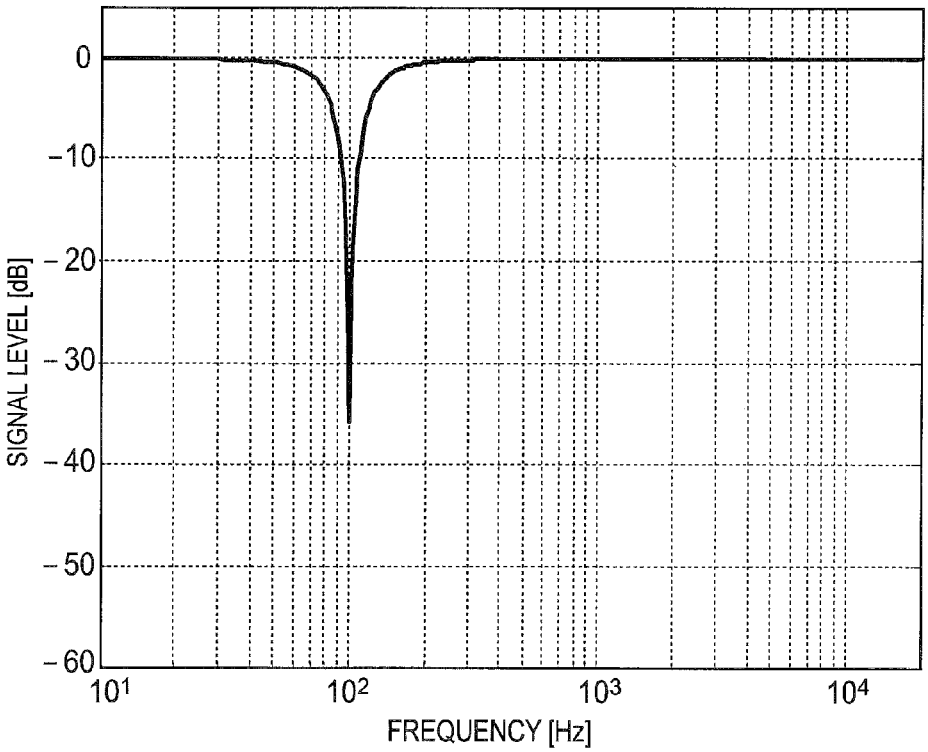

In the case of the second embodiment, the specific frequency is 100 [Hz]. Therefore, a frequency of a low-frequency range where complementing is carried out with the overtone signal is 100 [Hz], too. Accordingly, the amplification initial value of the first amplification unit 59*a*, which amplifies the overtone signal is: $20 \log_{10}(100\ [\mathrm{Hz}]/44{,}100\ [\mathrm{Hz}])=-52.8888$ [dB]. In this manner, the amplification initial value is set to about 53 [dB]. A frequency of a low-frequency range where complementing is carried out with the ½ overtone signal is 50 [Hz] or ½ of the 100 [Hz]. Accordingly, the amplification initial value of the second amplification unit 75, which amplifies the ½ overtone signal, is: $20 \log_{10}(50\ [\mathrm{Hz}]/44{,}100\ [\mathrm{Hz}])=-58.9094$ [dB]. In this manner, the amplification initial value is set to about 59 [dB]. The third addition unit 60 adds the correction amount input from the distortion correction unit 100 to the value 53 [dB], and outputs the resultant value to the first amplification unit 59*a* as an amplification value (first amplification value) for the first amplification unit 59*a*; the third addition unit 60 adds the correction amount input from the distortion correction unit 100 to the value 59 [dB], and outputs the resultant value to the second amplification unit 75 as an amplification value (second amplification value) for the second amplification unit 75. FIG. 31(*a*) illustrates frequency characteristics of a ½ overtone signal that is amplified by the second amplification unit 75 based on the second amplification value, and frequency characteristics of an input signal (or 100 [Hz] sine wave).

The second filter unit 62 outputs, as complement signal, an overtone signal and ½ overtone signal that are generated by removing the specific frequency (100 [Hz]) from the signal added in the fourth addition unit 61. The second filter unit 62 is a filter having inverse characteristics of the peaking filter of the first filter unit 10. The second filter unit 62 is a filter that allows a signal other than those of the specific frequency to pass therethrough. FIG. 31(*b*) illustrates filter characteristics of the second filter unit 62 according to the second embodiment. FIG. 26(*b*) illustrates a complement signal that has passed through the second filter unit 62. As can be seen from FIG. 26(*b*), in the complement signal, the outputting of signal is suppressed at around 100 [Hz] (which is the specific frequency of the second embodiment). The 50 [Hz] output signal is the ½ overtone signal; the output signal shown at 200 [Hz], 300 [Hz], 400 [Hz], . . . is the overtone signal.

In this manner, the output signal is generated by adding the complement signal generated by the low-frequency range complement unit 210 and the correction signal generated by the distortion correction unit 100, and the output signal is output through a speaker. Therefore, the signal level of the specific frequency (which is 100 [Hz] in the case of the second embodiment) at which distortion occurs in a speaker is reduced to a level where no distortion occurs. Moreover, the reduced sound of the specific frequency is complemented by the ½ overtone signal and the overtone signal. Thus, as for the generated output signal, it is possible to output high-quality sound by preventing a listener from recognizing deterioration in the sound quality in terms of audibility. Furthermore, since the ½ overtone signal is added to the output signal, the quality of the output sound is better than when only the overtone signal is added.

[Setting of Correction Band]

In the above-described first and second embodiments, what is described is a method of recognizing a frequency at which distortion could occur in a speaker as a specific frequency and suppressing the outputting of signal at the specific frequency and complementing the sound.

Figure 32A:
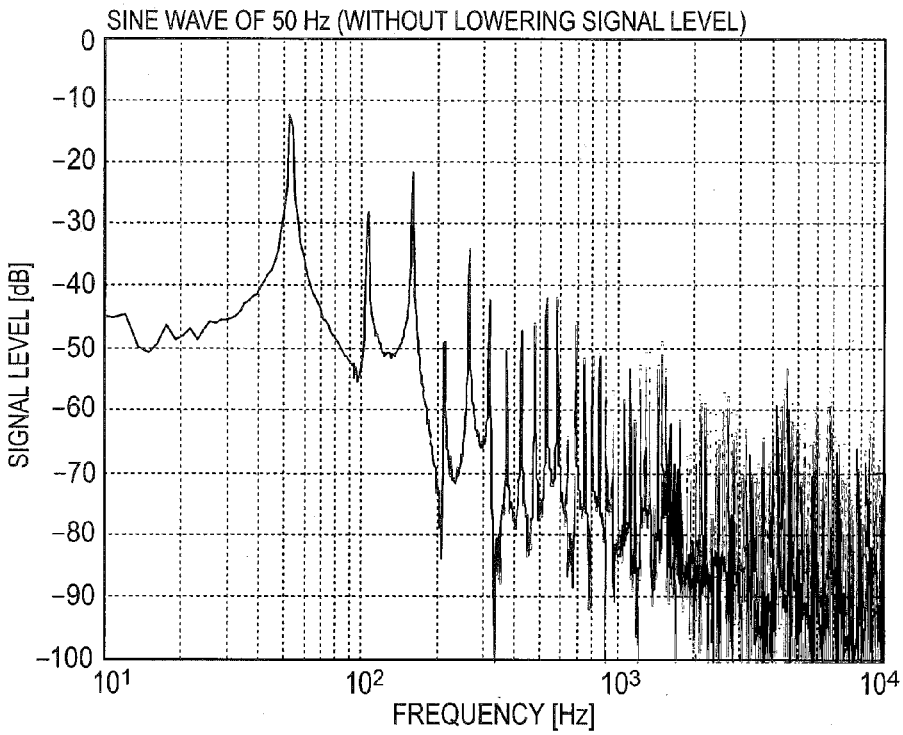
FIGS. 32(*a*) and 32(*b*) are graphs illustrating frequency characteristics or results of collecting sound output from a speaker by using a microphone and without performing a distortion correction process or a low-frequency range complement process, when 50 [Hz] and 60 [Hz] sine waves are used as the input signal.
Figure 32B:
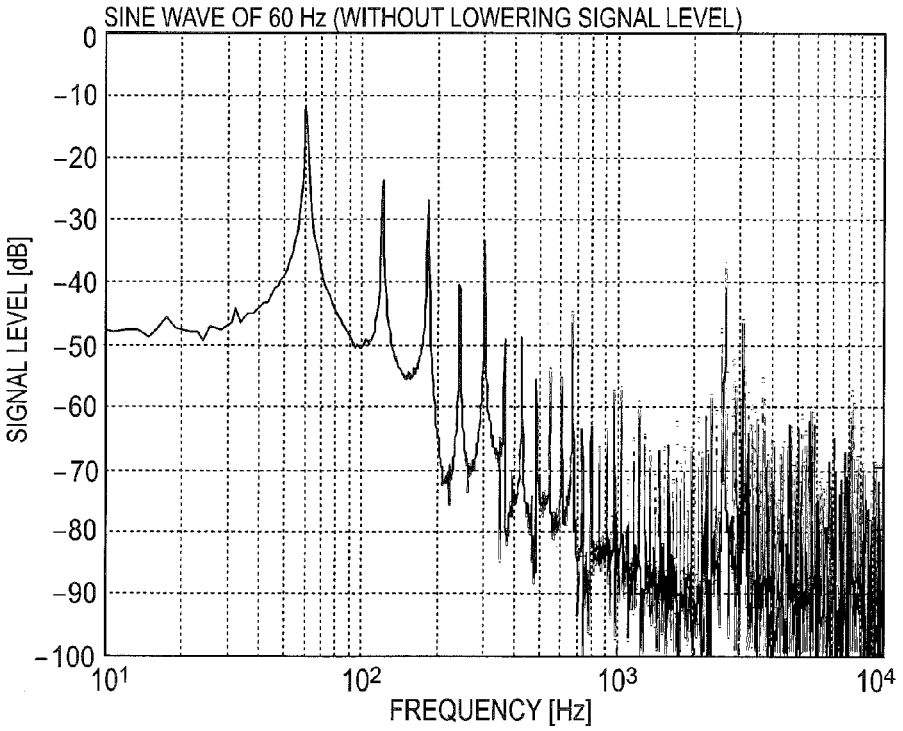

The specific frequency is in a band where distortion could occur in a speaker. Therefore, the band needs to be changed depending on the speaker. Moreover, there is a possibility that vibration of the speaker provided in the vehicle interior could be transmitted to speaker's peripheral parts and vehicle-interior parts, and abnormal noise could occur due to resonance. FIGS. 32(*a*) and 32(*b*) illustrate frequency characteristics or results of collecting sound output from a speaker by using a microphone and without performing a distortion correction process or a low-frequency range complement process, when 50 [Hz] and 60 [Hz] sine waves are used as an input signal. As shown in FIGS. 32(*a*) and 32(*b*), it is clear that, since abnormal noise is generated by the resonance between the vibration of the speaker and peripheral portions, a signal of strong component is output in the middle- to high-frequency range.

Figure 33A:
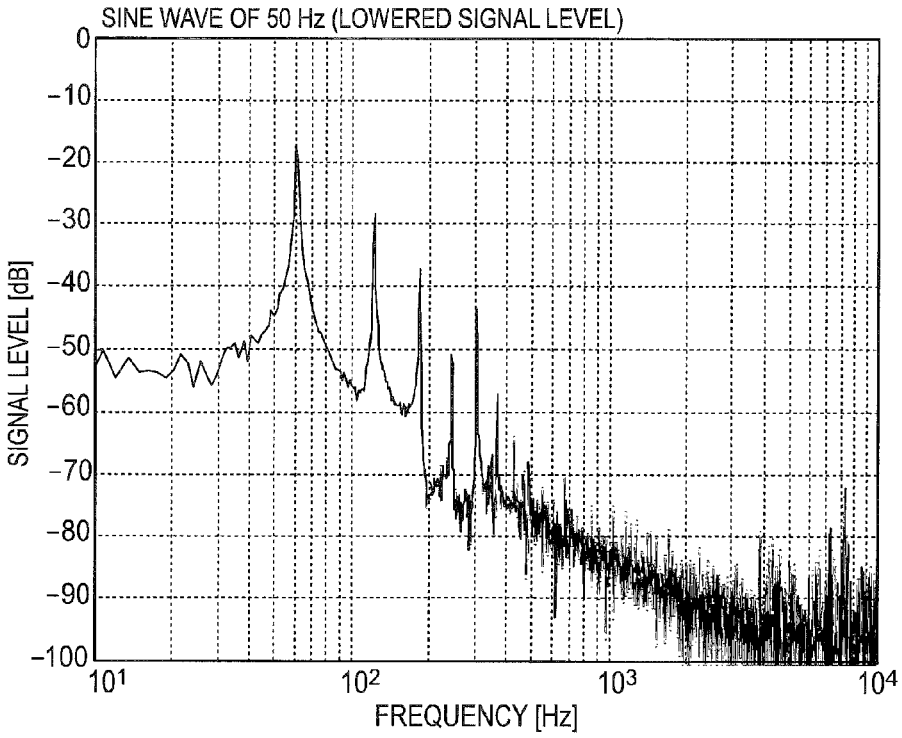
FIGS. 33(*a*) and 33(*b*) are graphs illustrating frequency characteristics when a signal level of the input signal of FIGS. 32(*a*) and 32(*b*) is lowered.
Figure 33B:
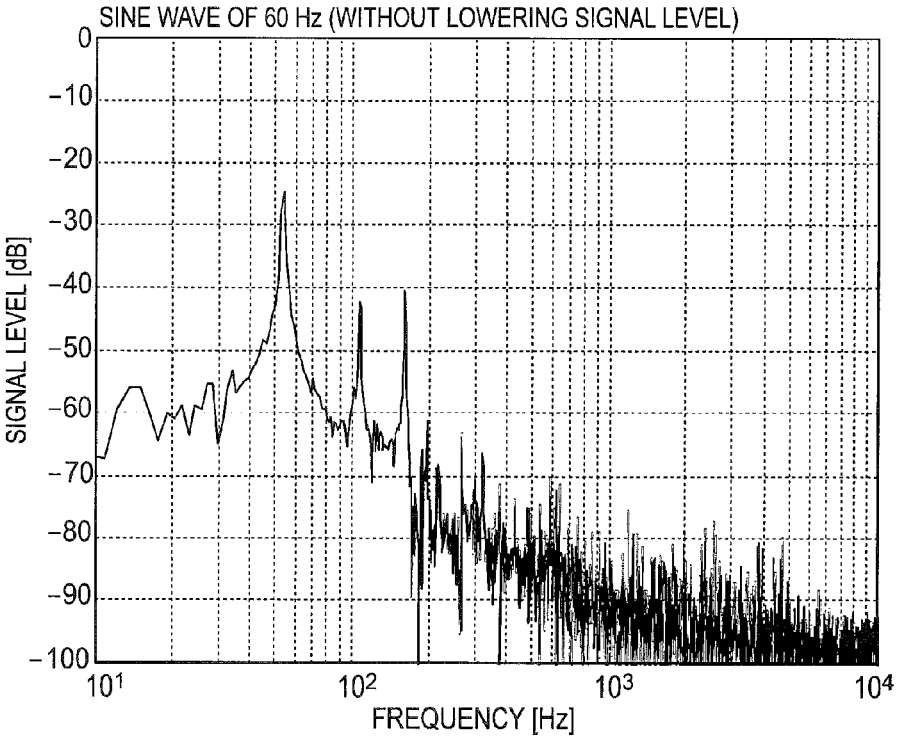

FIGS. 33(*a*) and 33(*b*) illustrate frequency characteristics when a signal level of the input signal of FIGS. 32(*a*) and 32(*b*) is lowered. As can be seen from FIGS. 33(*a*) and 33(*b*), by lowering the signal level of the input signal, it is possible to suppress the occurrence of abnormal noise. In particular, in the case of FIGS. 33(*a*) and 33(*b*), the abnormal noise in the middle- to high-frequency range, where resonance occurs in the case of FIGS. 32(*a*) and 32(*b*), is suppressed in an effective manner. As described above, the abnormal noise and the distorted sound can be caused not only by characteristics of the speaker but also by the structure of the vehicle and the like. Therefore, the distortion correction process and the low-frequency range complement process need to be performed by calculating a band where the distorted sound and the abnormal noise occur.

Figure 34:
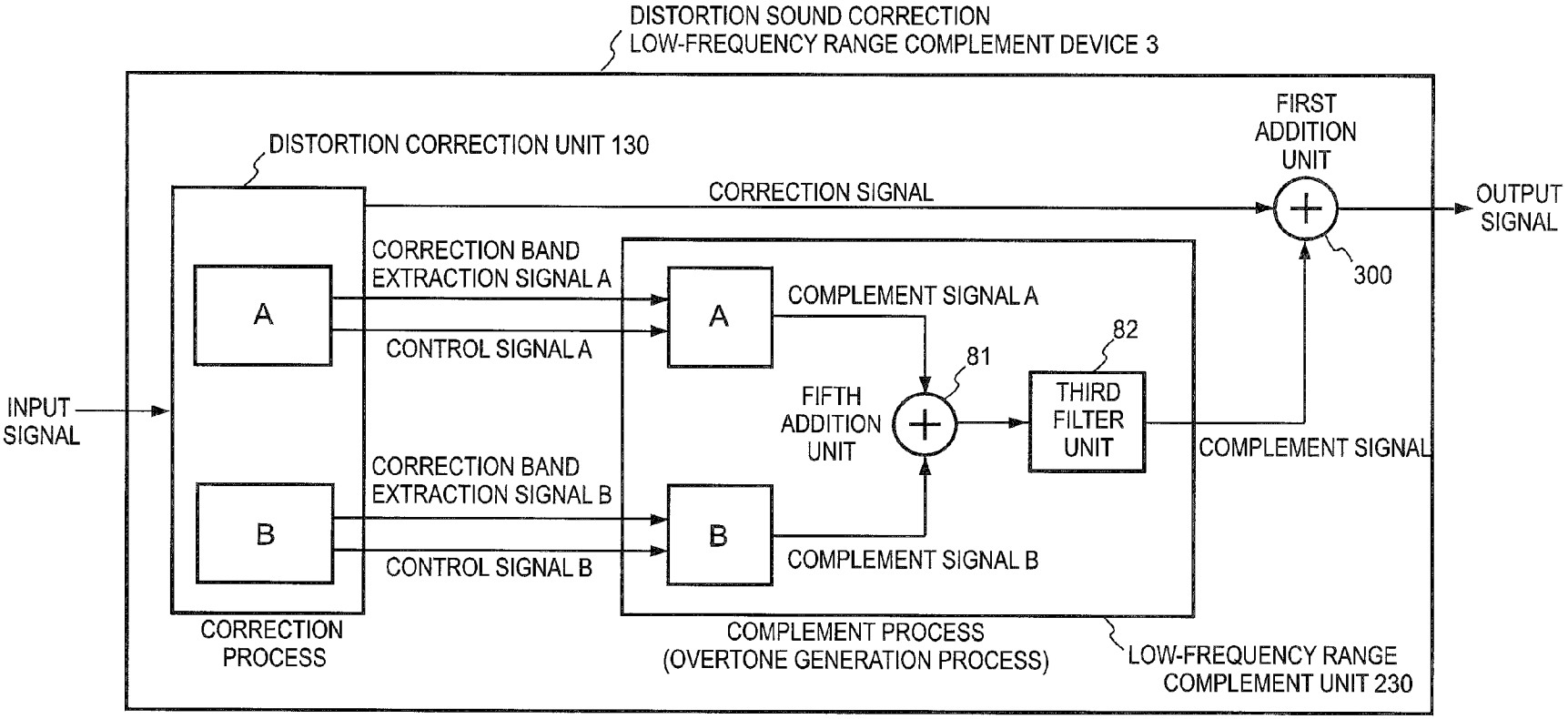
FIG. 34 is a block diagram illustrating the schematic configuration of a distortion sound correction low-frequency range complement device that carries out a distortion correction process and a low-frequency range complement process for two specific frequencies.

FIG. 34 is a block diagram illustrating, as one example, the schematic configuration of a distortion sound correction low-frequency range complement device 3 that carries out a distortion correction process and a low-frequency range complement process for two specific frequencies. The distortion sound correction low-frequency range complement device 3 includes a distortion correction unit 130, a low-frequency range complement unit 230, and a first addition unit 300. When abnormal noise or distorted sound occurs in two frequency bands, the occurrence of the distorted sound or abnormal noise is suppressed by suppressing the signal level of each specific frequency. Furthermore, the quality of sound needs to be complemented in terms of audibility by using an overtone signal that is generated with respect to each specific frequency, and the like. Accordingly, the distortion correction unit 130 needs to have a function unit that suppresses the signal level of a specific frequency in accordance with each band. The low-frequency range complement unit 230 needs to generate an overtone signal based on each band.

In FIG. 34, functional blocks [A] and [B], shown inside the distortion correction unit 130, represent functional blocks that suppress the outputting of signal in accordance with corresponding specific frequencies. The "[A]" represents a functional unit that serves as a distortion correction unit that performs a distortion correction process for one specific frequency. The "[B]" represents a functional unit that serves as a distortion correction unit that performs a distortion correction process for the other specific frequency. A functional block [A] shown inside the low-frequency range complement unit 230 represents a functional unit that generates an overtone signal based on one specific frequency; a functional block [B] represents a functional unit that generates an overtone signal based on the other specific frequency.

Even if the correction and complement process is performed in two bands, it is desirable that a specific frequency at which complementing is carried out be in a low-frequency band. If the specific frequency is set in the band that is greater than or equal to 150 [Hz] to 200 [Hz], abnormal noise could occur due to an overtone signal which becomes a complement signal. For example, if the specific frequency is 500 [Hz], the overtone that is generated based on the 500 [Hz] is 1 [kHz], 1.5 [kHz], 2 [kHz], . . . . In this manner, a high-frequency range overtone is generated. Therefore, abnormal noise could occur in the output signal that is output.

In the correction process by the distortion correction unit 130, as indicated by [A] and [B], two bands are required. Therefore, the signals required for the complement process (overtone generation process) by the low-frequency range complement unit 230 are four signals, which consist of two correction band extraction signals and two control signals; correction band extraction signal A, correction band extraction signal B, control signal A, and control signal B in the distortion correction units 130 of [A] and [B].

Furthermore, the low-frequency range complement unit 230 generates overtone signals for two bands. Accordingly, two complement signals (complement signal A and complement signal B) are generated. Therefore, in the distortion sound correction low-frequency range complement device 3, a fifth addition unit 81 is provided to add the two complement signals. A signal that the fifth addition unit 81 generates by adding the complement signals A and B contains a signal of each specific frequency. If the signal is added by the first addition unit 300 to the correction signal, the output signal may be distorted. The distortion sound correction low-frequency range complement device 3 therefore includes a third filter unit 82. The third filter unit 82 performs a filter process to remove components of each specific frequency from the signal that is generated by adding the complement signals A and B. That is, the signal outputs of the two frequency bands, or the signal outputs of the frequency band that is to be processed by [A] and of the frequency band that is to be processed by [B], are removed.

The third filter unit 82 may be placed on an upstream side of the fifth addition unit 81. In this case, a filter unit that removes the signal output of the specific frequency of the complement signal A, and a filter unit that removes the signal output of the specific frequency of the complement signal B need to be separately placed to carry out the filter process. In this case, the process is duplicated, and the processing load increases. In terms of preventing the duplicated process and lowering the processing load, it is preferred that the third filter unit 82 be placed on a downstream side of the fifth addition unit 81.

If the third filter unit 82 is placed on the upstream side of the fifth addition unit 81, a signal of a specific frequency that should be removed may be left after the addition process of the fifth addition unit 81 depending on the relation between the specific frequency of [A] and the specific frequency of [B] even as a filter process that removes the signal output of the specific frequency of the complement signal A and a filter process that removes the signal output of the specific frequency of the complement signal B are separately carried out.

For example, suppose that the specific frequency of [A] is around 40 [Hz], and that the specific frequency of [B] is around 80 [Hz]. In this case, the frequencies of the overtones of the complement signal A are 40 [Hz], 80 [Hz], 120 [Hz], . . . ; the frequencies of the overtones of the complement signal B are 80 [Hz], 160 [Hz], 240 [Hz], . . . . Meanwhile, if one the third filter unit 82 removes the signal output of 40 [Hz], which is the specific frequency of the complement signal A, and the other the third filter unit 82 removes the signal output of 80 [Hz], which is the specific frequency of the complement signal B, the signal output of 40 [Hz] in the complement signal A and the signal output of 80 [Hz] in the complement signal B are removed. However, the complement signal A still contains the signal output of 80 [Hz], which is the specific frequency of the complement signal B. In such a case, if the signals are combined by the fifth addition unit 81, the combined signal contains the signal output of 80 [Hz], which is the specific frequency of the complement signal B.

Accordingly, if the signal (complement signal) that contains the signal output of 80 [Hz] is added by the first addition unit 300 to the correction signal, distortion may occur based on the signal output of 80 [Hz] when the output signal is output via a speaker. In order to carry out a suppression process (correction process) on the signal level at the specific frequency in an effective and simple manner, it is desirable that the third filter unit 82 be placed on the downstream side of the fifth addition unit 81.

Although the distortion sound correction complement device of the present invention has been described above in accordance with examples shown in the first and second embodiments, the distortion sound correction complement device of the present invention is not limited to the first and second embodiments described above. It is apparent that a person skilled in the art can give thought to various alternative implementations and modified implementations within the scope of the claims and those implementations naturally fall within the scope of the present invention.

For example, what is described in the first embodiment is the case where the frequency (specific frequency) at which corrections are made is 36 [Hz]. What is described in the second embodiment is the case where the specific frequency is 100 [Hz]. However, the specific frequency is determined based on a band in which distortion of a speaker occurs. Therefore, the specific frequency needs to be changed depending on the speaker through which the output signal is output.

Even if the specific frequency is determined based on a band in which distortion of a speaker occurs, how much the gain should be suppressed at the specific frequency needs to be determined based on the magnitude of the distortion and the like. According to the first and second embodiments, the gain (specific signal level) that is to be reduced is set to −8 [dB]. If the distortion should be significantly reduced, the setting value of the gain is set in such a way as to be large in the negative direction, and if the sound should be thick in quality while still being slightly distorted, it is desirable that the gain be set in such a way that the setting value is smaller in the negative direction.

Furthermore, the maximum value detection value of the maximum value detection unit 21 and the maximum value hold value of the maximum value hold unit 22, which are set in the signal level detection unit 20 of the distortion correction unit 100, are not limited to the values shown in FIGS. 7(*a*) and 29(*a*). The setting values can be adjusted depending on the purpose of the level detection. However, if the values are set too large, the values may not be able to deal with level fluctuations of the signal. Therefore, it is desirable that the values be set in such a way as to deal with the level fluctuations. If the setting values are too small, the values would put too great a burden on the calculation process in the signal level detection unit 20. Therefore, the values need to be appropriately adjusted depending on the calculation processing capacity of the device.

The attack release filter of the attack release filter unit 31 of the correction gain calculation unit 30 is a parameter for controlling the correction amount (degree of correction) in accordance with the level fluctuations of the signal. If corrections are gradually made, it is desirable that the attack time or the release time, or both, be set long. If corrections are made quickly (or if corrections are made swiftly), it is desirable that the attack time or the release time, or both, be set short.

For example, if the input signal from the sound source is a music signal, it is desirable that the attack time be set short, and that the release time be set long. If the fluctuation in the signal level of the input signal at the frequency (specific frequency) at which corrections are made is large, and if the signal level of the input signal is greater than or equal to the gain that is set to make the corrections (or the gain of the signal level where suppression is carried out at the specific frequency, which is −8 [dB] according to the first and second embodiments), the attack time is set short. Therefore, it is possible to quickly address the signal level fluctuation. When the release time is set long, it is possible to gradually control for the signal level fluctuation. Therefore, it is possible to control in such a way as to enable a listener not to feel any sense of discomfort in terms of audibility.

As described above in connection with the low-frequency range complement units 200 and 210, the cut-off frequency of the first HPF unit 51 and second LPF unit 52 is set to the value of the center frequency set in the first filter unit 10 of the distortion correction unit 100, or the value of the specific frequency. The first HPF unit 51 and the second LPF unit 52 extract a signal in order to generate an overtone. Accordingly, in order to more effectively develop the sound quality of the specific frequency that a listener can feel in terms of audibility with the help of the overtone signal, the cut-off frequency of the first HPF unit 51 and second LPF unit 52 needs to be set to the value of the specific frequency. For example, in the case of the first embodiment, the cut-off frequency of the first HPF unit 51 and second LPF unit 52 is set to 36 [Hz], which is the specific frequency. In the case of the second embodiment, the cut-off frequency of the first HPF unit 51 and second LPF unit 52 is set to 100 [Hz], which is the specific frequency.

In the low-frequency range complement units 200 and 210, the third LPF unit 57 and the second HPF unit 58 are band-limiting filters for the overtone signal. Accordingly, the cut-off frequency of the third LPF unit 57 and second HPF unit 58 needs to be set in such a way as to be more effective without reducing the effects of the overtone signal.

In general, the cut-off frequency of the third LPF unit 57 is set to a larger value than the cut-off frequency of the second LPF unit 52. According to the first embodiment, the cut-off frequency of the third LPF unit 57 is about twice as high as the cut-off frequency of the second LPF unit 52. According to the second embodiment, the cut-off frequency of the third LPF unit 57 is about 1.3 times as high as the cut-off frequency of the second LPF unit 52. For example, when an overtone signal is to be generated, in order to clarify the effects of the overtone whose frequency is twice as high, it is desirable that the signal level be increased. However, in the case of the overtone whose frequency is more than three times as high, the stronger signal level might cause a listener to recognize abnormal noise. Accordingly, the cut-off frequency of the third LPF unit 57 is set to a larger value than the cut-off frequency of the second LPF unit 52. The signal level of the overtone signal can be more suppressed in the case of the overtone whose frequency is three times as high than in the case of the overtone whose frequency is twice as high. The signal level of the overtone signal can be more suppressed in the case of the overtone whose frequency is four times as high than in the case of the overtone whose frequency is three times as high. In this manner, as the frequency shifts to the high-frequency range, the signal level of the overtone signal can be suppressed in stages. Thus, it is possible to suppress the occurrence of abnormal noise.

The cut-off frequency of the second HPF unit 58 is set to a value that is equal to, or greater than, that of the cut-off frequency of the first HPF unit 51. When the cut-off frequency of the second HPF unit 58 is set to a value that is equal to, or greater than, that of the cut-off frequency of the first HPF unit 51, it is possible to accept the signal level of an overtone signal that is higher than the specific frequency and to more reliably secure the effects of the overtone signal.

In the low-frequency range complement units 200 and 210, the amplification initial values of the amplification unit 59, the first amplification unit 59*a*, and the second amplification unit 75 are determined based on the frequency (specific frequency) where corrections should be made. As described above, the amplification initial value is determined by:

$$\text{Amplification initial value [dB]} = 20 \log_{10}(\text{Specific frequency [Hz]}/\text{Sampling frequency [Hz]})$$

To the amplification initial value that is calculated by the formula, the correction amount that is calculated by the distortion correction unit 100 is added. Then, the overtone signal is amplified. Therefore, it is possible to generate a complement signal that does not cause a listener to feel any sense of discomfort in terms of audibility.

In the low-frequency range complement units 200 and 210 of the first and second embodiments, the correction band extraction signal input is divided by the first HPF unit 51 and the second LPF unit 52 into a high-frequency range signal and a low-frequency range signal. Based on the low-frequency range signal created by the division, an overtone signal is generated. Then, the overtone signal is combined with the high-frequency range signal in the fourth addition unit 61. In this case, the correction band extraction signal that is input to the low-frequency range complement units 200 and 210 is a signal that is generated based on a signal that the peaking filter of the first filter unit 10 has already generated by extracting the specific frequency. Furthermore, as described above, the cut-off frequency of the first HPF unit 51 and second LPF unit 52 is equal to the center frequency of the peaking filter of the first filter unit 10.

However, the filter characteristics (See FIG. 8(*b*)) of the peaking filter of the first filter unit 10 used in the first embodiment are different from the filter characteristics (See FIG. 17(*a*)) of the first HPF unit 51 and second LPF unit 52. More specifically, the signal that has passed through the peaking filter of the first filter unit 10 contains slightly more middle-frequency components than the signal that has passed through the first HPF unit 51 and the second LPF unit 52. Therefore, for example, if the first HPF unit 51, the second LPF unit 52, and the fourth addition unit 61 are omitted to simplify the configuration, and if the correction band extraction signal that is input to the low-frequency range complement unit 200 is used to generate an overtone signal, the overtone signal may contain abnormal noise.

For example, the filter characteristics of the peaking filter may be changed or adjusted in such a way that the signal that has passed through the first filter unit 10 does not contain middle-frequency components, or the filter characteristics of the third LPF unit 57 or second HPF unit 58 which adjusts the band of the generated overtone signal may be changed or adjusted. In this manner, the overtone signal that is generated based on the unchanged correction band extraction signal can have the same characteristics as the signal that is generated by addition by the fourth addition unit 61 (or the signal that is generated by adding a high-frequency component of the correction band extraction signal and an overtone signal that is generated from a low-frequency component).

Figure 35:
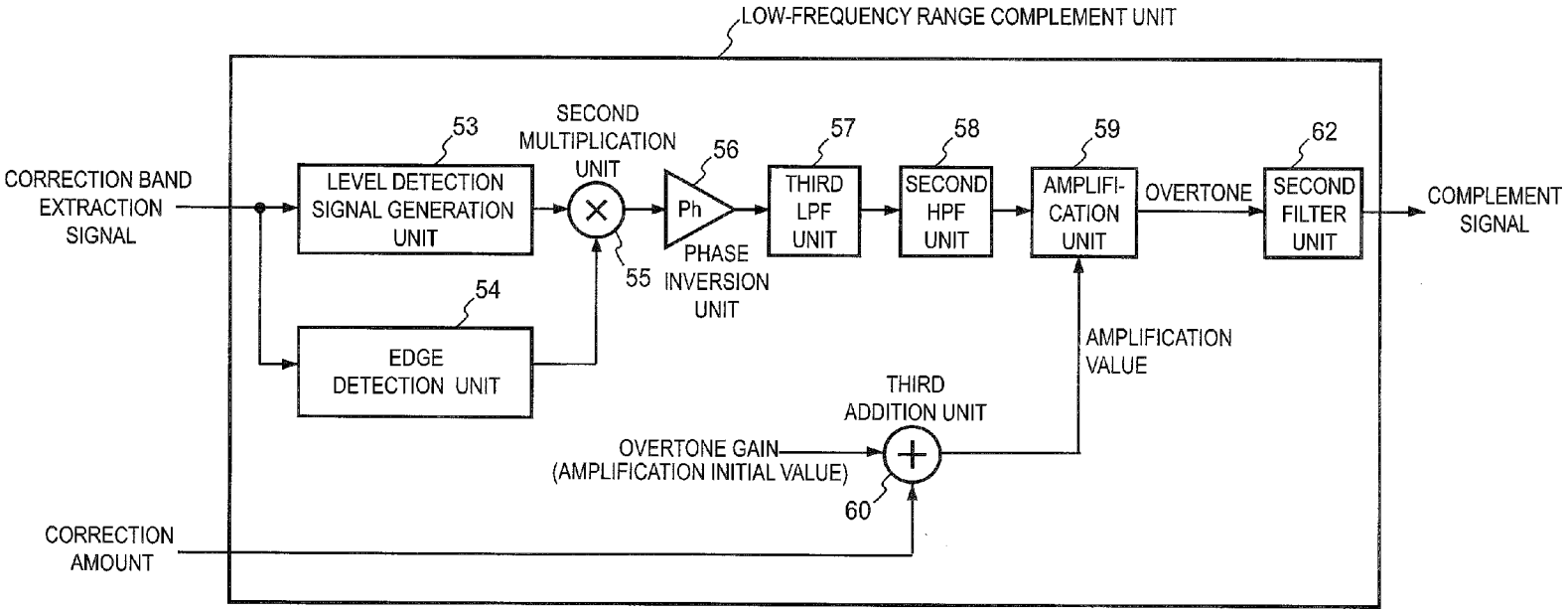
FIG. 35 is a block diagram illustrating the schematic configuration of a low-frequency range complement unit that is made by removing the first HPF unit, the second LPF unit, and the fourth addition unit from the low-frequency range complement unit shown in FIG. 6.

The filter characteristics of the first filter unit 10, or of the third LPF unit 57 and the second HPF unit 58, may be changed or adjusted to remove the first HPF unit 51, the second LPF unit 52, and the fourth addition unit 61 from the configuration of FIG. 6, as shown in FIG. 35. In such a case, the configuration is simplified. Even if the configuration is simplified as described above, the filter characteristics of the first filter unit 10, or of the third LPF unit 57 and the second HPF unit 58, are changed or adjusted. Therefore, as in the case of the first and second embodiments, it is possible to suppress the occurrence of distorted sound due to the complement signal that is generated by the overtone signal that is generated by using the correction band extraction signal that is input. As a result, it is possible to generate the output signal that does not cause a listener to feel any sense of discomfort in terms of audibility.

REFERENCE SIGNS LIST

1, 2, 3 distortion sound correction low-frequency range complement device (distortion sound correction complement device)
10 first filter unit
20 signal level detection unit
32 first lookup table unit
34 second lookup table unit
41 first multiplication unit (correction band extraction signal generation unit)
42 second addition unit (correction signal generation unit)
53 level detection signal generation unit
54 edge detection unit (first edge detection unit)
54*a* first edge detection unit
55 second multiplication unit (first weighting unit)
56 phase inversion unit (first phase inversion unit)
56*a* first phase inversion unit
57 third LPF unit (low-pass filter unit)
58 second HPF unit (high-pass filter unit)
59 amplification unit (first amplification unit)
59*a* first amplification unit
61 fourth addition unit (addition unit)
62 second filter unit
71 second edge detection unit
72 third multiplication unit (second weighting unit)
73 second phase inversion unit
74 peaking filter unit
75 second amplification unit
81 fifth addition unit
300 first addition unit (output signal generation unit)

The invention claimed is:

1. A distortion sound correction complement device that regards a frequency at which distortion occurs in a speaker that outputs an output signal as a specific frequency, and a maximum signal level at which the output signal output from the speaker is not distorted at the specific frequency as a specific signal level, the device comprising:

a first filter unit that performs, by using a peaking filter whose center frequency is the specific frequency, a filter process on an input signal in order to generate a correction band signal;

a signal level detection unit that calculates an absolute value of amplitude of the correction band signal to perform maximum-value detection in order to detect a signal level of the correction band signal;

a first lookup table unit that determines, based on the signal level detected by the signal level detection unit, a ratio of a signal level that has exceeded the specific signal level to the detected signal level as a value of a control signal;

a second lookup table unit that determines, based on the signal level detected by the signal level detection unit, a correction amount that is used to amplify an overtone signal that is generated based on the specific frequency;

a correction band extraction signal generation unit that multiplies the correction band signal by the control signal in order to generate a correction band extraction signal;

a correction signal generation unit that subtracts the correction band extraction signal from the input signal in order to generate a correction signal;

a level detection signal generation unit that calculates an absolute value of the correction band extraction signal and cuts DC components in order to generate a level detection signal;

a first edge detection unit that detects a timing at which the correction band extraction signal turns positive after being negative in order to generate, as the overtone signal, an impulse train whose amplitude is 1;

a first weighting unit that multiplies the overtone signal by the level detection signal in order to add weight to the overtone signal;

a first phase inversion unit that inverts phase of the overtone signal to which the first weighting unit adds weight;

a low-pass filter unit that performs, by using a low-pass filter, a filter process on the overtone signal whose phase is inverted by the first phase inversion unit, in order to suppress a high-frequency range signal level of the overtone signal;

a high-pass filter unit that suppresses a low-frequency range signal level of the overtone signal on which the low-pass filter unit performs the filter process;

a first amplification unit that multiplies the overtone signal on which the high-pass filter unit performs a filter process by gain that is calculated by adding the correction amount to an amplification initial value that is determined based on the input signal, in order to amplify the overtone signal;

a second filter unit that performs, by using a filter having inverse characteristics of the peaking filter used by the first filter unit, a filter process on the overtone signal amplified by the first amplification unit in order to suppress a signal level of the specific frequency in the amplified overtone signal and thereby generate a complement signal; and an output signal generation unit that adds the complement signal to the correction signal in order to generate an output signal.

2. The distortion sound correction complement device according to claim 1, wherein a cut-off frequency of the low-pass filter used by the low-pass filter unit is set to a higher frequency than the center frequency of the peaking filter used by the first filter unit.

3. The distortion sound correction complement device according to claim 1, wherein the amplification initial value is determined by:

amplification initial value [dB]=20 $\log_{10}$(Specific frequency [Hz]/Sampling frequency [Hz])

in accordance with a sampling frequency of the input signal and the specific frequency.

4. The distortion sound correction complement device according to claim 1, wherein the value of the control signal that is determined by the first lookup table unit is a gain coefficient indicating the ratio of a signal level that has exceeded the specific signal level to the detected signal level, if the value is less than or equal to the specific signal level, the gain coefficient is set to 0, and if the value is greater than the specific signal level, the gain coefficient is set to a value that is greater than 0 but less than 1 depending on how much the detected signal level increases.

5. The distortion sound correction complement device according to claim 1, wherein if the signal level of the correction band signal is less than or equal to the specific signal level, the correction amount that is determined by the second lookup table unit is 0, and if the signal level of the correction band signal is greater than the specific signal level, the correction amount is determined based on a value of a difference between the signal level of the correction band signal and the specific signal level.

6. The distortion sound correction complement device according to claim 1, comprising:

a second edge detection unit that generates, as a ½ overtone signal, a signal with an amplitude of 1 that is generated by removing every other pulse from an impulse train that is generated by detecting a timing at which the correction band extraction signal turns positive after being negative;

a second weighting unit that multiplies the ½ overtone signal by the level detection signal in order to add weight to the ½ overtone signal;

a second phase inversion unit that inverts phase of the ½ overtone signal to which the second weighting unit adds weight;

a peaking filter unit that performs, by using a peaking filter whose center frequency is half the specific frequency, a filter process on the ½ overtone signal whose phase is inverted by the second phase inversion unit;

a second amplification unit that multiplies the ½ overtone signal on which the peaking filter unit performs the filter process by gain that is calculated by adding the correction amount to a ½-overtone amplification initial value that is calculated by 20 $\log_{10}$ (Specific frequency [Hz]/2×Sampling frequency of input signal [Hz]), in order to amplify the ½ overtone signal; and an addition unit that adds the overtone signal amplified by the first amplification unit and the ½ overtone signal amplified by the second amplification unit in order to generate a new overtone signal, wherein the second filter unit performs, by using a filter having inverse characteristics of the peaking filter used by the first filter unit, a filter process on the new overtone signal generated by the addition unit in order to suppress a signal level of the specific frequency in the new overtone signal and thereby generate a complement signal, and the output signal generation unit adds the complement signal to the correction signal in order to generate an output signal.

7. A distortion sound correction complement method for a distortion sound correction complement device that regards a frequency at which distortion occurs in a speaker that outputs an output signal as a specific frequency, and a maximum signal level at which the output signal output from the speaker is not distorted at the specific frequency as a specific signal level, the method comprising:

a correction band signal generation step by a first filter unit of performing, by using a peaking filter whose center frequency is the specific frequency, a filter process on an input signal in order to generate a correction band signal;

a signal level detection step by a signal level detection unit of calculating an absolute value of amplitude of the correction band signal to perform maximum-value detection in order to detect a signal level of the correction band signal;

a control signal determination step by a first lookup table unit of determining, based on the signal level detected at the signal level detection step, a ratio of a signal level that has exceeded the specific signal level to the detected signal level as a value of a control signal;

a correction amount determination step by a second lookup table unit of determining, based on the signal level detected at the signal level detection step, a correction amount that is used to amplify an overtone signal that is generated based on the specific frequency;

a correction band extraction signal generation step by a correction band extraction signal generation unit of multiplying the correction band signal by the control signal in order to generate a correction band extraction signal;

a correction signal generation step by a correction signal generation unit of subtracting the correction band extraction signal from the input signal in order to generate a correction signal;

a level detection signal generation step by a level detection signal generation unit of calculating an absolute value of the correction band extraction signal and cutting DC components in order to generate a level detection signal;

an overtone signal generation step by a first edge detection unit of detecting a timing at which the correction band extraction signal turns positive after being negative in order to generate, as the overtone signal, an impulse train whose amplitude is 1;

a first weighting step by a first weighting unit of multiplying the overtone signal by the level detection signal in order to add weight to the overtone signal;

a first phase inversion step by a first phase inversion unit of inverting phase of the overtone signal which is added weight at the first weighting step;

a low-pass filter processing step by a low-pass filter unit of performing, by using a low-pass filter, a filter process on the overtone signal whose phase is inverted at the first phase inversion step, in order to suppress a high-frequency range signal level of the overtone signal;

a high-pass filter processing step by a high-pass filter unit of suppressing a low-frequency range signal level of the overtone signal on which is performed the filter process at the low-pass filter processing step;

a first amplification step by a first amplification unit of multiplying the overtone signal on which is performed a filter process at the high-pass filter processing step by gain that is calculated by adding the correction amount to an amplification initial value that is determined based on the input signal, in order to amplify the overtone signal;

a complement signal generation step by a second filter unit of performing, by using a filter having inverse characteristics of the peaking filter used at the correction band signal generation step, a filter process on the overtone signal amplified at the first amplification step in order to suppress a signal level of the specific frequency in the amplified overtone signal and thereby generate a complement signal; and an output signal generation step by an output signal generation unit of adding the complement signal to the correction signal in order to generate an output signal.

8. The distortion sound correction complement method for the distortion sound correction complement device according to claim 7, wherein a cut-off frequency of the low-pass filter used at the low-pass filter processing step is set to a higher frequency than the center frequency of the peaking filter used at the correction band signal generation step.

9. The distortion sound correction complement method for the distortion sound correction complement device according to claim 7, wherein the amplification initial value is determined by:

$$\text{amplification initial value [dB]} = 20 \log_{10}(\text{Specific frequency [Hz]}/\text{Sampling frequency [Hz]})$$

in accordance with a sampling frequency of the input signal and the specific frequency.

10. The distortion sound correction complement method for the distortion sound correction complement device according to claim 7, wherein the value of the control signal that is determined at the control signal determination step is a gain coefficient indicating the ratio of a signal level that has exceeded the specific signal level to the detected signal level, if the value is less than or equal to the specific signal level, the gain coefficient is set to 0, and if the value is greater than the specific signal level, the gain coefficient is set to a value that is greater than 0 but less than 1 depending on how much the detected signal level increases.

11. The distortion sound correction complement method for the distortion sound correction complement device according to claim 7, wherein if the signal level of the correction band signal is less than or equal to the specific signal level, the correction amount that is determined at the correction amount determination step is 0, and if the signal level of the correction band signal is greater than the specific signal level, the correction amount is determined based on a value of a difference between the signal level of the correction band signal and the specific signal level.

12. The distortion sound correction complement method for the distortion sound correction complement device according to claim 7, comprising:

a ½ overtone signal generation step by a second edge detection unit of generating, as a ½ overtone signal, a signal with an amplitude of 1 that is generated by removing every other pulse from an impulse train that is generated by detecting a timing at which the correction band extraction signal turns positive after being negative;

a second weighting step by a second weighting unit of multiplying the ½ overtone signal by the level detection signal in order to add weight to the ½ overtone signal;

a second phase inversion step by a second phase inversion unit of inverting phase of the ½ overtone signal which is added weight at the second weighting step;

a peaking filter processing step by a peaking filter unit of performing, by using a peaking filter whose center frequency is half the specific frequency, a filter process on the ½ overtone signal whose phase is inverted at the second phase inversion step;

a second amplification step by a second amplification unit of multiplying the ½ overtone signal on which is performed the filter process at the peaking filter processing step by gain that is calculated by adding the correction amount to a ½-overtone amplification initial value that is calculated by $20 \log_{10}$ (Specific frequency [Hz]/2× Sampling frequency of input signal [Hz]), in order to amplify the ½ overtone signal; and an addition step by an addition unit of adding the overtone signal amplified at the first amplification step and the ½ overtone signal amplified at the second amplification step in order to generate a new overtone signal, wherein at the complement signal generation step, the second filter unit performs, by using a filter having inverse characteristics of the peaking filter used at the correction band signal generation step, a filter process on the new overtone signal generated by the addition unit in order to suppress a signal level of the specific frequency in the new overtone signal and thereby generate a complement signal, and at the output signal generation step, the output signal generation unit adds the complement signal to the correction signal in order to generate an output signal.

* * * * *